US009636918B2

(12) United States Patent
Okuno et al.

(10) Patent No.: US 9,636,918 B2
(45) Date of Patent: May 2, 2017

(54) LIQUID CONTAINER, LIQUID CONSUMPTION APPARATUS, AND ELECTRICAL CONNECTOR

(71) Applicant: SEIKO EPSON CORPORATION, Tokyo (JP)

(72) Inventors: Tokujiro Okuno, Kitakyushu (JP); Yoshiyuki Tanaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/844,251

(22) Filed: Sep. 3, 2015

(65) Prior Publication Data

US 2016/0067978 A1 Mar. 10, 2016

(30) Foreign Application Priority Data

Sep. 5, 2014 (JP) ..... 2014-181174

(51) Int. Cl.
*B41J 2/175* (2006.01)
*B41J 29/13* (2006.01)

(52) U.S. Cl.
CPC ..... *B41J 2/17526* (2013.01); *B41J 2/1753* (2013.01); *B41J 2/17513* (2013.01); *B41J 2/17553* (2013.01); *B41J 29/13* (2013.01)

(58) Field of Classification Search
CPC B65D 23/104; B65D 25/282; B65D 25/2882; B65D 35/245; B65D 35/56; B65D 35/565; B65D 77/06; B65D 77/065; B65D 77/067
See application file for complete search history.

(56) References Cited

U.S. PATENT DOCUMENTS 6,763,973 B1 * 7/2004 Hudkins ..... B65D 21/023 222/1
6,913,342 B2 * 7/2005 Dewey ..... B41J 2/17553 347/49
2002/0066735 A1 * 6/2002 Hewlitt ..... B65D 77/06 220/495.03

(Continued)

FOREIGN PATENT DOCUMENTS

EP 2127884 A2 12/2009
EP 2127884 A3 9/2010

(Continued)

OTHER PUBLICATIONS

European Search Report issued on Oct. 21, 2016 in European Patent Application No. 15183863.8.

*Primary Examiner* — Shelby Fidler
(74) *Attorney, Agent, or Firm* — Stroock & Stroock & Lavan LLP

(57) ABSTRACT

A liquid container that supplies a liquid to a liquid consumption apparatus via a liquid introduction part disposed in the liquid consumption apparatus. The liquid container includes: a liquid container part that stores the liquid; a liquid supply part that is in communication with an inside of the liquid container part, that has a liquid supply opening facing in a first direction, and that the liquid introduction part is to be connected to, the first direction being a longitudinal direction of one end portion of the liquid container part; and an operation part that is connected to the liquid container part and that has a grip part that is grippable.

24 Claims, 38 Drawing Sheets

(56) References Cited

U.S. PATENT DOCUMENTS

2002/0097904 A1* 7/2002 White ..... G06K 9/3275 382/151
2002/0171713 A1* 11/2002 Ueno ..... B41J 2/17509 347/49
2003/0094464 A1* 5/2003 Decottignies ..... B05B 11/0005 222/105
2004/0094571 A1* 5/2004 Rani ..... A61J 1/10 222/92
2009/0290001 A1* 11/2009 Domae ..... B41J 2/17513 347/85
2012/0327163 A1 12/2012 Mizuno
2013/0182051 A1 7/2013 Aoki et al.
2013/0281964 A1 10/2013 Kugelmann et al.
2014/0094574 A1* 4/2014 Cho ..... C08L 23/08 526/64
2014/0360596 A1* 12/2014 Tsukahara ..... B41J 2/17509 137/376
2014/0362148 A1* 12/2014 Ishizawa ..... B41J 2/17523 347/86
2015/0085026 A1* 3/2015 Karasawa ..... B41J 2/1752 347/85

FOREIGN PATENT DOCUMENTS

JP 2001002085 A * 1/2001
JP 2001-150691 A 6/2001
JP 2001-232812 A 8/2001
JP 2006-069030 A 3/2008
WO 97/42035 A1 11/1997

* cited by examiner

CROSS-SECTIONAL VIEW ALONG F3B-F3B

CROSS-SECTIONAL VIEW ALONG F4A-F4A

VIEW IN DIRECTION OF ARROW F18

CROSS-SECTIONAL VIEW ALONG F24-F24

LIQUID CONTAINER, LIQUID CONSUMPTION APPARATUS, AND ELECTRICAL CONNECTOR

BACKGROUND

1. Technical Field

The present invention relates to a liquid consumption apparatus and technology used in the liquid consumption apparatus.

2. Related Art

A technology by which an ink bag is attached to a side of a printer housing is known (e.g., WO 97/42035). According to the technology disclosed in WO 97/42035, ink in the ink bag is supplied to a cartridge via a supply tube. The cartridge is attached to the inside of the printer and is disposed on a carriage.

According to the technology disclosed in WO 97/42035, when attaching an ink bag to a printer, an ink supply part of the ink bag needs to be connected to the tip of the supply tube, which is unfixed and in a free state. Therefore, in some cases it is difficult to attach the ink bag to the printer. Also, since the ink bag is flexible, the shape of the ink bag changes when the user grips the ink bag to attach/detach the ink bag to/from the printer. Therefore, the operability of the ink bag is reduced in some cases. Also, when a plurality of ink bags are arranged in a printer, an attachment operation space, which is the space used for attaching the ink bags, may be large in the lateral direction (the horizontal direction).

Such problems are not only limited to the technology of providing ink to a printer, but are common to liquid consumption apparatuses that discharge a liquid, and to technology used in liquid consumption apparatuses.

Therefore, advantages of some aspects of the invention is to solve at least some of the above-described problems, and its first advantage is to provide a technology that makes it easy to connect a liquid container, which is at least partially flexible, to a liquid introduction part of a liquid consumption apparatus. A second advantage is to provide a technology that improves the operability of the liquid container when attaching/detaching the liquid container to/from the liquid consumption apparatus. A third advantage is to provide a technology that reduces the attachment operation space, which is the space used for attaching the liquid container to the liquid consumption apparatus. Also, in the related arts, there are the demands for cost reduction, resource saving, simplification of manufacturing, improvements in usability, the technology for simplifying the configuration, and so on.

SUMMARY

An advantage of some aspects of the invention is to solve at least some of the above-described problems, and the invention may be implemented in the following modes.

(1) One mode of the invention provides a liquid container that supplies a liquid to a liquid consumption apparatus via a liquid introduction part disposed in the liquid consumption apparatus. This liquid container includes: a liquid container part that stores the liquid; a liquid supply part that is in communication with an inside of the liquid container part, that has a liquid supply opening facing in a first direction, and that the liquid introduction part is to be connected to, the first direction being a longitudinal direction of one end portion of the liquid container part; and an operation part that is connected to the liquid container part and that has a grip part that is grippable.

With the liquid container according to this mode, the user can easily operate the operation part by gripping the grip part of the operation part. Also, since the operation part having the grip part is connected to the liquid container part, the user can connect the liquid supply part to the liquid introduction part by moving the operation part. Also, since the liquid supply opening faces the first direction, which is the longitudinal direction of the one end portion of the liquid container part, this configuration can reduce the attachment operation space for the liquid container in the direction that intersects the attaching direction in which the liquid container is attached to the liquid consumption apparatus.

(2) In the liquid container according to the above-described mode, the operation part may be located on the side of the one end portion of the liquid container part.

With the liquid container according to this mode, the operation part is located on the side of the one end portion of the liquid container part, and accordingly, when the grip part of the operation part is gripped, the other end portion of the liquid container part is suspended vertically below the one end portion due to its own weight. Therefore, this configuration makes the orientation of the liquid container stable when the grip part is gripped, and allows the user to easily operate the liquid container.

(3) In the liquid container according to the above-described mode, the liquid supply part may be supported by the operation part.

With the liquid container according to this mode, the position of the liquid supply part can be easily changed by changing the position of the liquid supply part.

(4) In the liquid container according to the above-described mode, the grip part may be disposed such that a longitudinal direction of the grip part is parallel with the longitudinal direction of the one end portion.

With the liquid container according to this mode, the liquid container can be reduced in thickness compared to when the longitudinal direction of the grip part is the direction that intersects the longitudinal direction of the one end portion.

(5) In the liquid container according to the above-described mode, the operation part may further include a color identification part for identifying a color of the liquid stored in the liquid container part.

With the liquid container according to this mode, the color of the liquid in the liquid container part is easily identifiable.

(6) In the liquid container according to the above-described mode, the operation part may further include: a second side part that extends from the grip part, which is a first side part, in a direction intersecting the longitudinal direction of the one end portion; and a third side part that extends from the grip part in a direction intersecting the longitudinal direction of the one end portion, and that opposes the second side part, and the third side part may have an opening that allows a user's hand to move therethrough toward the second side part.

With the liquid container according to this mode, the user can easily grip the grip part, which is the first side part of the operation part, by inserting a hand of the user into the opening.

(7) In the liquid container according to the above-described mode, the liquid introduction part may be disposed on the side of a left side face of the liquid consumption apparatus when the liquid consumption apparatus is seen from a front face thereof. When the liquid consumption apparatus is seen from vertically above, in an attached state in which the liquid container is attached to the liquid consumption apparatus, an angle formed between the longitudinal direction of the grip part and the left side face, in a clockwise direction from the left side face, may be equal to or greater than 0 degrees and less than 90 degrees, and a direction in which the liquid supply part is connected to the liquid introduction part may be a direction having forward and backward components, in which the front face and a back face of the liquid consumption apparatus oppose each other.

With the liquid container according to this mode, the liquid consumption system including the liquid consumption apparatus and the liquid container can be prevented from increasing in size in the lateral direction. Also, when the liquid container is attached to the liquid consumption apparatus, the attachment operation space for the liquid container in the lateral direction can be reduced.

(8) In the liquid container according to the above-described mode, the liquid introduction part may be disposed on the side of a right side face of the liquid consumption apparatus when the liquid consumption apparatus is seen from a front face thereof. When the liquid consumption apparatus is seen from vertically above, in an attached state in which the liquid container is attached to the liquid consumption apparatus, an angle formed between the longitudinal direction of the grip part and the right side face, in a counterclockwise direction from the right side face, may be equal to or greater than 0 degrees and less than 90 degrees, and a direction in which the liquid supply part is connected to the liquid introduction part may be a direction having forward and backward components, in which the front face and a back face of the liquid consumption apparatus oppose each other.

With the liquid container according to this mode, the liquid consumption system including the liquid consumption apparatus and the liquid container can be prevented from increasing in size in the lateral direction. Also, when the liquid container is attached to the liquid consumption apparatus, the operation space for the liquid container in the lateral direction can be reduced.

(9) The liquid container according to the above-described mode may include a container-side engagement part that is configured to be able to engage with an apparatus-side engagement part that is disposed on the liquid consumption apparatus so as to be able to support the liquid container.

With the liquid container according to this mode, the liquid container can be supported on the liquid consumption apparatus by the container-side engagement part.

(10) Another mode of the invention provides a liquid container that supplies a liquid to a liquid consumption apparatus via a liquid introduction part disposed in the liquid consumption apparatus. This liquid container includes: a liquid container part that stores the liquid; a liquid supply part that is in communication with an inside of the liquid container part, that has a liquid supply opening facing in a first direction, and that the liquid introduction part is to be connected to, the first direction being a longitudinal direction of one end portion of the liquid container part; and a container-side engagement part that is configured to be able to engage with an apparatus-side engagement part that is disposed on the liquid consumption apparatus so as to be able to support the liquid container.

With the liquid container according to this mode, the liquid supply opening faces the first direction, which is the longitudinal direction of the one end portion of the liquid container part, and accordingly this configuration can reduce the attachment operation space for the liquid container in the direction that intersects the attaching direction in which the liquid container is attached to the liquid consumption apparatus. Also, the liquid container can be supported on the liquid consumption apparatus by the container-side engagement part.

(11) In the liquid container according to the above-described mode, the container-side engagement part may be disposed along a direction that is parallel with the longitudinal direction of the one end portion.

With the liquid container according to this mode, the liquid container can be more stably supported on the liquid consumption apparatus by the container-side engagement part.

(12) The liquid container according to the above-described mode may further include: a container-side electrical connection part having a contact part that is configured to be able to be brought into contact with an apparatus-side electrical connection part that is provided in the liquid consumption apparatus.

With the liquid container according to this mode, the container-side electrical connection part can be electrically connected to the apparatus-side electrical connection part. With this configuration, various kinds of information (e.g. the color of the liquid stored in the liquid container part, the amount of remaining liquid) can be exchanged between the liquid container and the liquid consumption apparatus, for example.

(13) The liquid container according to the above-described mode may further include: a container-side electrical connection part having a contact part that is configured to be able to be brought into contact with an apparatus-side electrical connection part that is provided in the liquid consumption apparatus, the container-side electrical connection part being supported by the operation part.

With the liquid container according to this mode, the container-side electrical connection part can be electrically connected to the apparatus-side electrical connection part. With this configuration, various kinds of information (e.g. the color of the liquid stored in the liquid container part, the amount of remaining liquid) can be exchanged between the liquid container and the liquid consumption apparatus, for example.

(14) In the liquid container according to the above-described mode, in an attached state in which the liquid container is attached to the liquid consumption apparatus, a longitudinal direction of the grip part may extend in a direction that intersects a vertical direction, and when the operation part is projected onto a plane that is perpendicular to the longitudinal direction of the grip part, the liquid supply part and the contact part may be arranged side-by-side or at least partially overlap in the vertical direction.

With the liquid container according to this mode, the liquid container is prevented from increasing in size in the direction that is perpendicular to the longitudinal direction of the grip part and to the vertical direction.

(15) In the liquid container according to the above-described mode, the contact part may be disposed on an inclined surface that is inclined with respect to the first direction.

With the liquid container according to this mode, the contact part and the apparatus-side electrical connection part slide against each other immediately before they are brought into contact, and accordingly foreign objects adhering to the contact part can be removed. This configuration can reduce the possibility of an electrical connection failure occurring between the contact part and the apparatus-side electrical connection part.

(16) In the liquid container according to the above-described mode, the contact part may be provided in a plurality, and a plane defined by the plurality of contact parts may be inclined with respect to a connecting direction of the liquid container, in which the plurality of contact parts are connected to the apparatus-side electrical connection part.

With the liquid container according to this mode, the contact part and the apparatus-side electrical connection part slide against each other immediately before they are brought into contact, and accordingly foreign objects adhering to the contact part can be removed. This configuration can reduce the possibility of an electrical connection failure occurring between the contact part and the apparatus-side electrical connection part.

(17) In the liquid container according to the above-described mode, the contact part may be provided in a plurality, and the plurality of contact parts may be arranged along a direction that intersects the first direction.

With the liquid container according to this mode, a plurality of contact parts can be disposed along the first direction.

(18) The liquid container according to the above-described mode may further include: a container-side electrical connection part having a contact part that is configured to be able to be brought into contact with an apparatus-side electrical connection part that is provided in the liquid consumption apparatus, wherein at least one of the liquid supply part and the container-side electrical connection part, and the grip part, may be arranged side-by-side in the first direction.

With the liquid container according to this mode, the liquid container can be reduced in size in the direction that intersects the first direction. Also, the liquid supply part can be easily connected to the liquid introduction part, or the container-side electrical connection part can be easily connected to the apparatus-side electrical connection parts, by operating the grip part.

(19) In the liquid container according to the above-described mode, the container-side electrical connection part may further include a contact point positioning part that determines a position of the contact part with respect to the apparatus-side electrical connection part when the contact part is brought into contact with the apparatus-side electrical connection part.

With the liquid container according to this mode, the contact point positioning part prevents misalignment of the contact part and the apparatus-side electrical connection part.

(20) In the liquid container according to the above-described mode, in an attached state in which the liquid container is attached to the liquid consumption apparatus, the liquid supply part may be located at a higher level than the liquid container part.

With the liquid container according to this mode, when operating the liquid container, it is possible to easily check the position of the liquid supply part.

(21) The liquid container according to the above-described mode may include a communication flow channel that allows for communication between the liquid supply part and the liquid container part, and that intersects the one end portion.

With the liquid container according to this mode, the liquid in the liquid container part can be distributed to the liquid supply part via the communication flow channel.

(22) In the liquid container according to the above-described mode, the liquid supply part may have a supply opening positioning part that determines a position of the liquid supply opening with respect to the liquid introduction part when the liquid supply opening is connected to the liquid introduction part.

With the liquid container according to this mode, misalignment of the liquid supply opening and the liquid introduction part when the liquid supply opening is connected to the liquid introduction part can be prevented.

(23) In the liquid container according to the above-described mode, the liquid container part may include: a first face and a second face that oppose each other in a direction that is perpendicular to the longitudinal direction of the one end portion, and that are flexible; and a junction part that partially connects respective inner surfaces of the first face and the second face.

With the liquid container according to this mode, the liquid container part is prevented from localized large bulging in the direction in which the first face and the second face oppose each other.

(24) The liquid container according to the above-described mode may further include a restriction member that is attached to a flexible deformable face from among faces constituting the liquid container part, and that is more rigid than the deformable face.

With the liquid container according to this mode, the deformable face of the liquid container part is prevented from excessively bulging.

(25) Yet another mode of the invention provides a liquid container that supplies a liquid to a liquid consumption apparatus via a liquid introduction part disposed in the liquid consumption apparatus. The liquid container according to this mode includes: a liquid container part that has a first face and a second face that are flexible and oppose each other, the liquid container storing a liquid; a liquid supply part that is in communication with an inside of the liquid container part, and that the liquid introduction part is to be connected to; and a junction part that partially connects respective inner surfaces of the first face and the second face.

With the liquid container according to this mode, the liquid container part is prevented from localized large bulging in the direction in which the first face and the second face oppose each other.

(26) Yet another mode of the invention provides a liquid container that is to be attached to a liquid consumption apparatus and that supplies a liquid to the liquid consumption apparatus. This liquid container includes: a liquid container part that is at least partially flexible and that stores the liquid; a liquid supply part that has a central axis extending along a straight line, and that a liquid introduction part of the liquid consumption apparatus is to be connected to; and an operation part connected to the liquid container part. The operation part includes: a first side part that is grippable, and that extends in a direction that is parallel with a direction in which the central axis extends; and a second side part that intersects the first side part and that supports the liquid supply part.

With the liquid container according to this mode, the user can easily operate the operation part by gripping the first side part of the operation part. Also, since the operation part having the first side part is connected to the liquid container part, the user can connect the liquid supply part to the liquid introduction part by moving the operation part. Also, the first side part extends in the direction that is parallel with the direction in which the central axis extends, and accordingly this configuration can reduce the attachment operation space for the liquid container in the direction that intersects the attaching direction in which the liquid container is attached to the liquid consumption apparatus.

(27) Yet another mode of the invention provides a liquid container that is to be attached to a liquid consumption apparatus and that supplies a liquid to the liquid consumption apparatus. This liquid container includes: a liquid supply part that is to be connected to the liquid introduction part; a liquid container part that is at least partially flexible, and that has one end portion extending in a direction that is parallel with a connecting direction in which the liquid supply part is connected to the liquid introduction part in a state in which the liquid container is attached to the liquid consumption apparatus; and an operation part connected to the liquid container part. The operation part includes: a first side part that is grippable; and a second side part that extends from one end portion of the first side part of the operation part in a longitudinal direction of the one end portion of the liquid container part, the second side part extending in a direction that intersects the longitudinal direction, and the liquid supply part is supported by the second side part.

With the liquid container according to this mode, the user can easily operate the operation part by gripping the first side part of the operation part. Also, since the operation part having the first side part is connected to the liquid container part, the user can connect the liquid supply part to the liquid introduction part by moving the operation part. Also, since the second side part that supports the liquid supply part extends in the direction that intersects the longitudinal direction, this configuration can reduce the attachment operation space for the liquid container in the direction that intersects the attaching direction (connecting direction) in which the liquid container is attached to the liquid consumption apparatus.

(28) Yet another mode of the invention provides a liquid consumption apparatus. This liquid consumption apparatus includes: a housing that houses therein a head that discharges a liquid; a liquid introduction part to which the liquid supply part of the liquid container according to the above-described mode is connectable, the liquid introduction part being located outside the housing.

With the liquid consumption apparatus according to this mode, the liquid introduction part is located outside the housing, and accordingly it is easy to connect the liquid introduction part and the liquid supply part compared to when the liquid introduction part is located inside the housing.

(29) Yet another mode of the invention provides a liquid consumption apparatus. This liquid consumption apparatus includes: a housing that houses therein a head that discharges a liquid; a liquid introduction part to which the liquid supply part of the liquid container according to the above-described mode is connectable; and an apparatus-side engagement part that engages with the container-side engagement part of the liquid container and that is configured to support the liquid container.

With the liquid consumption apparatus according to this mode, the liquid container can be supported by the apparatus-side engagement part. Also, since the apparatus-side engagement part is located outside the housing, it is easy to check the position of the apparatus-side engagement part compared to when the apparatus-side engagement part is located inside the housing.

(30) Yet another mode of the invention provides a liquid consumption apparatus. This liquid consumption apparatus includes: a housing that houses therein a head that discharges a liquid; and an apparatus-side electrical connection part that is brought into contact with the contact part of the liquid container according to the above-described mode, the apparatus-side electrical connection part being located outside the housing.

With the liquid consumption apparatus according to this mode, since the apparatus-side electrical connection part is located outside the housing, it is easy to connect the apparatus-side electrical connection part and the contact part compared to when the apparatus-side electrical connection part is located inside the housing.

(31) Yet another mode of the invention provides a liquid consumption apparatus. This liquid consumption apparatus includes: a plurality of liquid introduction parts to which the liquid supply part of the liquid container is connectable; and a partition part that is disposed between two adjacent liquid introduction parts and that partitions a container space part that houses the liquid container.

With the liquid consumption apparatus according to this mode, since the partition part partitions adjacent container spaces, adjacent liquid containers are prevented from hitting each other, and it is easy to perform the operation to attach the liquid containers.

(32) Yet another mode of the invention provides an electrical connector. This electrical connector includes: an operation part that includes a first side part that is grippable, and a second side part that extends from one end portion of the first side part of the operation part in a longitudinal direction of the first side part, the second side part extending in a direction that intersects the first side part; and a connector-side electrical contact part that is configured to be able to be brought into contact with an apparatus-side electrical connection part that is provided in a liquid consumption apparatus, the connector-side electrical contact part being provided on the second side part.

With the electrical connector according to this mode, the user can easily operate the operation part by gripping the first side part of the operation part.

(33) In the electrical connector according to the above-described mode, the contact part may be disposed on an inclined surface that is inclined with respect to the first direction.

With the electrical connector according to this mode, the contact part and the apparatus-side electrical connection part slide against each other immediately before they are brought into contact, and accordingly foreign objects adhering to the contact part can be removed. This configuration can reduce the possibility of an electrical connection failure occurring between the contact part and the apparatus-side electrical connection part.

(34) In the electrical connector according to the above-described mode, the contact part may be provided in a plurality, and a plane defined by the plurality of contact parts may be inclined with respect to a connecting direction of the electrical connector, the connecting direction being a direction in which the plurality of contact parts are electrically connected to the apparatus-side electrical connection part.

With the electrical connector according to this mode, the contact part and the apparatus-side electrical connection part slide against each other immediately before they are brought into contact, and accordingly foreign objects adhering to the contact part can be removed. This configuration can reduce the possibility of an electrical connection failure occurring between the contact part and the apparatus-side electrical connection part.

(35) The electrical connector according to the above-described mode may further include a liquid supply part that is provided on the second side part and that is to be connected to a liquid introduction part of the liquid consumption apparatus, and when the operation part is projected onto a plane that is perpendicular to the longitudinal direction of the first side part, at least part of the liquid supply part and at least part of the contact part may be arranged side-by-side in a direction that is perpendicular to the longitudinal direction and that is a direction in which the second side part extends.

With the electrical connector according to this mode, the electrical connector is prevented from increasing in size in the direction that is perpendicular to the longitudinal direction of the operation part and the direction in which the second side part extends.

(36) Yet another mode of the invention provides an electrical connector that is to be connected to a liquid introduction part provided in a liquid consumption apparatus. This electrical connector includes: a liquid supply part that is to be connected to the liquid introduction part; an engagement part that is connected to the liquid supply part and that is configured to engage with an apparatus-side engagement part provided in the liquid consumption apparatus; and a contact part that is to be connected to the liquid supply part, that is disposed so as to at least partially overlap the liquid supply part in a vertical direction when the liquid supply part is connected to the liquid introduction part, and that is configured to be able to be brought into contact with an apparatus-side electrical connection part that is provided in the liquid consumption apparatus.

With the electrical connector according to this mode, the contact part is disposed so as to at least partially overlap the liquid supply part in the vertical direction, and accordingly the electrical connector is prevented from increasing in size in the direction that intersects the vertical direction.

The constituent elements included according to the above-described modes of the invention are not all essential, and in order to solve some or all of the above-described problems or achieve some or all of the advantageous effects described in this specification, some of the constituent elements can be modified, omitted, or replaced with other constituent elements as necessary, and the limiting content can be partially omitted. Also, in order to solve some or all of the above-described problems or achieve some or all of the above-described advantageous effects, some or all of the technical features in any of the above-described modes of the invention can be combined with some or all of the technical features included in another one of the above-described modes of the invention so as to obtain an independent mode of the invention.

For example, one mode of the invention can be implemented as an apparatus that includes at least one element out of a plurality of elements, namely the liquid container part, the operation part, and the liquid supply part. In other words, this apparatus may have or may not have the liquid container. Also, this apparatus may have or may not have the operation part. Also, this apparatus may have or may not have the liquid supply part.

Also, for example, one mode of the invention can be implemented as an apparatus that includes at least one element out of a plurality of elements, namely the liquid container part, the liquid supply part, and the container-side engagement part. In other words, this apparatus may have or may not have the liquid container. Also, this apparatus may have or may not have the liquid supply part. Also, this apparatus may have or may not have the container-side engagement part.

According to such modes, it is possible to solve at least one of the various problems such as achieving apparatus size reduction, cost reduction, resource saving, simplification of manufacturing, and improvements in usability. Some or all of the technical features of the above-described modes of the liquid container can be applied to this apparatus.

Note that the invention can be implemented in various modes, and can be implemented in various aspects such as a liquid container manufacturing method, a liquid consumption system including the liquid container and the liquid consumption apparatus, and so on.

DESCRIPTION OF EXEMPLARY EMBODIMENTS

First Embodiment

Figure 1:
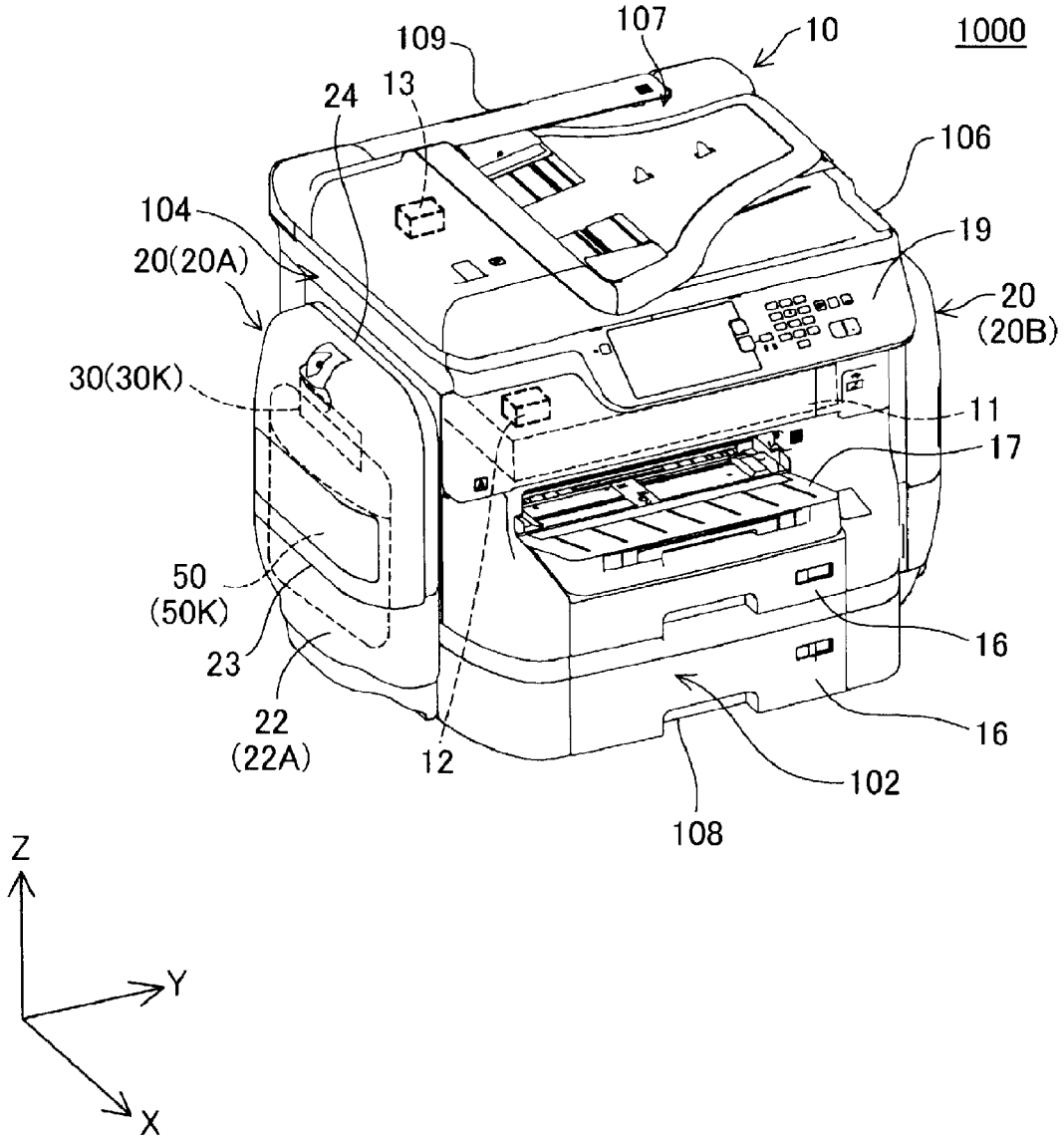
FIG. 1 is a first perspective view of a liquid consumption system.
Figure 2:
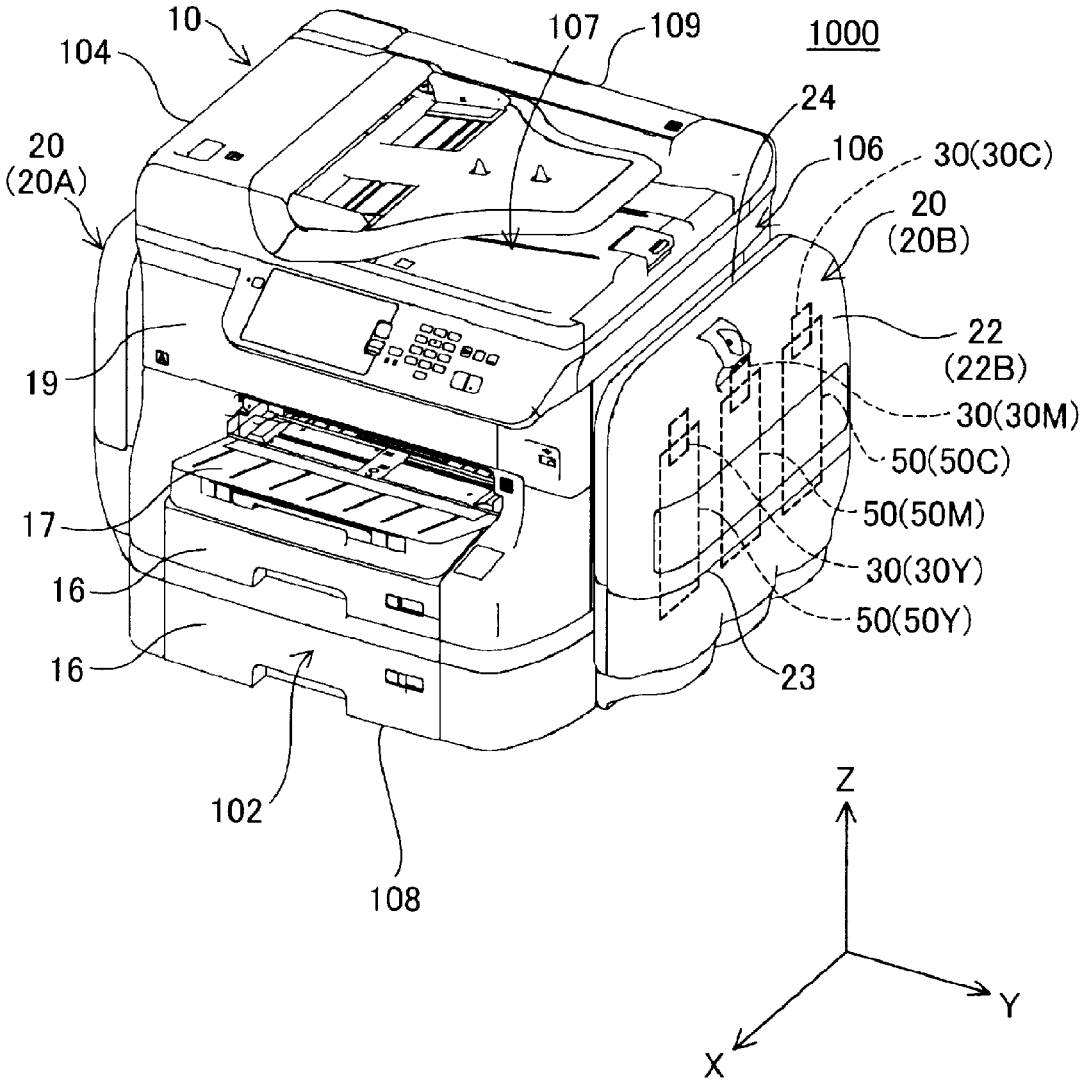
FIG. 2 is a second perspective view of the liquid consumption system.

A-1. Configuration of Liquid Consumption System:

FIG. 1 is a first perspective view of a liquid consumption system 1000. FIG. 2 is a second perspective view of the liquid consumption system 1000. XYZ axes that are perpendicular to each other are depicted in FIG. 1 and FIG. 2.

As shown in FIG. 1, the liquid consumption system 1000 includes a printer 10 serving as a liquid consumption apparatus and four liquid containers 50. When the liquid consumption system 1000 is used, the printer 10 is placed on the horizontal plane defined by the X axis direction and the Y axis direction. In other words, the Z axis direction coincides with the vertical direction (the top-to-bottom direction). The −Z axis direction coincides with the vertically downward direction, and the +Z axis direction coincides with the vertically upward direction. Ink, which is a liquid, is supplied from the liquid containers 50 to the printer 10.

The printer 10 is an inkjet printer. The printer 10 includes a housing 19, which is a printer body, and two liquid container casings 20. The housing 19 of the printer 10 substantially has the shape of a rectangular cuboid. The housing 19 of the printer 10 has a front face (first face, first wall) 102, a left side face (first side face, first side wall) 104, a right side face (second side face, second side wall) 106, a back face (a second face, a second wall) 109, a top face (a third face, a third wall) 107, and a bottom face (a fourth face, a fourth wall) 108.

The front face 102 and the back face 109 oppose each other. The left side face 104 and the right side face 106 oppose each other. The front face 102, the back face 109, the left side face 104, and the right side face 106 are substantially perpendicular to the plane on which the printer 10 is placed. The top face 107 and the bottom face 108 oppose each other. The top face 107 and the bottom face 108 are substantially parallel with the plane on which the printer is placed. Each of the left side face 104 and the right side face 106 intersects with the front face 102 and the back face 109. Here, the terms "substantially perpendicular" and "substantially parallel" includes the meanings of almost "perpendicular" and almost "parallel" in addition to the meaning of perfectly "perpendicular" and perfectly "parallel". In other words, the faces 102, 104, 106, 107, 108, and 109 are not perfectly flat and includes protrusions and depressions, etc., and accordingly they may be almost "perpendicular" or almost "parallel".

The X axis direction is the direction in which the front face 102 and the back face 109 oppose each other. The Y axis direction is the direction in which the left side face 104 and the right side face 106 oppose each other. The Z axis direction is the direction in which the top face 107 and the bottom face 108 oppose each other. The X axis direction is the "depth direction" of the printer 10, the Y axis direction is the "width direction (lateral direction)" of the printer 10, and the Z axis direction is the "height direction" of the printer 10.

The printer 10 includes a control unit 13, a recording mechanism 11, paper feed cassettes 16, and a discharge tray 17. The plurality of paper feed cassettes are disposed at different heights in the vertical direction (bottom-to-top direction). Each paper feed cassette 16 houses recording media (e.g., sheets of paper) on which images of characters, etc., are printed (recorded) by the printer 10. In this embodiment, two paper feed cassettes 16 are stacked in the vertical direction in the housing 19. The number of paper feed cassettes 16 in the housing 19 may be increased. When an additional paper feed cassette 16 is provided in the housing 19, the additional paper feed cassette 16 is to be disposed below the existing paper feed cassettes 16 in the vertical direction.

The control unit 13 and the recording mechanism 11 are disposed inside the housing 19. The control unit 13 controls various operations of the liquid consumption system 1000. The recording mechanism 11 has a head 12, which discharges (ejects) ink. The head 12 is in communication with a liquid introduction part provided in the liquid container casings 20, which is described below. The recording mechanism 11 performs printing (recording) of images and so on by ejecting ink onto a sheet of paper, which serves as a recording medium, according to control signals from the control unit 13. Specifically, printing onto a sheet of paper is performed by the recording mechanism 11 conveying the sheet of paper in the +X axis direction (vertical scanning direction), and the head 12 ejecting ink onto the sheet of paper while moving in the Y axis direction (horizontal scanning direction). This movement of the head 12 is achieved via a timing belt (not shown in the drawings) driven by a stepping motor (not shown in the drawings). Note that although the printer according to this embodiment is a so-called serial head printer in which the head 12 moves in the horizontal scanning direction, it may be a so-called line head printer in which the head 12 has an elongated shape along the Y axis direction and the head 12 is fixed and does not move.

The discharge tray 17 is provided in the front face 102. The discharge tray 17 discharges a recording medium onto which recording by the recording mechanism 11 is performed.

The two liquid container casings 20 are respectively attached to the left side face 104 and the right side face 106. In other words, the two liquid container casings 20 are located outside the housing 19. Hereinafter, the liquid container casing 20 that is attached to the left side face 104 is also referred to as "first liquid container casing 20A", and the liquid container casing 20 attached to the right side face 106 is also referred to as "second liquid container casing 20B". Note that when there is no need to distinguish the first liquid container casing 20A and the second liquid container casing 20B from each other, they may be simply referred to as "liquid container casing 20".

The first liquid container casing 20A (FIG. 1) includes a casing body 22 for housing a liquid container 50, and an attachment/detachment unit 30 for attaching/detaching the liquid container 50. The second liquid container casing 20B (FIG. 2) includes a casing body for housing a liquid container 50 and three attachment/detachment units 30 respectively corresponding to three liquid containers 50. Here, when the two casings 22 need to be distinguished from each other, signs "22A" and "22B" are used. Also, when the liquid containers 50 need to be distinguished from each other, signs "50K", "50C", "50M", and "50Y" are used. Also, when the attachment/detachment units 30 need to be distinguished from each other, signs "30K", "30C", "30M", and "30Y" are used. Note that the number of liquid container casings 20, the number of liquid containers 50, and the number of the attachment/detachment units 30 are not limited to the above. For example, the number of the casing bodies 22 may be one, or may be three or more. Furthermore, the number of the liquid containers 50 housed in one liquid container casing 20 may be one, or may be two or more.

The casing body 22 is configured to be freely openable and closable with a vertically upper end portion 24 being rotatable about a pivot part 23. After the ink stored in the liquid container 50 is consumed, the user opens the casing body 22 and detaches the consumed liquid container 50 from the attachment/detachment unit 30. Then, the user attaches a new liquid container 50 to the attachment/detachment unit 30, and closes the casing body 22.

Each of the four liquid containers 50 contains (i.e., is filled with) a different kind of ink. In this embodiment, inks for the color black (K), yellow (Y), magenta (M), and cyan (C) are respectively stored in the different liquid containers 50. The liquid container 50K has a liquid container part storing the black ink. The liquid container 50C has a liquid container part storing the cyan ink. The liquid container 50M has a liquid container part storing the magenta ink. The liquid container 50Y has a liquid container part storing the yellow ink.

The attachment/detachment units 30 (FIG. 1, FIG. 2) are for being able to attach/detach the liquid containers 50. In other words, the liquid container 50 is detachably housed inside the casing body 22. An attachment/detachment unit 30K is located inside the casing body 22A, and the attachment/detachment units 30C, 30M, and 30Y are located inside the casing body 22B. When the liquid container 50 is attached to the attachment/detachment unit 30, a supply mechanism (not shown in the drawings) of the printer 10, which has the function of a pump, sucks up the ink stored in the liquid container 50, thereby supplying the ink to the head 12 of the printer 10.

Figure 3A:
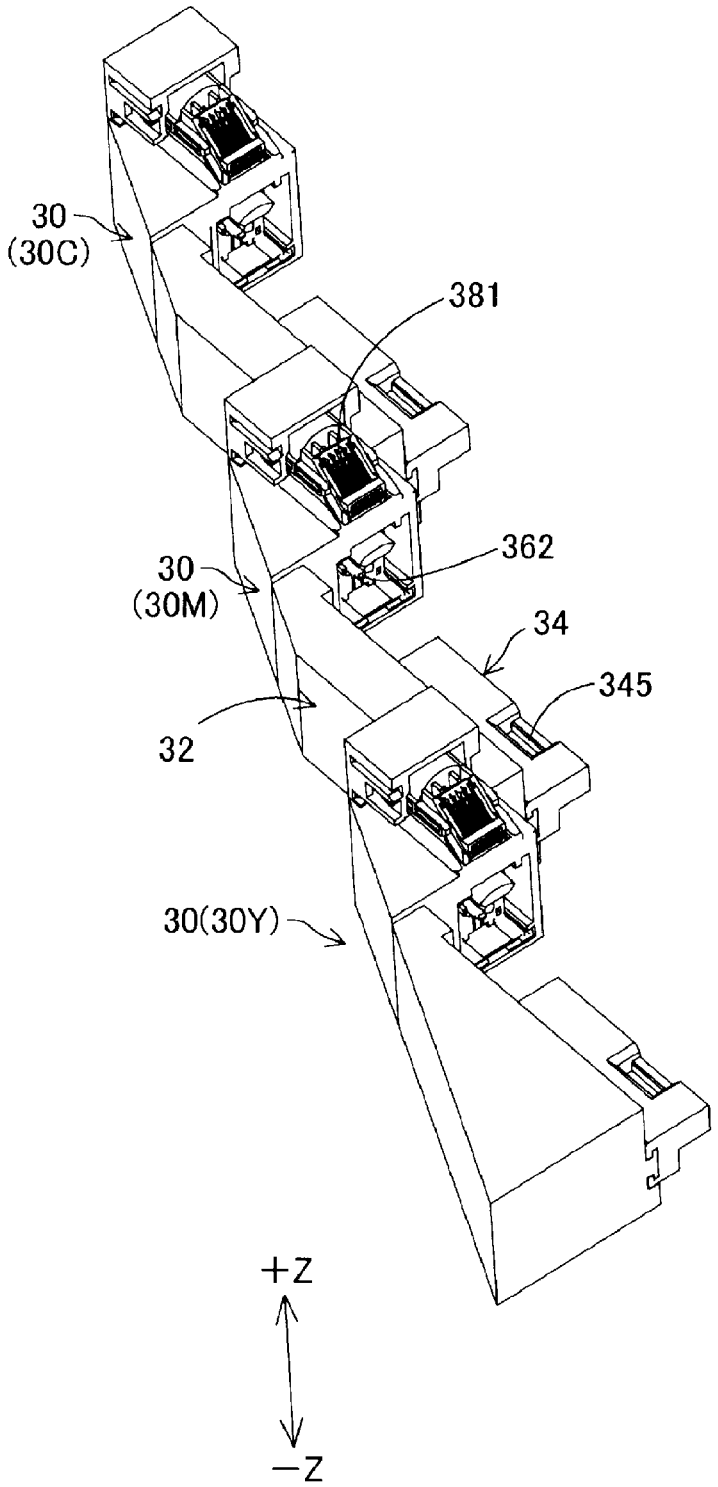
FIG. 3A is a perspective view of an attachment/detachment unit.
Figure 3B:
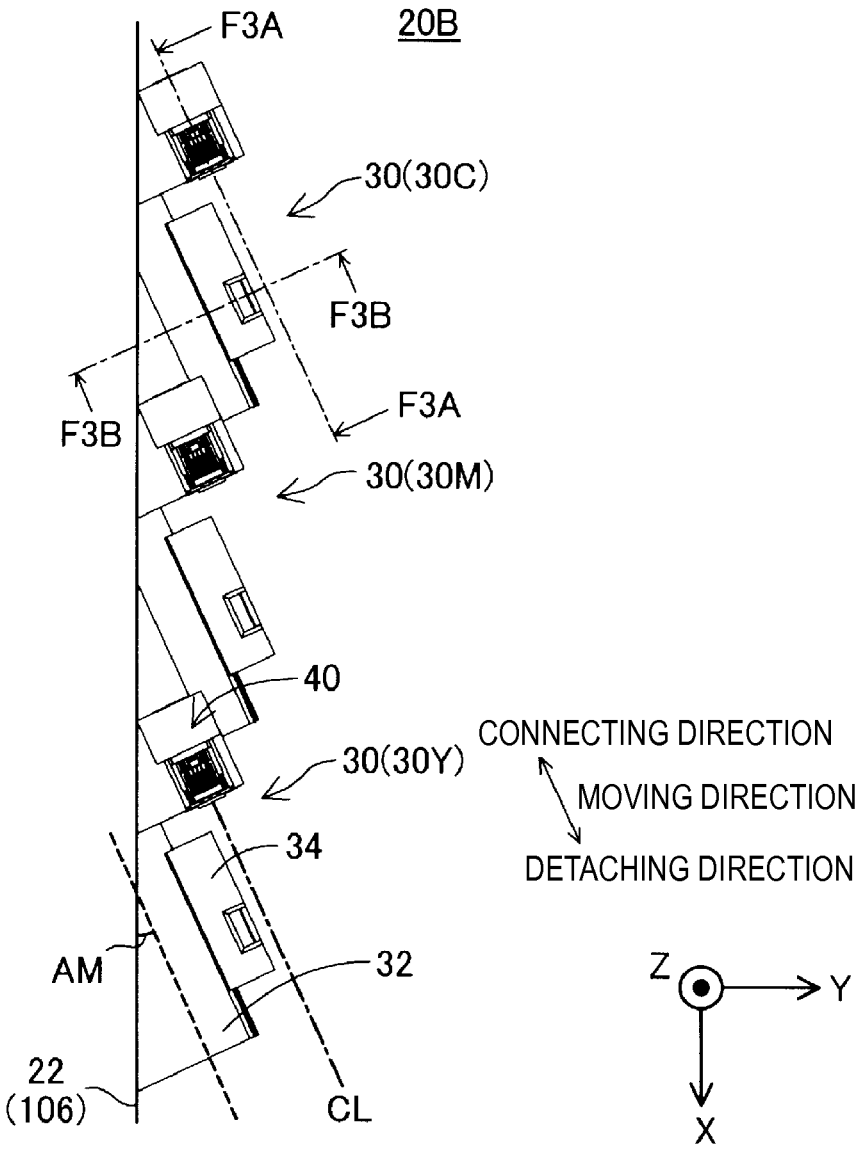
FIG. 3B is a first diagram showing the inside of a second liquid container casing.
Figure 4:
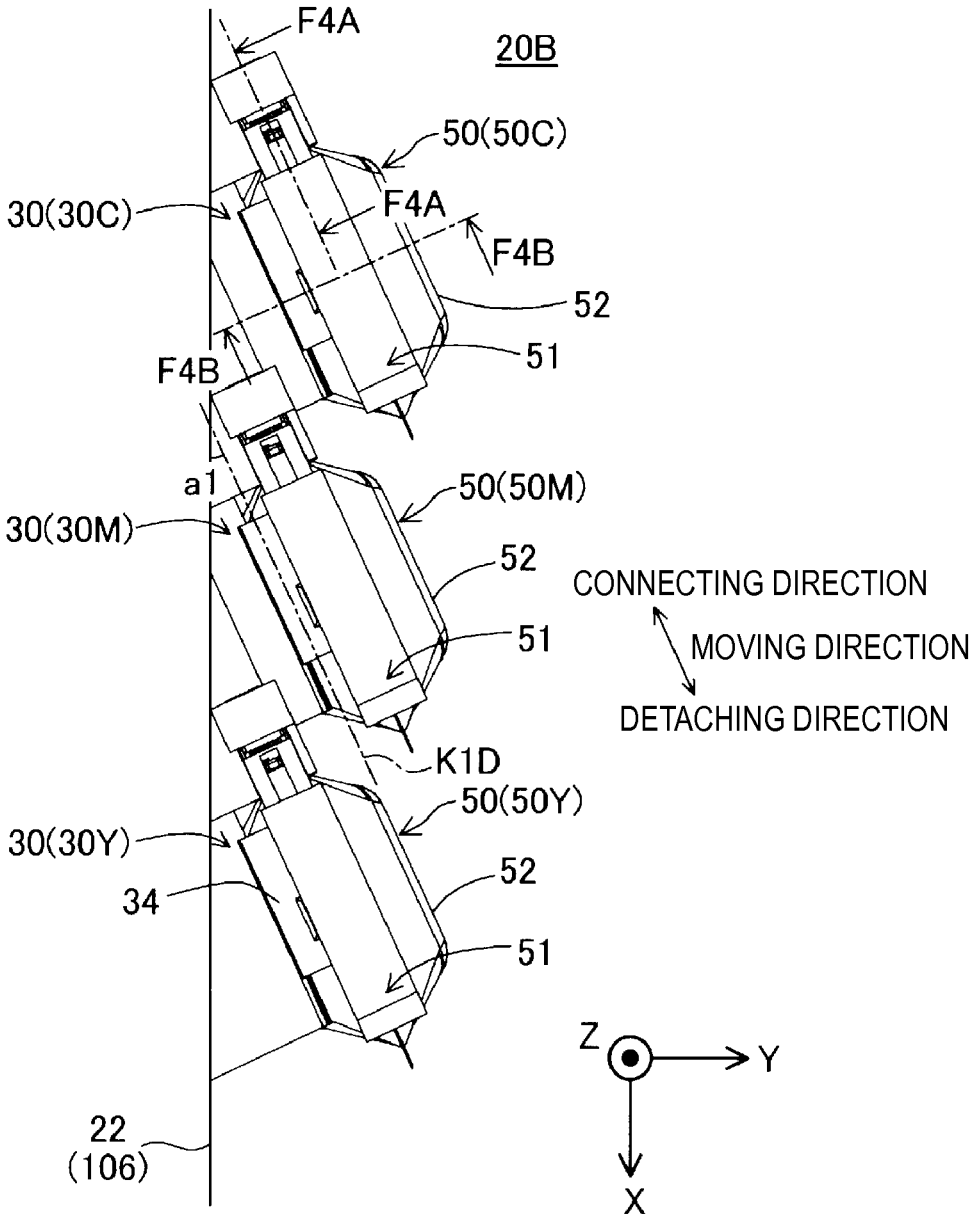
FIG. 4 is a second diagram showing the inside of the second liquid container casing.
Figure 5:
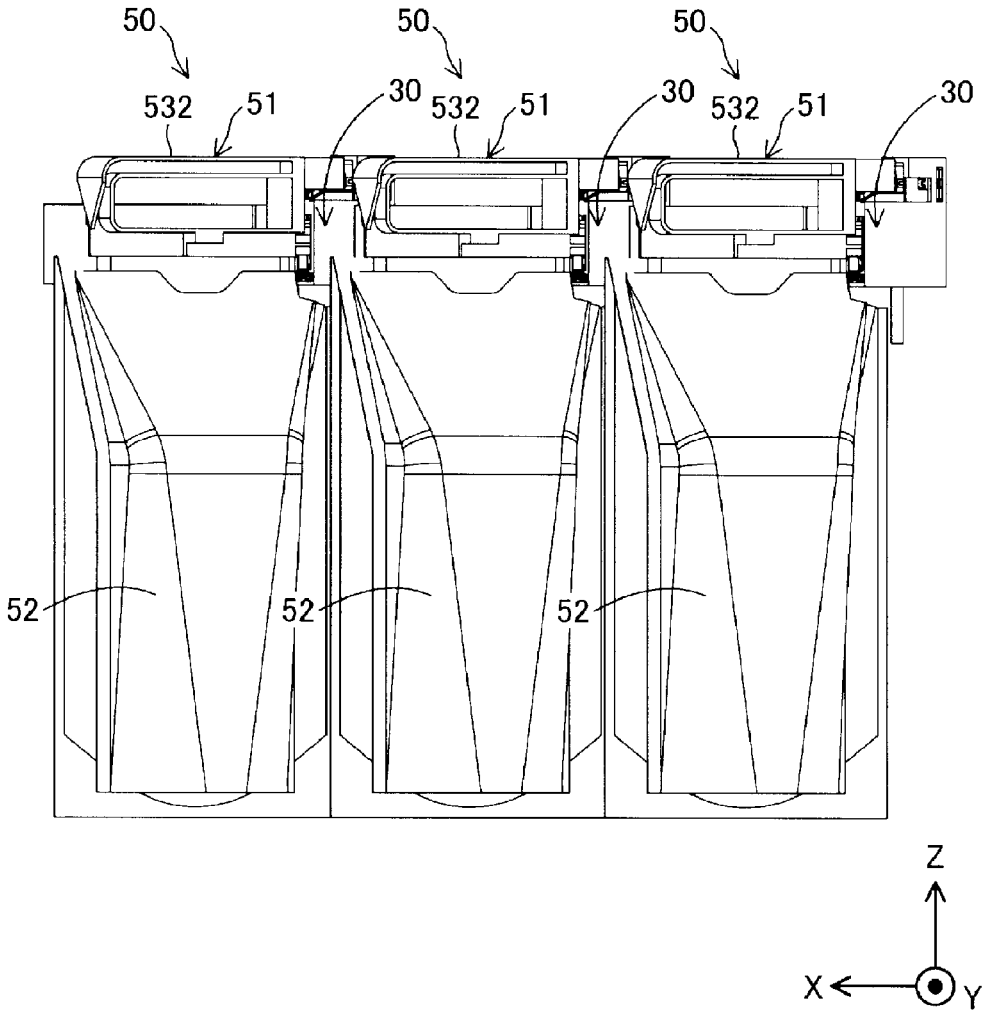
FIG. 5 is a third diagram showing the inside of the second liquid container casing.

A-2. Configuration of Attachment/Detachment Unit 30:

FIG. 3A is a perspective view of the attachment/detachment unit 30. FIG. 3B is a first diagram showing the inside of the second liquid container casing 20B. FIG. 4 is a second diagram showing the inside of the second liquid container casing 20B. FIG. 5 is a third diagram showing the inside of the second liquid container casing 20B. FIG. 3B shows the state in which the liquid containers 50 are not housed within the second liquid container casing 20B. FIG. 4 and FIG. 5 show the attached state in which the liquid containers 50 are attached to the printer 10.

The attachment/detachment unit 30K disposed within the first liquid container casing 20A (FIG. 1) and the attachment/detachment units 30C, 30M, and 30Y disposed within the second liquid container casing 20B (FIG. 2) are different in an angle a1 (FIG. 4) with respect to the side faces 104 and 106 to which they are attached. With respect to other configurations, the attachment/detachment units 30 have the same configuration. The following describes the configurations of the attachment/detachment units 30C, 30M, and 30Y, as well as unique features in the configuration of the attachment/detachment unit 30K.

The three attachment/detachment units 30C, 30M, and 30Y (FIG. 3A, FIG. 3B, FIG. 5) are arranged side-by-side along the X axis direction. The attachment/detachment unit 30 (FIG. 3B) includes a fixing member 32, a movable member 34, and a connection member 40. The fixing member 32 and the connection member 40 are supported by the casing body 22 by being attached to the casing body 22 with an attachment member such as a screw.

As shown in FIG. 3A, the movable member 34 is movably supported by the fixing member 32. The movable member 34 also serves as a guiding part that moves and thereby guides a liquid supply part 57 of the liquid container 50 to the position of connection with the liquid introduction part 362. The moving direction of the movable member 34 is inclined with respect to the right side face 106. Specifically, as shown in FIG. 3B, an angle AM formed between the right side face 106 and the moving direction in the counterclockwise direction from the right side face 106 when the printer 10 is seen from above in the vertical direction is equal to or greater than 0 degrees and less than 90 degrees. The angle AM in this embodiment is 25 degrees. The direction in which the connection member 40 is orientated (the direction that is parallel with a central axis CL of the liquid introduction part 362 described below) is parallel with the moving direction. Note that the moving direction of the attachment/detachment unit 30K is parallel with the X axis direction, which is parallel with the left side face 104. Here, regarding the moving direction, the direction toward the connection member 40 is the attaching direction (connecting direction) of the liquid container 50, and its opposite direction is the detaching direction. The movable member 34 supports the liquid container 50 such that a container part supporting assembly 51 of the liquid container 50 is disposed above the liquid container part 52 in the vertical direction (FIG. 4, FIG. 5). The container part supporting assembly 51 includes a first side part 532 that the user can grip. The longitudinal direction of the first side part 532 is parallel with the moving direction. Here, as shown in FIG. 4, the angle a1 formed between the right side face 106 and the longitudinal direction KID of the first side part 532 in the counterclockwise direction from the right side face 106 when the printer 10 is seen from above in the vertical direction is equal to or greater than 0 degrees and less than 90 degrees. The angle a1 in this embodiment is 25 degrees. The connecting direction of the liquid container 50 is the direction having forward and backward direction components (X axis direction components) in which the front face 102 and back face 109 oppose each other.

Figure 6:
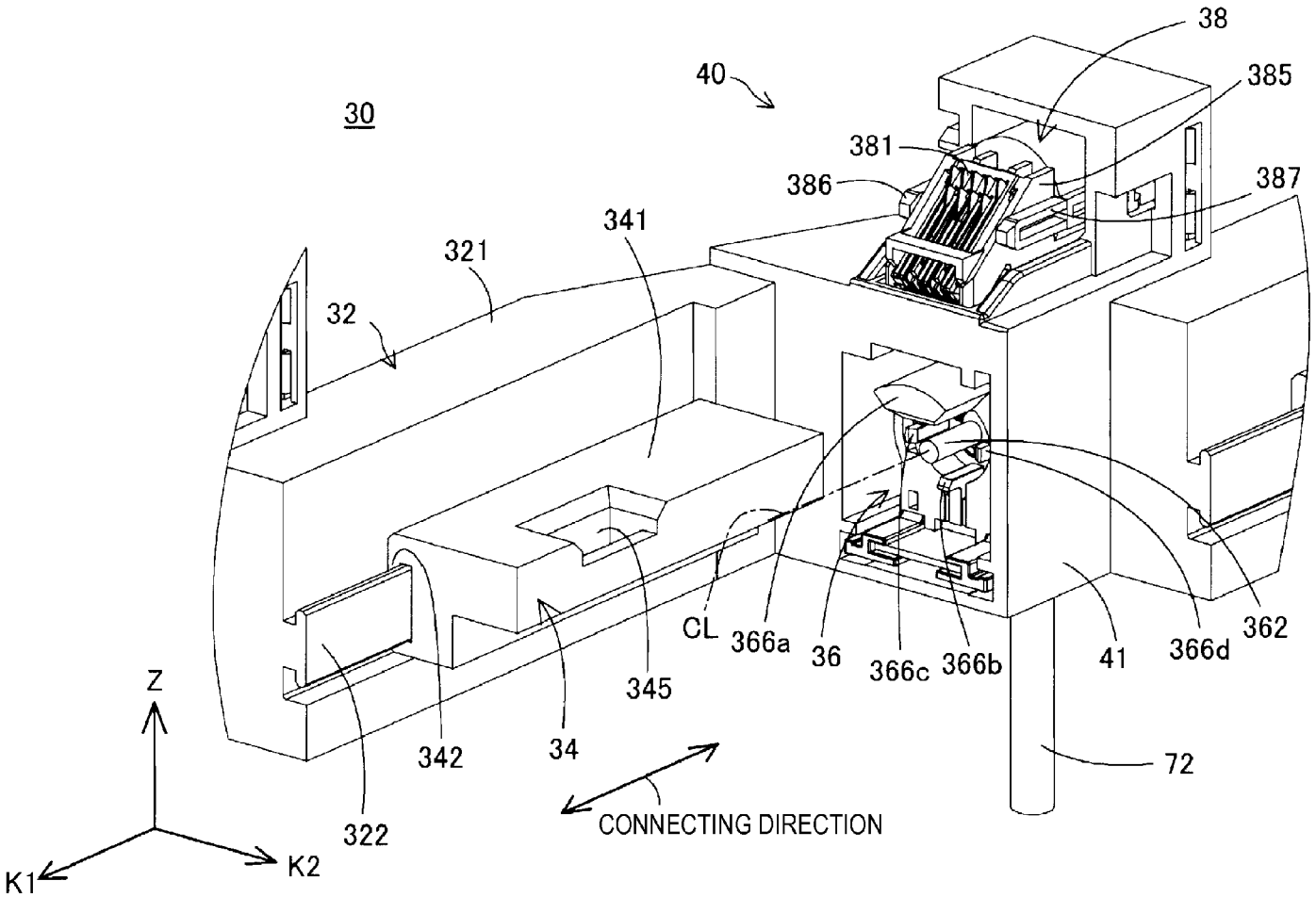
FIG. 6 is a perspective view of the attachment/detachment unit.
Figure 7:
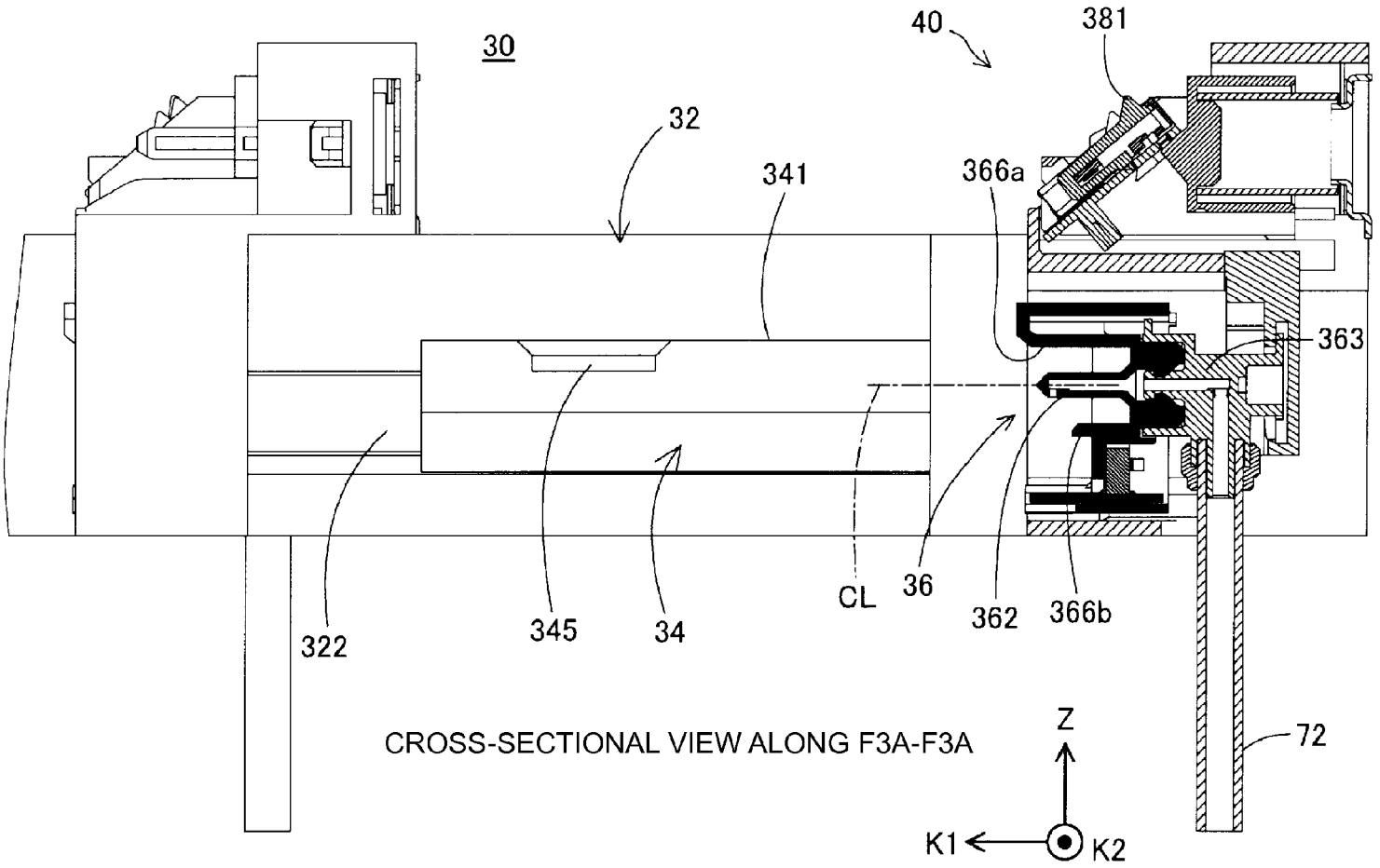
FIG. 7 is a cross-sectional view along F3A-F3A in FIG. 3B.
Figure 8:
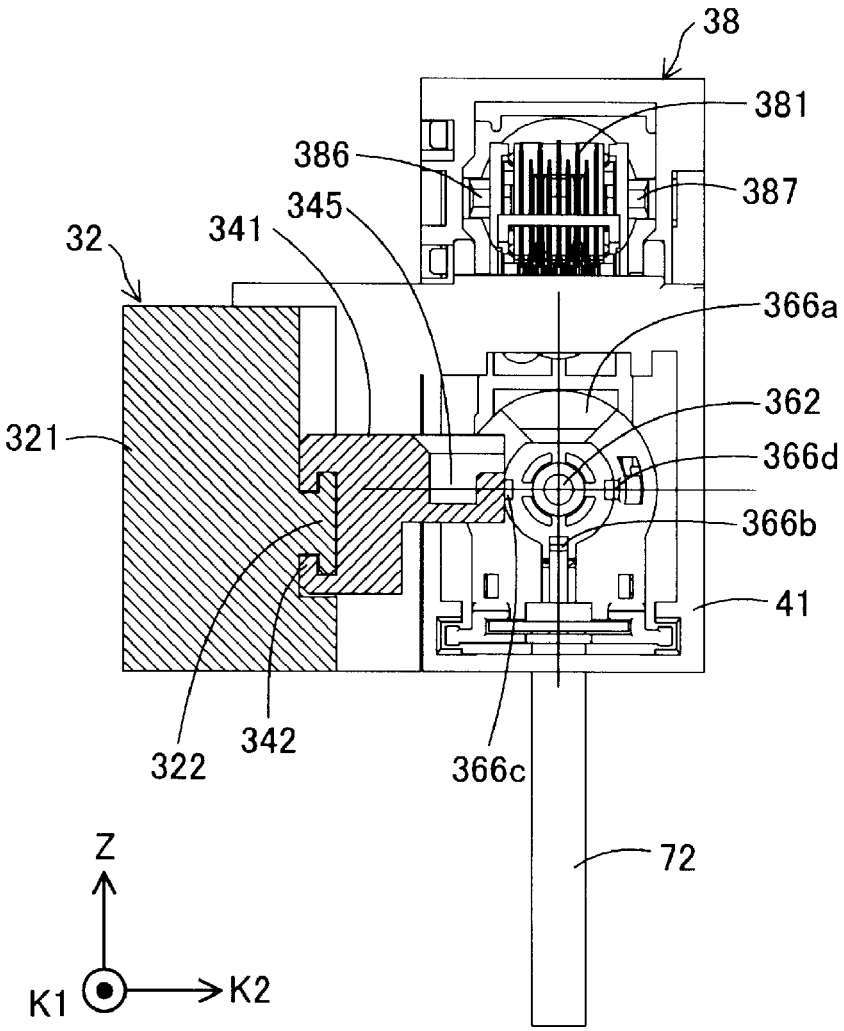
FIG. 8 is a cross-sectional view along F3B-F3B in FIG. 3B.
Figure 9:
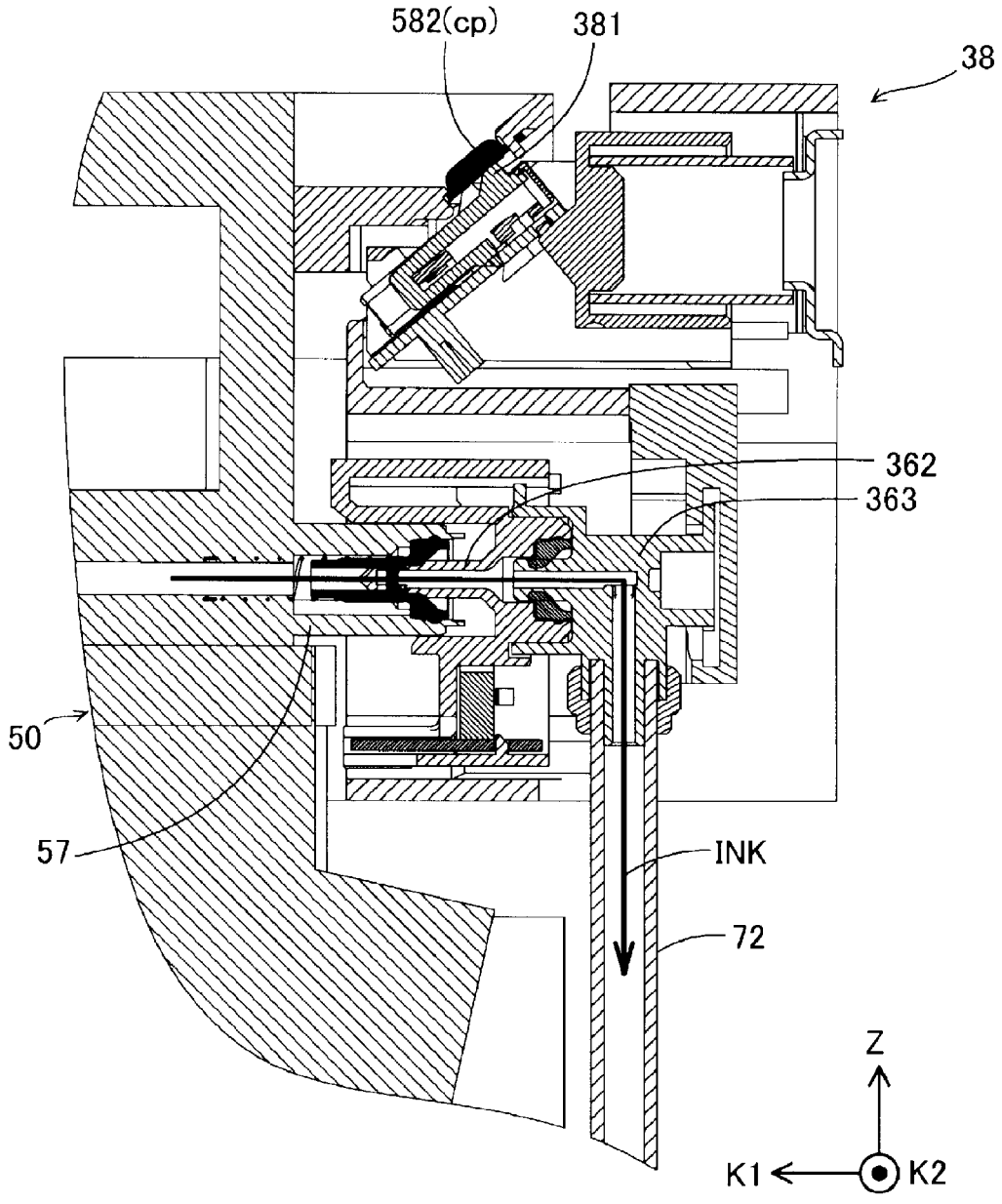
FIG. 9 is a cross-sectional view along F4A-F4A in FIG. 4.
Figure 10:
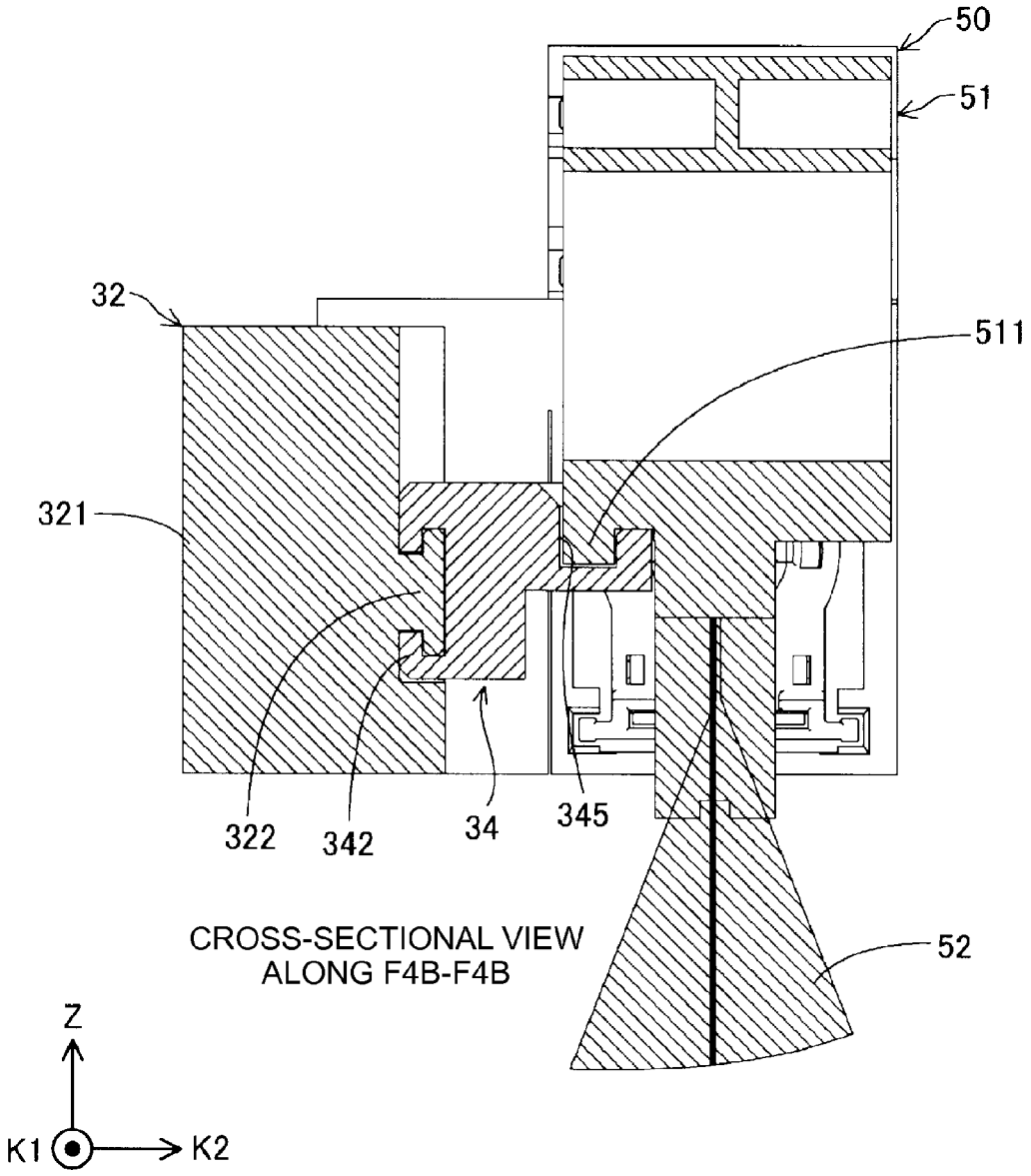
FIG. 10 is a cross-sectional view along F4B-F4B in FIG. 4.

FIG. 6 is a perspective view of the attachment/detachment unit 30. FIG. 7 is a cross-sectional view along F3A-F3A in FIG. 3B. FIG. 8 is a cross-sectional view along F3B-F3B in FIG. 3B. FIG. 9 is a cross-sectional view along F4A-F4A in FIG. 4. FIG. 10 is a cross-sectional view along F4B-F4B in FIG. 4. Here, FIG. 6 to FIG. 10 show a K1 axis, a K2 axis, and the Z axis, which are perpendicular to each other. The drawings following the above also show the K1 axis, the K2 axis, and the Z axis as needed. Here, it is assumed that the direction that is parallel with the central axis CL of the liquid introduction part 362 (FIG. 7) (the direction in which the liquid introduction part 362 extends) is the K1 axis direction, and the direction that is perpendicular to the Z axis direction and the K1 axis direction is the K2 axis direction.

The fixing member 32 (FIG. 6) includes a body part 321 and a fixed-side rail part 322 that protrudes from the body part 321. The fixed-side rail part 322 extends along the K1 axis direction.

The movable member 34 (FIG. 6) includes an upper surface part 341 located above in the vertical direction, an apparatus-side engagement part 345 formed on the upper surface part 341 and having the shape of a depression, and a movable-side rail part 342 that engages with the fixed-side rail part 322. The apparatus-side engagement part 345 is disposed so as to be able to support the liquid container 50. As shown in FIG. 10, a container-side engagement part 511 of the container part supporting assembly 51, which has the shape of a protrusion, is inserted into the apparatus-side engagement part 345. Thus, the movable member 34 supports the liquid container 50 such that the container part supporting assembly 51 of the liquid container 50 is located above the liquid container part 52 in the vertical direction. The movable-side rail part 342 engages with the fixed-side rail part 322 so as to be able to move the movable member 34 along the moving direction (the K1 axis direction). The movable-side rail part 342 extends along the K1 axis direction.

The connection member 40 (FIG. 6) includes a liquid introduction mechanism 36 and a contact mechanism 38. The liquid introduction mechanism 36 and the contact mechanism 38 are arranged side-by-side along the Z axis direction. The contact mechanism 38 is located at a higher level than the liquid introduction mechanism 36.

The liquid introduction mechanism 36 includes a liquid introduction body part 363 (FIG. 7), the liquid introduction part 362 (FIG. 6) and introduction part-side positioning parts 366*a* to 366*d* (FIG. 6). As shown in FIG. 7, the liquid introduction part 362 protrudes from the liquid introduction body part 363 to the +K1 axis direction. The liquid introduction part 362 has the shape of a needle, and the ink can pass through the inside thereof. The liquid introduction part 362 has the central axis CL, and has the shape of a cylinder extending along the central axis CL. As shown in FIG. 9, the liquid supply part 57 of the liquid container 50 is connected to the liquid introduction part 362. Ink supplied from the liquid supply part 57 to the liquid introduction part 362 is distributed to the printer 10 via an internal flow channel of the liquid introduction body part 363 and a hose 72 serving as a distribution member connected to the internal flow channel. As shown in FIG. 8, the introduction part-side positioning parts 366*a* to 366*d* are disposed at predetermined intervals around the liquid introduction part 362 having the central axis CL. The introduction part-side positioning parts 366*a* to 366*d* protrude from the liquid introduction body part 363 to the +K1 axis direction. The introduction part-side positioning parts 366*a* to 366*d* are members used for positioning the liquid supply part 57 and the liquid introduction part 362 when attaching the liquid container 50.

The contact mechanism 38 (FIG. 6) includes a plurality of apparatus-side terminals 381 serving as apparatus-side electrical connection parts, and a holding member 385 holding the plurality of apparatus-side terminals 381, and contact mechanism-side positioning parts 386 and 387. The plurality of apparatus-side terminals 381 are electrically connected to a circuit substrate 582 by being brought into contact with contact parts cp (FIG. 7) of the circuit substrate 582 of the liquid container 50. The apparatus-side terminals 381 are electrically connected to the control unit 13 of the printer 10 (FIG. 1) via wiring or the like. With this configuration, in the attached state, the control unit 13 and the circuit substrate 582 exchange various kinds of information about the liquid container 50 (e.g. the color of the ink and the amount of remaining ink). In this embodiment, nine apparatus-side terminals 381 are provided in correspondence with nine contact parts cp. The contact mechanism-side positioning parts 386 and 387 are disposed so as to sandwich the apparatus-side terminals 381 between them in the K2 axis direction. The contact mechanism-side positioning parts 386 and 387 are disposed on the holding member 385. The contact mechanism-side positioning parts 386 and 387 are members extending along the K1 axis direction. The contact mechanism-side positioning parts 386 and 387 are members for positioning the apparatus-side terminals 381 and the contact parts cp when attaching the liquid container 50.

Figure 11:
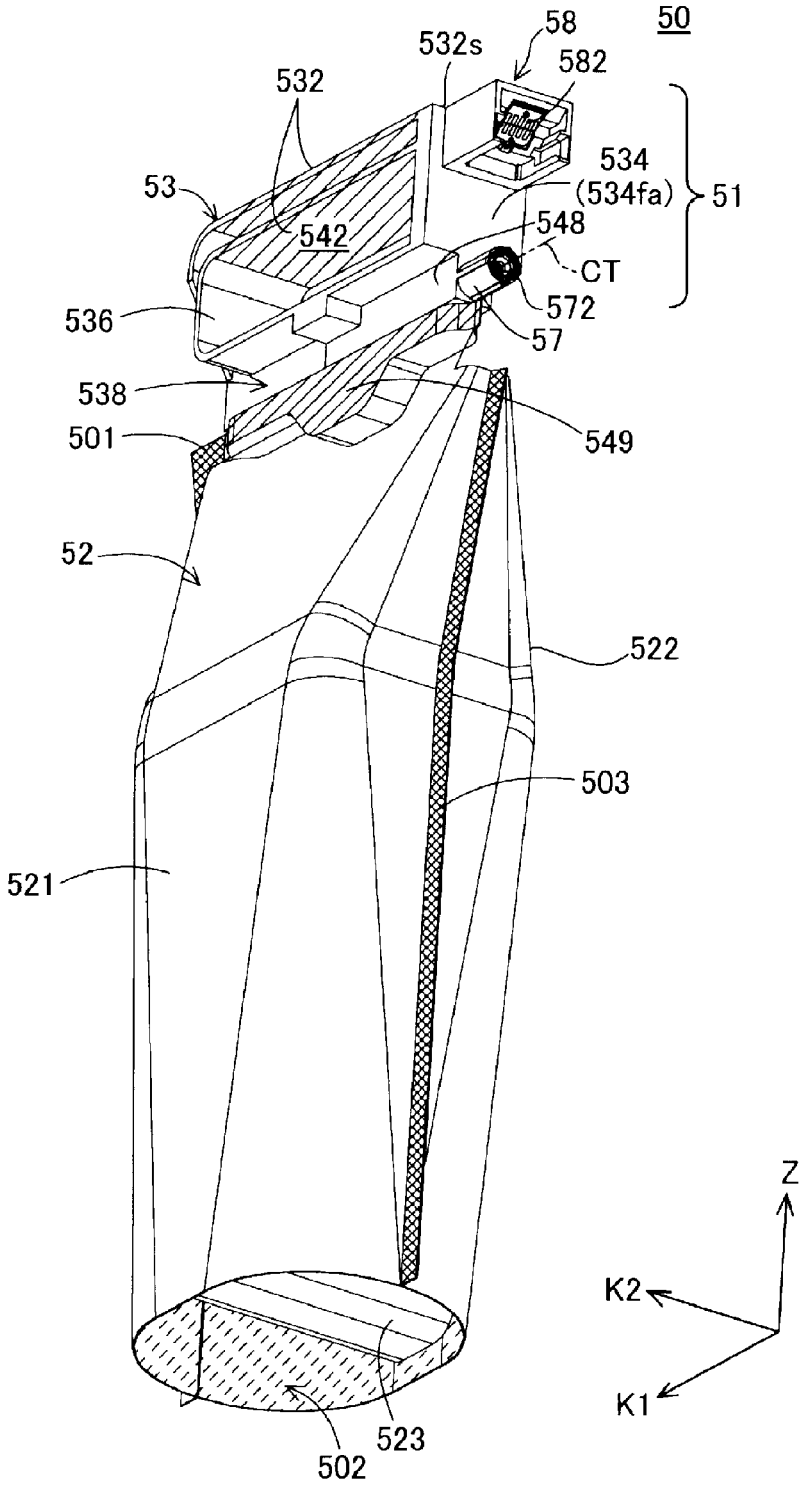
FIG. 11 is a first perspective view of a liquid container.
Figure 12:
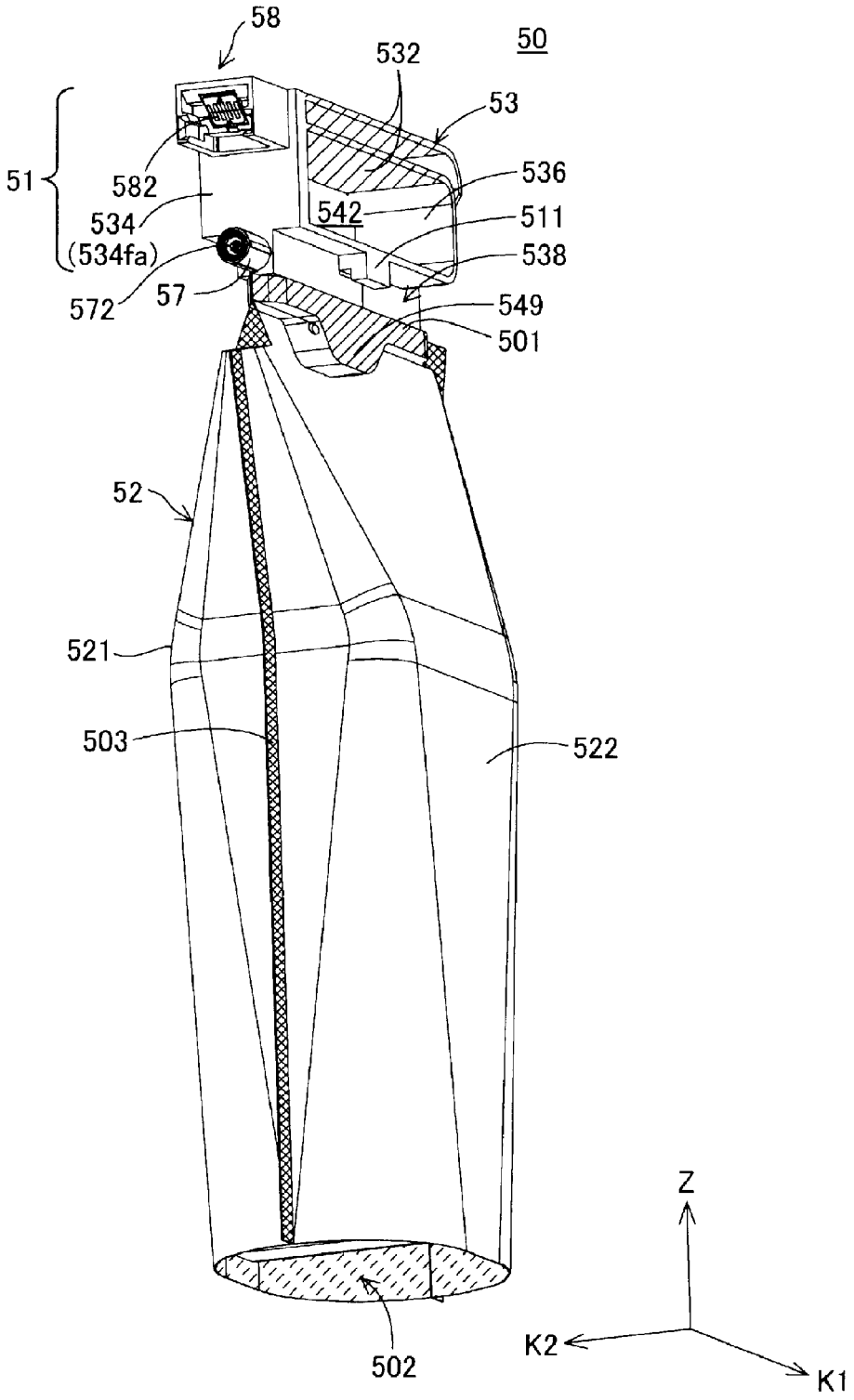
FIG. 12 is a second perspective view of the liquid container.
Figure 13:
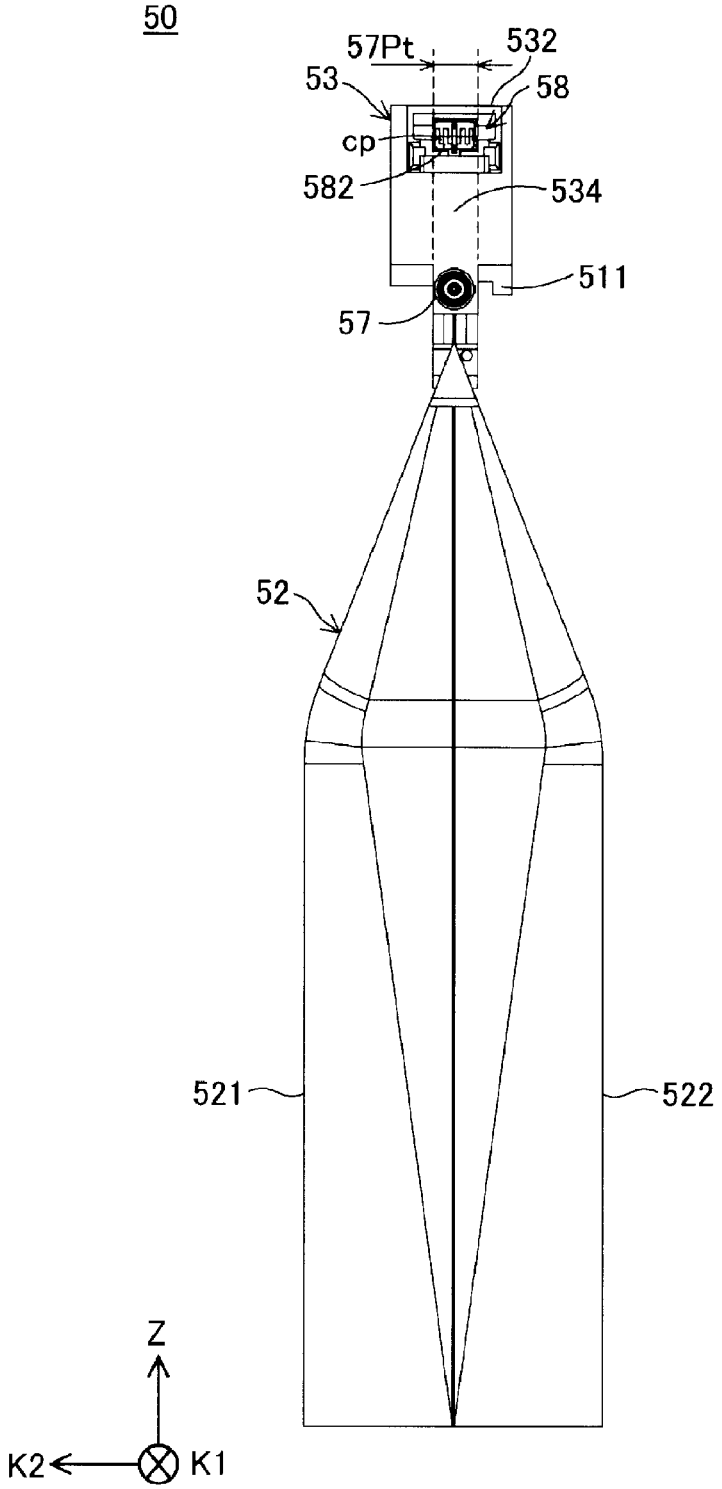
FIG. 13 is a front view of the liquid container.
Figure 14:
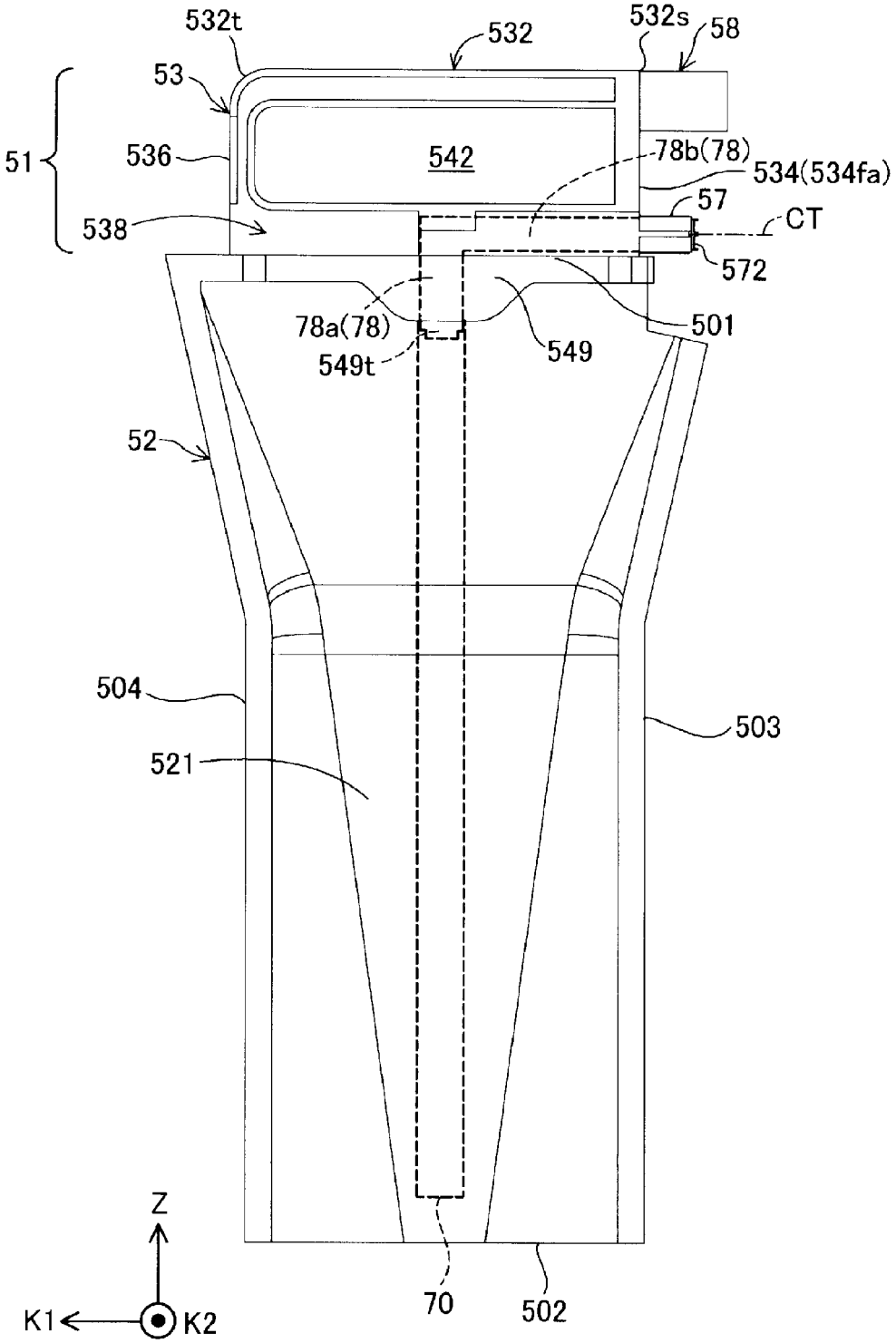
FIG. 14 is a left side view of the liquid container.
Figure 15:
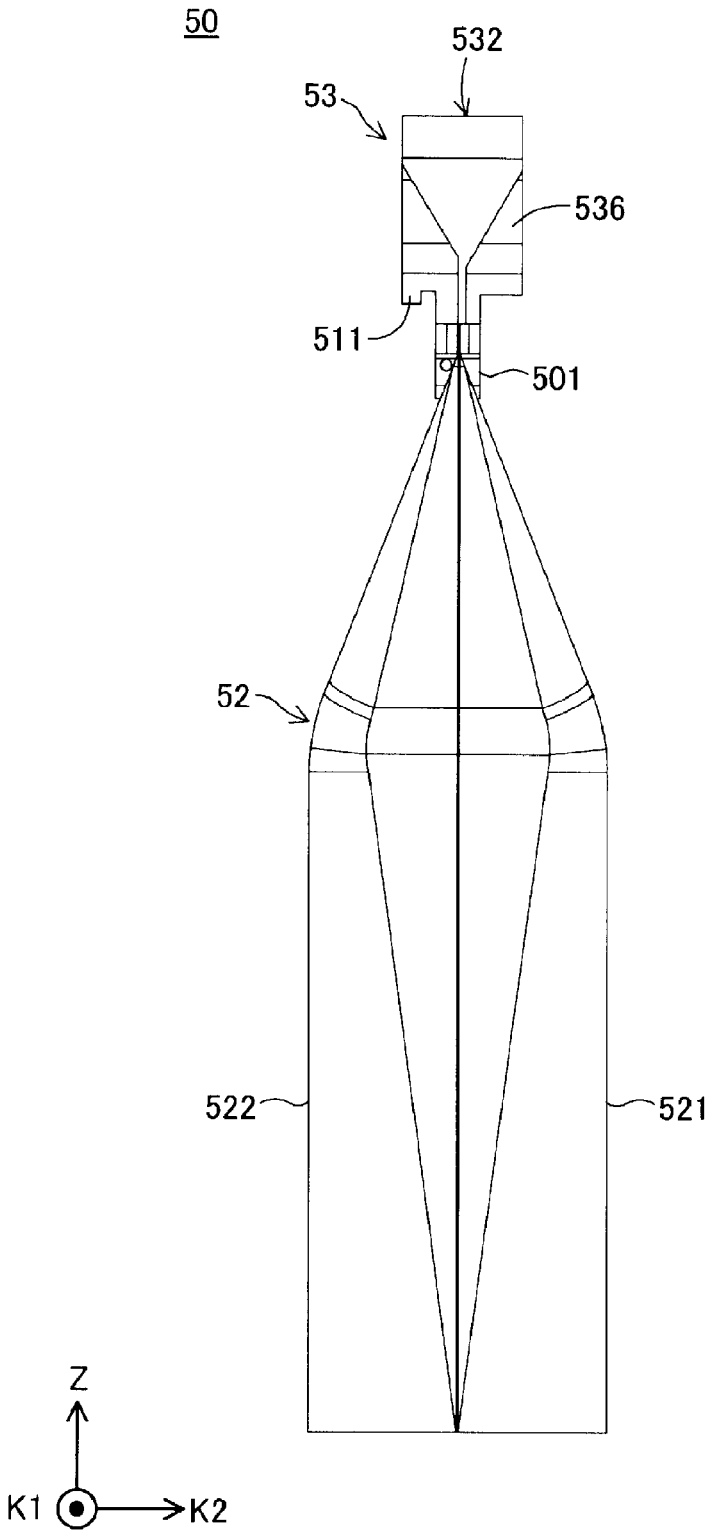
FIG. 15 is a back view of the liquid container.
Figure 16:
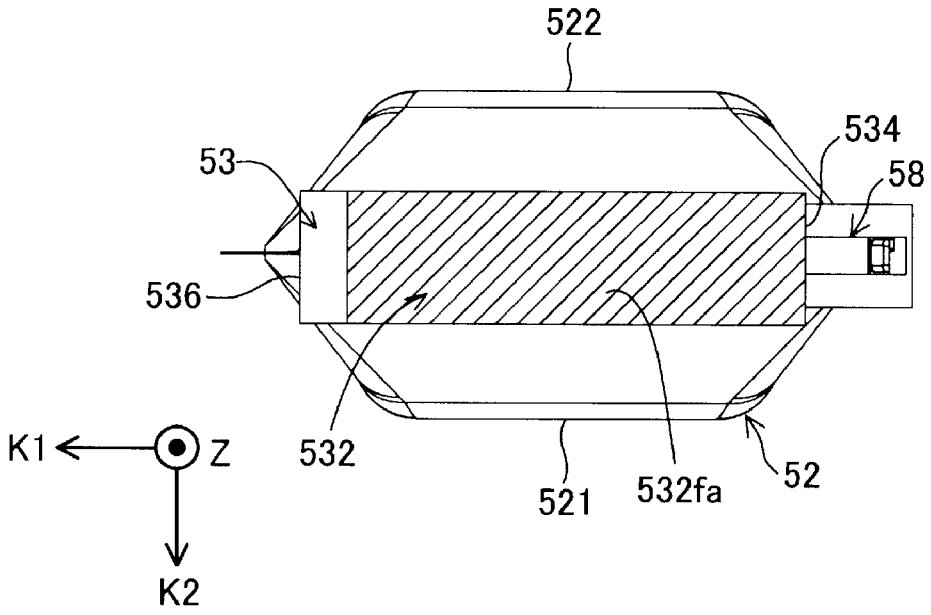
FIG. 16 is a top view of the liquid container.
Figure 17:
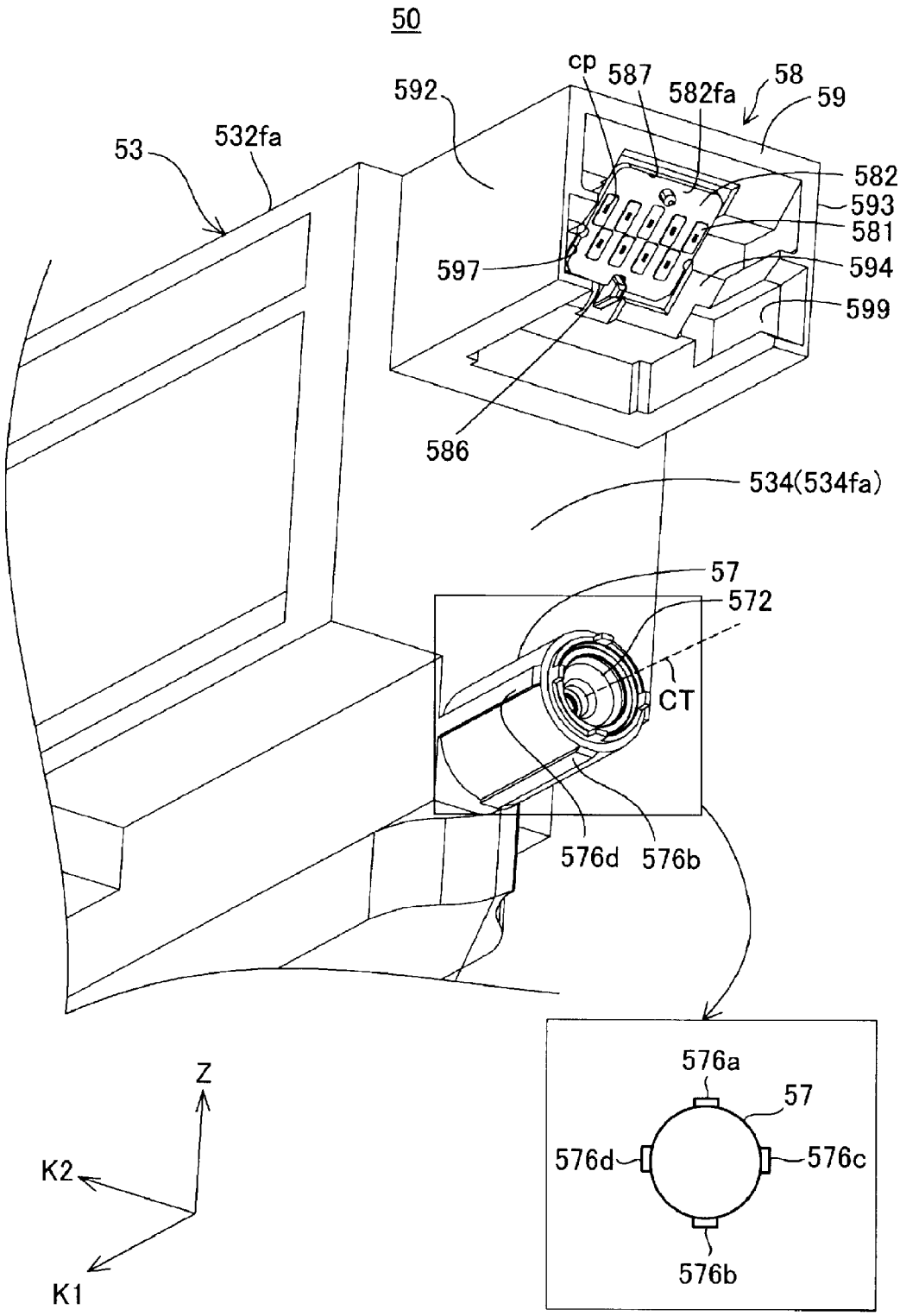
FIG. 17 is a partially enlarged view of the liquid container.
Figure 18:
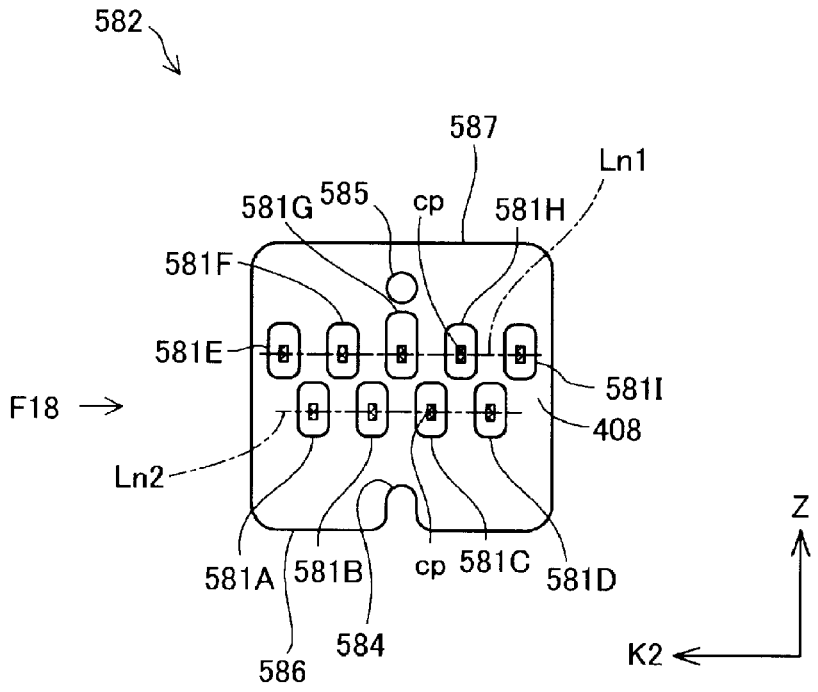
FIG. 18 is a diagram illustrating a circuit substrate.
Figure 19:
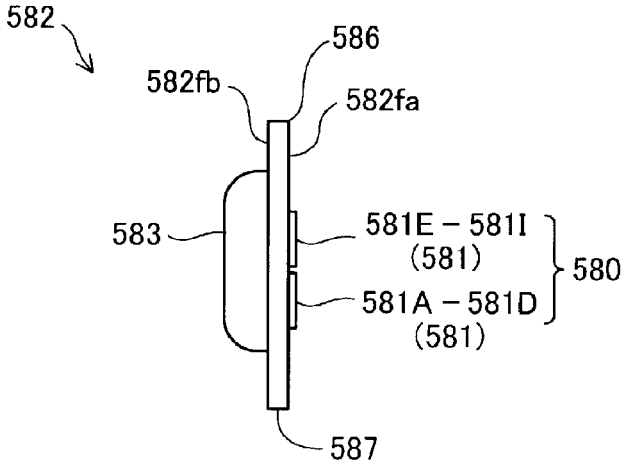
FIG. 19 is a view in the direction of an arrow F18 in FIG. 18.

A-3. Configuration of Liquid Container 50:

FIG. 11 is a first perspective view of the liquid container 50. FIG. 12 is a second perspective view of the liquid container 50. FIG. 13 is a front view of the liquid container 50. FIG. 14 is a left side view of the liquid container 50. FIG. 15 is a back view of the liquid container 50. FIG. 16 is a top view of the liquid container 50. FIG. 17 is a partially enlarged view of the liquid container 50. FIG. 18 is a diagram illustrating the circuit substrate 582. FIG. 19 is a view in the direction of an arrow F18 in FIG. 18. FIG. 11 to FIG. 17 show the K1 axis, the K2 axis, and the Z axis in the attached state.

The capacity of the liquid container 50K (FIG. 1) and the liquid containers 50C, 50M, and 50Y (FIG. 2) is different from the capacity of the liquid container part 52. The liquid container part 52 of the liquid container 50K is greater in capacity than the liquid container parts of the liquid containers 50C, 50M, and 50Y, and is capable of storing a larger amount of ink. In this embodiment, the liquid container part 52 of the liquid container 50K is greater in length in the Z axis direction and in the K2 axis direction than the liquid container parts 52 of the liquid containers 50C, 50M, and 50Y. With respect to other configurations, the liquid container 50K and the liquid containers 50C, 50M, and 50Y have the same configuration. The respective liquid container parts 52 of the liquid containers 50C, 50M, and 50Y have the same external shape, and are capable of containing the same volume of ink. Note that the capacities of the respective liquid container parts 52 of the liquid containers 50C, 50M, and 50Y are not necessarily the same, and may be different. For example, the liquid container part 52 of the liquid container 50 containing the ink that is used frequently may have a greater capacity than the liquid container part 52 of the liquid container 50 containing the ink that is used infrequently.

The Z axis direction, the K1 axis direction, and the K2 axis direction can be defined as follows. When the liquid container 50 is in the attached state, the Z axis direction is the direction of gravity (vertical direction). The +Z axis direction is the upward gravity direction (vertically upward direction), and the −Z axis direction is the downward direction of gravity (vertically downward direction). The K1 axis direction is the horizontal direction. The −K1 axis direction is the attaching direction (the connecting direction) in which the liquid container 50 is attached to the printer 10 after the liquid container 50 is set to the movable member 34. The +K1 axis direction is the detaching direction in which the liquid container 50 is detached from the printer 10. The K2 axis direction is the direction that is perpendicular to the direction of gravity (Z axis direction) and the K1 axis direction. The Z axis direction is the "height direction" of the liquid container 50. The K1 axis direction is the "length direction" of the liquid container 50. The K2 axis direction is the "thickness direction" (width direction) of the liquid container 50.

The liquid container 50 (FIG. 11) includes the container part supporting assembly 51 and the liquid container part 52. The container part supporting assembly 51 includes an operation part 53, the liquid supply part 57, and a substrate unit 58. The operation part 53 is a member having the shape of a frame having an opening facing toward the K2 axis direction. Note that the shape of the operation part 53 is not limited to such a shape, and may be any shape that the user can hold with a hand.

The liquid container part 52 is capable of storing ink. The liquid container part 52 is attached to the container part supporting assembly 51, with the external surface being exposed. In other words, the liquid container part 52 is not housed in a casing or the like, and is configured to be externally visible. The liquid container part 52 is flexible, and the capacity thereof decreases as the ink stored therein decreases. Note that it is only necessary that the capacity of the liquid container part 52 decreases as the ink stored therein decreases, and it suffices if at least part of the liquid container part 52 is flexible.

The liquid container part 52 includes a first film 521, a second film 522, and a third film 523. The first film 521 to the third film 523 partition the space for storing the ink therein. When the liquid container 50 is in the attached state, the third film 523 constitutes the bottom part of the liquid container part 52. Also, in the attached state, the first film 521 and the second film 522 constitutes a side face part of the liquid container part 52.

Here, as shown in FIG. 11, of the liquid container part 52, the portion to which the container part supporting assembly 51 is attached is defined as one end portion (upper end portion) 501, and the portion opposing the one end portion 501 is defined as the other end portion (bottom end portion) 502. Also, of the liquid container part 52, the portion on one side (in the −K1 axis direction) is defined as a first side end portion 503, and the portion on the other side (in the +K1 axis direction) is defined as a second side end portion 504. In the attached state, the one end portion 501 extends in the direction that intersects the vertical direction (in the horizontal direction in this embodiment). The longitudinal direction of the one end portion 501 is the K1 axis direction, which is the same as the longitudinal direction of an attaching part 549. Also, the −K1 axis direction (first direction), which is one of the longitudinal directions of the one end portion 501, is the direction toward which a liquid supply opening 572 faces.

The respective peripheral areas of the first film 521 and the second film 522 are partially fused to each other. More specifically, their respective peripheral areas are fused at the one end portion 501, the first side end portion 503, and the second side end portion 504. To facilitate understanding, in FIG. 11 and FIG. 12, the part where the first film 521 and the second film 522 are fused to each other is indicated by cross hatching. To the one end portion 501 of the liquid container part 52, the container part supporting assembly 51 (specifically, the attaching part 549) is fused. To facilitate understanding, in FIG. 11 and FIG. 12, the part where the container part supporting assembly 51, the first film 521, and the second film 522 are fused is indicated by single hatching with solid lines.

As shown in FIG. 11, the third film 523 is fused to portions of the respective peripheral areas of the first film 521 and the second film 522. These fused portions are indicated by single hatching with dot-and-dash lines. As described above, the liquid container part 52 according to this embodiment is of the type with three films 521, 522, and 523 attached to each other by fusing or the like (a so-called pouch type with a bottom).

Although the liquid container part 52 in this embodiment is of the type with the first film 521 to the third film 523 attached to each other by fusing or the like, the third film 523 may be omitted, and the liquid container part 52 may be of the type with the first film 521 and the second film 522 attached to each other by fusing or the like (a so-called pillow type).

The first film 521 to the third film 523 are flexible members. The material (constituent) of the first film 521 to the third film 523 is, for example, polyethylene terephthalate (PET), nylon, or polyethylene. The first film 521 to the third film 523 may be configured to have a layered structure by using a plurality of films made of these materials. In such a layered structure, the outer layer may be formed with PET or nylon, which has excellent impact resistance, and the inner layer may be formed with polyethylene, which has excellent ink resistance. Furthermore, a film having a layer formed by deposition of aluminum may be included as a constituent member of the layered structure. Such a configuration improves the gas-barrier properties, thereby suppressing the change in density of the ink stored in the liquid container part 52, for example. In this way, the material of the liquid container part 52 can be determined as needed.

As shown in FIG. 14, a flow channel forming member 70 is disposed within the liquid container part 52. The flow channel forming member 70 is a tube. The flow channel forming member 70 is elastic. The flow channel forming member 70 is formed from, for example, elastomer, or rubber so as to be elastic. The flow channel forming member 70 forms a flow channel for bringing the inside of the liquid container part 52 and the liquid supply part 57 in communication. The ink in the liquid container part 52 passes through the flow channel forming member 70 and a communication flow channel 78, which is a flow channel formed in the operation part 53, and the ink is thus distributed to the liquid supply part 57. The downstream end portion of the flow channel forming member 70 in the direction of the flow of the ink from the liquid container part 52 to the liquid supply opening 572 is connected to a connection part **549*t* which is formed in the attaching part 549 and has an opening. The communication flow channel 78 includes a first flow channel part 78*a* that extends vertically upward from the downstream end portion of the flow channel forming member 70, and a second flow channel part 78*b* that extends in the K1 axis direction (the longitudinal direction of the one end portion 501) from the first flow channel part 78*a* and whose downstream end portion is connected to the liquid supply part 57. The first flow channel part 78*a* intersects the one end portion 501**.

As shown in FIG. 11, the operation part 53 is connected to the liquid container part 52. In other words, the operation part 53 is connected to the liquid container part 52 directly or indirectly via another member. In this embodiment the operation part 53 is connected to the liquid container part 52 by being connected to the one end portion 501 of the liquid container part 52. The operation part 53 is located on the side of the one end portion 501 of the liquid container part 52. The operation part 53 includes the first side part 532 located at the end portion in the +Z axis direction, the attaching part 549 located at the end portion in the −Z axis direction, and a base part 538 located between the first side part 532 and the attaching part 549 with respect to the Z axis direction. The operation part 53 also includes a second side part 534 located at the end portion in the −K1 direction, and a third side part 536 located at the end portion in the +K2 axis direction.

The first side part 532, the second side part 534, the third side part 536, and the base part 538 have the shape of a rod. The first side part 532, the second side part 534, the third side part 536, and the base part 538 form a member having the shape of a frame. Thus, a receiving space 542 having a substantially rectangular shape for receiving a hand of the user is formed in the operation part 53.

The first side part 532 is a part that the user can grip. To facilitate understanding, in FIG. 11, FIG. 12, and FIG. 16, the first side part 532 of the operation part 53 is indicated by single hatching. The first side part 532 extends along the K1 axis direction (longitudinal direction of the one end portion 501). In other words, the longitudinal direction of the first side part 532 is the K1 axis direction, which is the same as the longitudinal direction of the one end portion 501. For example, the longitudinal direction of an upper surface 532*fa* of the first side part 532 (FIG. 16) is the K1 axis direction. The first side part 532 is located at a higher level than the liquid container part 52 when the liquid container 50 is attached to the printer 10. The first side part 532 is located at a higher level than the liquid container part 52 when the operation part 53 of the liquid container 50 is supported by the user or the movable member 34 (FIG. 6). In this specification, the first side part 532 is also referred to as a "grip part 532".

The second side part 534 (FIG. 14) intersects the first side part 532 at, of the first side part 532, an operation part's one end portion 532*s*, which is located in one of the longitudinal directions (K1 axis directions) of the one end portion 501. In this embodiment, the second side part 534 is a member that extends toward the base part 538 (in the −Z axis direction, the direction to the liquid container part 52) from the operation part's one end portion 532*s*. In this embodiment, the second side part 534 has a surface 534*fa* that faces the attaching direction in which the liquid container 50 is attached to the printer 10.

The third side part 536 (FIG. 14) intersects the first side part 532 at, of the first side part 532, an operation part's other end portion 532*t*, which is located in the other one of the longitudinal directions (K1 axis directions) of the one end portion 501. In this embodiment, the third side part 536 is a member that extends from the operation part's other end portion 532*t* toward the base part 538 side. The second side part 534 and the third side part 536 oppose each other. The third side part 536 also serves as a part that is pressed toward the attaching direction (−K1 axis direction) after the liquid container 50 is set to the movable member 34 by inserting the container-side engagement part 511 of the liquid container 50 into the apparatus-side engagement part 345 of the movable member 34. A color identification part for identifying the color stored in the liquid container part 52 may be disposed at the third side part 536. As the color identification part is, for example, a label with a description of the ink color, a label colored with the ink color, etc., may be used.

The base part 538 opposes the first side part 532. The base part 538 extends along the K1 axis direction. As shown in FIG. 12, the container-side engagement part 511 is disposed at the base part 538. The container-side engagement part 511 engages with the apparatus-side engagement part 345 of the movable member 34 (FIG. 10). The container-side engagement part 511 is disposed along the direction that is parallel with the longitudinal direction of the first side part 532 (the K1 axis direction, the longitudinal direction of the one end portion 501). In other words, the container-side engagement part 511 has a predetermined length in the longitudinal direction.

The attaching part 549 (FIG. 11) extends along the K1 axis direction. The attaching part 549 is the part to which the one end portion 501 of the liquid container part 52 (FIG. 11) is attached by fusing or the like.

The liquid supply part 57 and the substrate unit 58 (FIG. 17) are supported by (attached to) the second side part 534 of the operation part 53. Specifically, the liquid supply part 57 is supported by, of the second side part 534, the surface 534*fa* that faces toward the first direction. The surface 534*fa* is a surface that is perpendicular to the horizontal direction in the attached state. As shown in FIG. 17, the surface 534*fa* is a surface that intersects the upper surface 532*fa*. The liquid supply part 57 is in communication with the inside of the liquid container part 52, and supplies the ink in the liquid container part 52 to the printer 10. Specifically, the ink in the liquid container part 52 passes through the flow channel forming member 70 and the internal flow channel (not shown in the drawings) of the operation part 53, and reaches the liquid supply part 57. Then, the ink that has reached the liquid supply part 57 is supplied to the head 12 of the printer 10 via the liquid introduction part 362 and so on.

The liquid supply part 57 protrudes outward from the second side part 534 (specifically, the surface 534*fa*). The liquid supply opening 572, which is an opening, is formed in the tip of the liquid supply part 57. The liquid supply opening 572 is in communication with the inside of the liquid container part 52, and causes the ink stored in the liquid container part 52 to flow to the outside (printer 10). The liquid supply part 57 is a cylindrical member (annular member) extending along the K1 axis direction (the direction along a central axis CT). The direction to which the liquid supply opening 572 faces is the first direction (−K1 axis direction), which is one of the longitudinal directions of the one end portion 501 of the liquid container 50. The "direction to which the liquid supply opening 572 faces" is the direction that is perpendicular to the plane defined by the end surface of the liquid supply opening 572. Also, "the direction to which the liquid supply opening 572 faces is the first direction" means that the liquid supply opening 572 faces toward the direction that includes the first direction component. In this embodiment the direction to which the liquid supply opening 572 faces is the direction that is parallel with the first direction. In the attached state in which the liquid container 50 is attached to the printer 10, the liquid supply part 57 is located at a higher level than the liquid container part 52. Accordingly, when operating the liquid container 50, it is possible to easily check the position of the liquid supply part 57 without being obstructed by the liquid container part 52.

The liquid supply part 57 has the central axis CT. The central axis CT is parallel with the K1 axis direction. The central axis CT extends along a straight line. A valve mechanism for opening and closing the internal flow channel of the liquid supply part 57 is provided inside the liquid supply part 57. The valve mechanism opens the flow channel when the liquid introduction part 362 (FIG. 8) is inserted into the liquid supply part 57, so that the ink can be distributed from the liquid supply part 57 to the liquid introduction part 362. As shown in FIG. 17, container-side positioning parts 576*a* to 576*d*, which serve as supply opening positioning parts, are provided on the peripheral part of the liquid supply part 57 around the central axis CT. When the liquid supply part 57 is connected to the liquid introduction part 362, the four container-side positioning parts 576*a* to 576*d* enter the inside of the circle connecting the four introduction part-side positioning parts 576*a* to 576*d*. Then the four container-side positioning parts 576*a* to 576*d* and the corresponding introduction part-side positioning parts 366*a* to 366*d* are brought into contact, and thus positioning of the liquid supply part 57 and the liquid introduction part 362 within the plane that is perpendicular to the attaching direction (−K1 axis direction) is performed. In other words, the four container-side positioning parts 576*a* to 576*d* determine the position of the liquid supply opening 572 with respect to the liquid introduction part 362 when the liquid supply opening 572 is connected (inserted) to the liquid introduction part 362. Accordingly, the four container-side positioning parts 576*a* to 576*d* prevent misalignment of the liquid supply opening 572 and the liquid introduction part when the liquid supply opening 572 is connected to the liquid introduction part 362. Note that the container-side positioning parts 576*a* to 576*d* may also be considered as constituent members of the liquid supply part 57. In other words, the container-side positioning parts 576*a* to 576*d* are provided on the periphery of the body of the liquid supply part 57 in which the internal flow channel is formed.

The substrate unit 58 (FIG. 17), which serves as a container-side electrical connection part, includes the circuit substrate 582 and a contact part positioning part 59. The substrate unit 58 is supported by (attached to) the operation part 53. Specifically, as with the liquid supply part 57, the substrate unit 58 is supported by, of the second side part 534, the surface 534*fa* that faces toward the first direction. The substrate unit 58 protrudes outward from the second side part 534 (specifically, the surface 534*fa*). The projecting direction of the substrate unit 58 is the same as the projecting direction of the liquid supply part 57 (−K1 axis direction). As shown in FIG. 11, the substrate unit 58 and the first side part 532 serving as the grip part are arranged side-by-side in the first direction (−K1 axis direction). Note that in another embodiment, the liquid supply part 57 and the first side part 532 may be arranged side-by-side in the first direction. For example, the liquid supply part 57 and the first side part 532 are arranged side-by-side in the first direction in a liquid container in which the liquid supply part 57 and the substrate unit 58 are replaced with each other.

The contact part positioning part 59 positions the circuit substrate 582. The contact part positioning part 59 is provided integrally with the operation part 53. In this embodiment, the contact part positioning part 59 and the operation part 53 are formed by casting, and the contact part positioning part 59 is thereby provided integrally with the operation part 53. Here, "provided integrally" means that the contact part positioning part 59 is provided in the operation part 53 so as to move along with the movement of the operation part 53. In another embodiment, the contact part positioning part 59 may be provided integrally with the operation part 53 by attaching the contact part positioning part 59 to the operation part 53 by fusing or the like.

The contact part positioning part 59 has the shape of a depression with an opening provided on the −Z axis direction side (on the side of the liquid supply part 57). The contact part positioning part 59 includes a bottom part (bottom surface) 594, a first side wall part 592, and a second side wall part 593. The bottom part 594, the first side wall part 592, and the second side wall part 593 define the shape of the depression of the contact part positioning part 59. The first side wall part 592 is a wall part that extends in the downward direction of gravity from a portion of the bottom part 594 that is on the −K2 axis direction side. The second side wall part 593 is a wall part that extends in the downward direction of gravity from a portion of the bottom part 594 that is on the +K2 axis direction side. The first side wall part 592 and the second side wall part 593 oppose each other. The bottom part 594 having the shape of a depression, which is located on the +Z axis side, is inclined with respect to the K1 axis direction. The circuit substrate 582 is attached to the bottom part 594, and accordingly a front surface 582*fa* of the circuit substrate 582 is held in the state of being inclined with respect to the horizontal direction, by the contact part positioning part 59.

The first side wall part 592 has a groove part 597, which serves as a contact part-side positioning part. The second side wall part 593 has a groove part 599, which serves as a contact part-side positioning part. The two groove parts 597 and 599 are provided on both sides of the circuit substrate 582 so as to sandwich the circuit substrate 582 in the K2 axis direction. The two groove parts 597 and 599 each substantially have the shape of a rectangular cuboid. Immediately before the contact parts cp and the apparatus-side terminals 381 are brought into electrical contact, the two groove parts 597 and 599 enter the two corresponding contact mechanism-side positioning parts 386 and 387 (FIG. 6). Thus the final positioning of the circuit substrate 582 (specifically, the contact parts cp) with respect to the apparatus-side terminals 381 is performed. As described above, the two groove parts 597 and 599 serving as the contact part-side positioning part, position the contact parts cp with respect to the apparatus-side electrical connection parts 381 when the contact parts cp are brought into contact with the apparatus-side electrical connection parts 381. Accordingly, the two groove parts 597 and 599 prevent misalignment of the apparatus-side electrical connection parts 381 and the contact parts cp.

As shown in FIG. 18, a boss groove 584 is formed in a lower end portion 586 of the circuit substrate 582 in the −Z axis direction, and a boss hole 585 is formed in an upper end portion 587 of the circuit substrate 582 in the +Z axis direction. The circuit substrate 582 is fixed to the bottom part 594 (FIG. 17) by using the boss groove 584 and the boss hole 585.

As shown in FIG. 18 and FIG. 19, the circuit substrate 582 includes liquid container-side terminals 580 provided on the front surface 582*fa* and a storage device 583 provided on a rear surface 582*fb*. The front surface 582*fa* and the rear surface 582*fb* are flat surfaces.

The liquid container-side terminals 580 include nine terminals 581A to 581I. The storage device 583 stores information about the liquid container 50 (e.g., the amount of remaining ink, the color of ink). The storage device 583 and the nine terminals 581A to 581I are electrically connected.

As shown in FIG. 18, each of the nine liquid container-side terminals 581A to 581I is formed to have a substantially rectangular shape. The nine liquid container-side terminals 581A to 581I are arranged so as to form two rows Ln1 and Ln2 that are separate from each other in the Z axis direction, which is the direction that intersects with the attaching direction (−K1 axis direction). Five liquid container-side terminals 581E to 581I and four liquid container-side terminals 581A to 581D are respectively arranged along the direction (K2 axis direction) that intersects with the first direction (−K1 axis direction). Each of the rows Ln1 and Ln2 are parallel with the K2 axis direction that intersects with the first direction (−K1 axis direction). A contact part cp is formed in the central portion of each of the liquid container-side terminals 581A to 581I, which is brought into contact with the corresponding apparatus-side terminal out of the apparatus-side terminals 381. The rows Ln1 and Ln2 may be considered as rows composed of a plurality of contact parts cp. Note that when the liquid container-side terminals 581A to 581I are referred to without being distinguished from each other, the sign "581" is used.

As shown in FIG. 17, the front surface 582*fa*, which is an inclined surface on which the plurality of contact parts cp are arranged, is inclined with respect to the connecting direction (attaching direction) of the liquid container 50. Specifically, the front surface 582*fa* on which the plurality of contact parts cp are arranged is inclined such that its upper end portion 587 is located more in the connecting direction (−K1 axis direction) than its lower end portion 586. Also, a virtual plane (contact surface) defined by the plurality of contact parts cp is inclined with respect to the connecting direction (−K1 axis direction). Specifically, the virtual plane is inclined such that its upper side is located more in the connecting direction than its lower side. Here, the virtual plane is a plane defined by three contact parts cp among which at least one contact part cp is not arranged in a straight line. Also, the front surface 582*fa* and the virtual plane are inclined so as to face toward the direction that includes the +Z axis direction (upward gravity direction) component and the −K1 axis direction (connecting direction) component. The virtual plane (contact surface) is a plane that passes through the plurality of contact parts cp.

As shown in FIG. 13, when the operation part 53 is projected onto the plane (reference plane) that is perpendicular to the longitudinal direction of the first side part 532 (K1 axis direction, the direction parallel with the central axis CT), the liquid supply part 57 and the contact parts cp are arranged side-by-side along the direction that is perpendicular to the longitudinal direction and in which the second side part 534 extends (the Z axis direction, the vertical direction). In other words, when the operation part 53 is projected onto the reference plane, at least a portion of the plurality of contact parts cp are located within a range 57Pt along the transverse direction of the second side part 534 (the K2 axis direction) in which the liquid supply part 57 is located. Also, in the liquid container 50 shown in FIG. 13, at least some of the contact parts cp may be located within the range 57Pt along the vertical direction in which the liquid supply part 57 is located. In this embodiment, a plurality of contact parts cp are located within the range 57Pt. With this configuration, the liquid container 50 is prevented from increasing in size in the direction (K2 axis direction) that is perpendicular to the longitudinal direction of the operation part 53 and the direction in which the second side part 534 extends. Note that in FIG. 13, the range 57Pt and the range surrounded by the minimum convex polygon including a plurality of contact parts cp may at least partially overlap in the vertical direction. Such a configuration also prevents the liquid container 50 from increasing in size in the K2 axis direction in a manner similar to the above.

Figure 20:
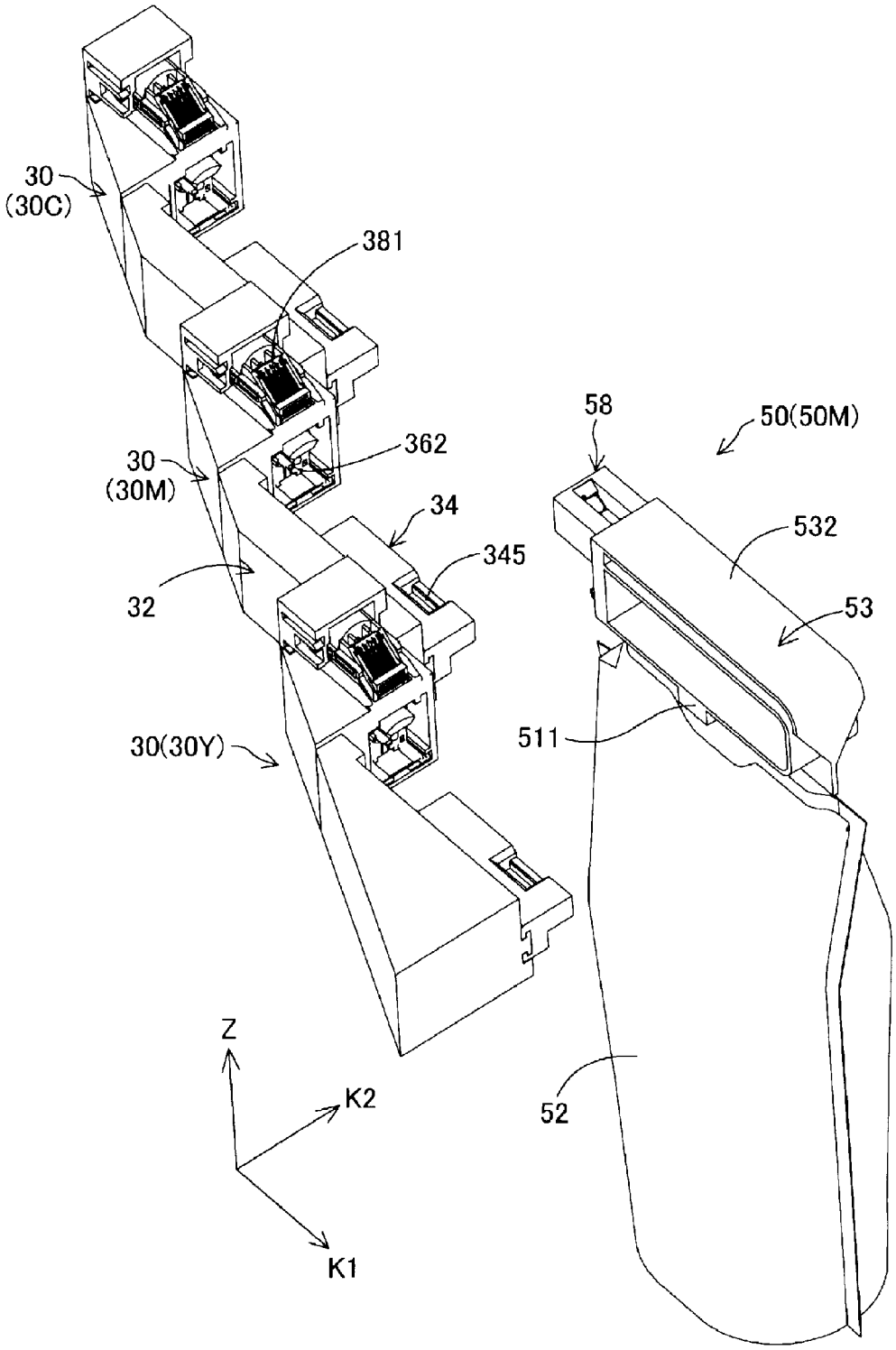
FIG. 20 is a first diagram illustrating a method for attaching the liquid container.
Figure 21:
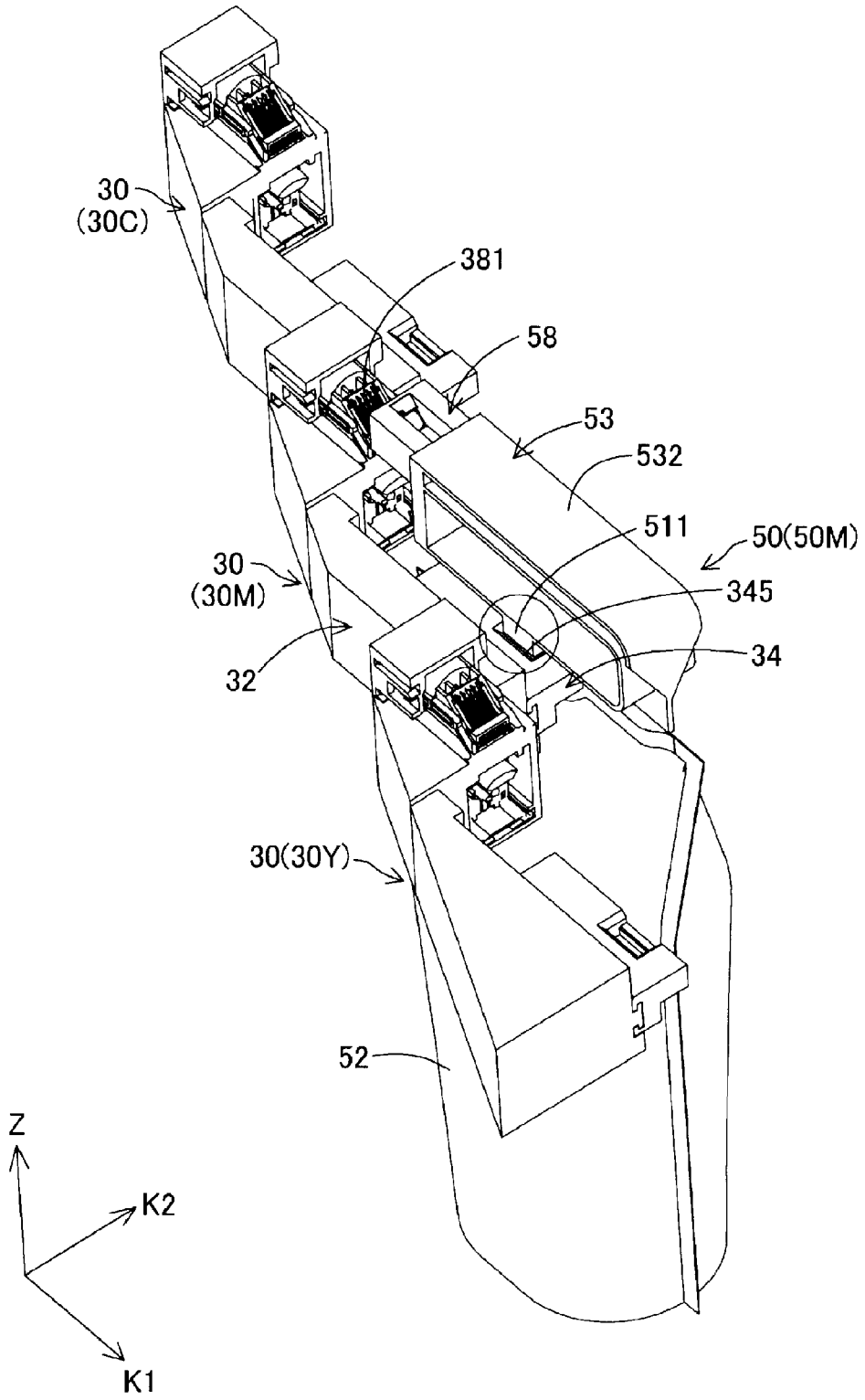
FIG. 21 is a second diagram illustrating the method for attaching the liquid container.
Figure 22:
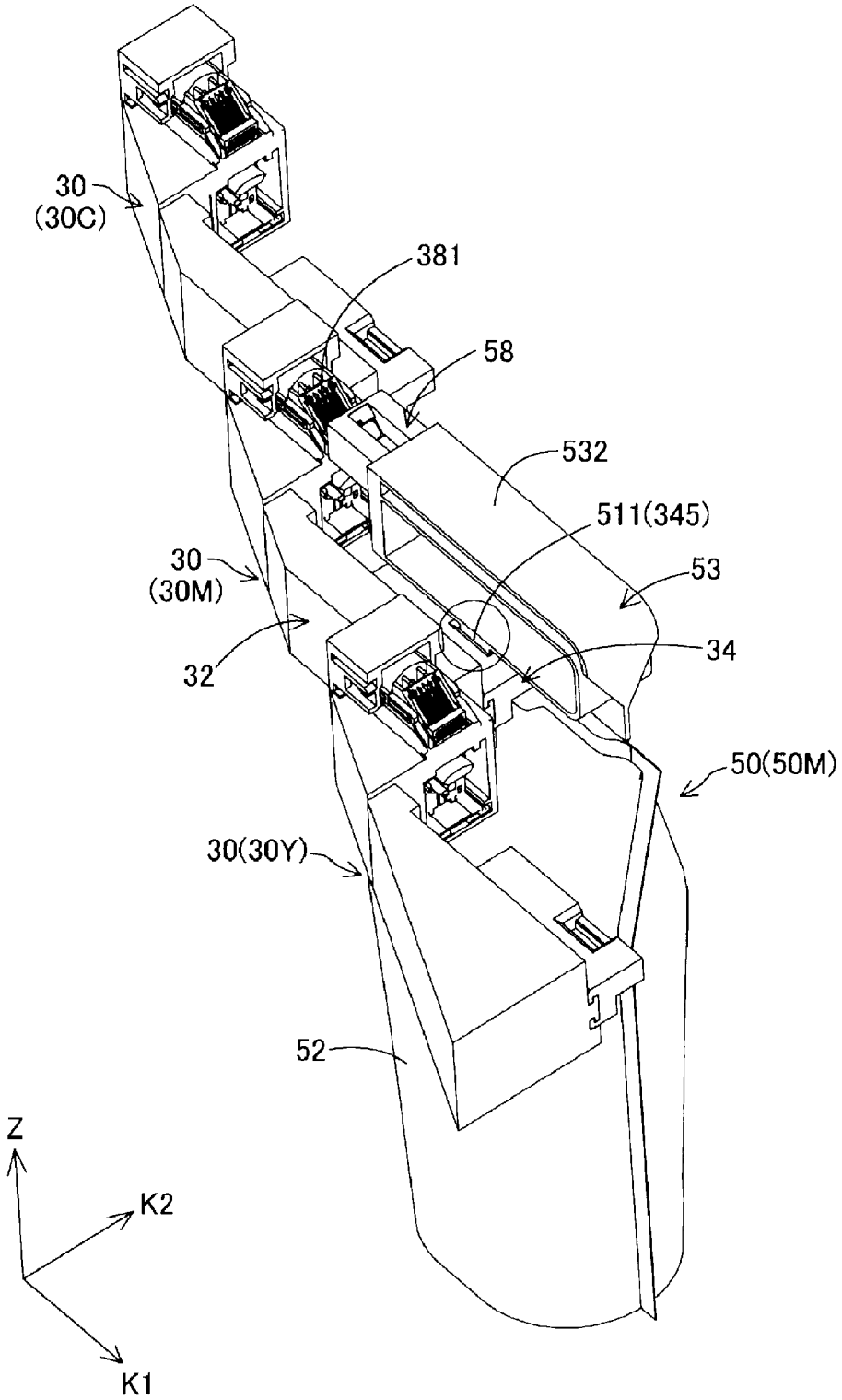
FIG. 22 is a third diagram illustrating the method for attaching the liquid container.
Figure 23:
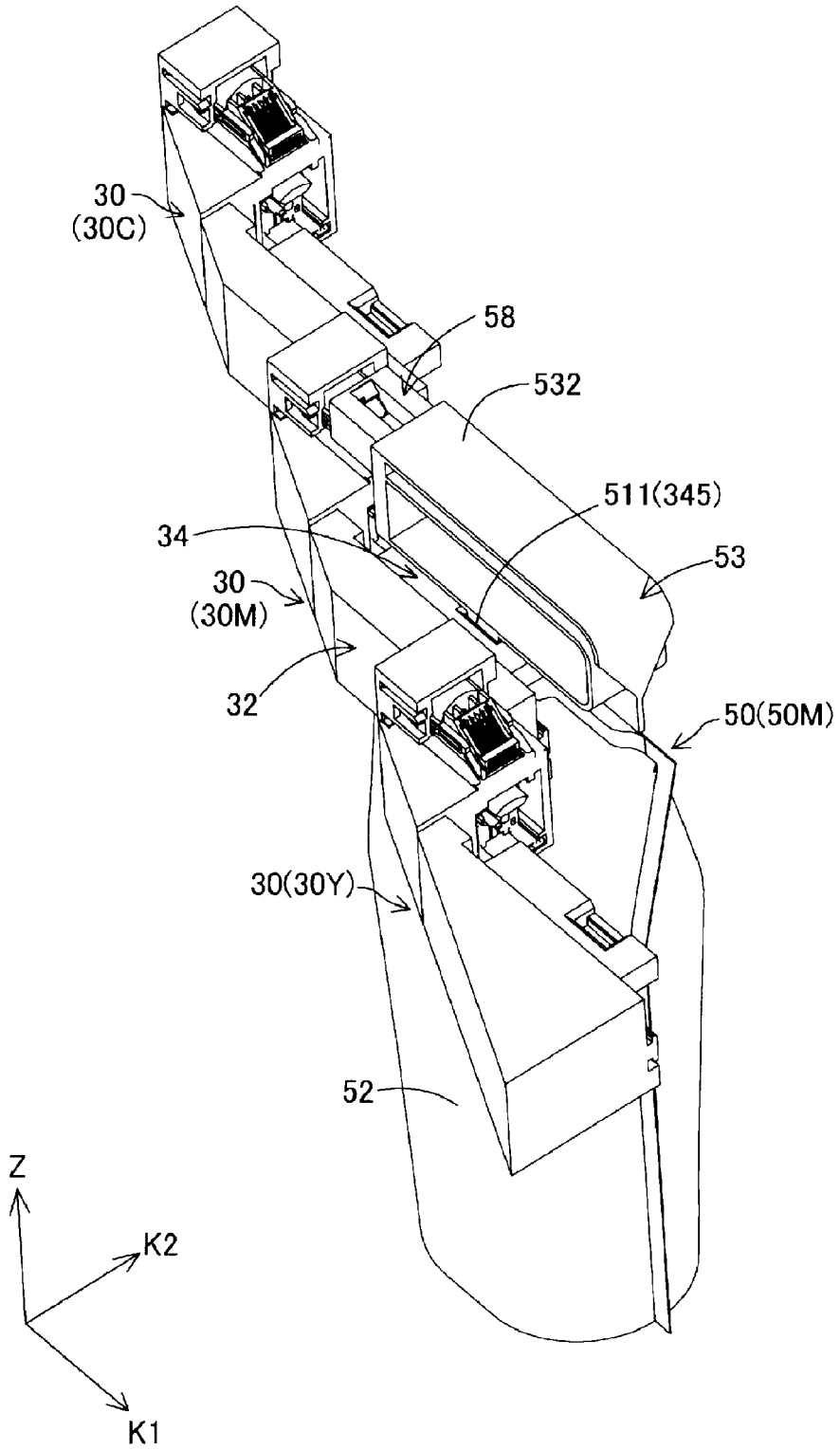
FIG. 23 is a fourth diagram illustrating the method for attaching the liquid container.

A-4. Method for Attaching Liquid Container 50:

FIG. 20 is a first diagram illustrating a method for attaching the liquid container 50. FIG. 21 is a second diagram illustrating the method for attaching the liquid container 50. FIG. 22 is a third diagram illustrating the method for attaching the liquid container 50. FIG. 23 is a fourth diagram illustrating the method for attaching the liquid container 50. The steps of attaching the liquid container 50 to the printer 10 are performed in order from FIG. 20 to FIG. 23.

As shown in FIG. 20 and FIG. 21, when attaching the liquid container 50 to the printer 10, first, the user holds the first side part 532 and moves the liquid container 50 so that the container-side engagement part 511 of the liquid container 50 is located above the apparatus-side engagement part 345 of the movable member 34. Then, as shown in FIG. 22, the user moves the liquid container 50 in the vertically downward direction to insert the container-side engagement part 511 into the apparatus-side engagement part 345 and engage the container-side engagement part 511 and the apparatus-side engagement part 345 with each other. This completes the setting of the liquid container 50 to the movable member 34. Next, as shown in FIG. 23, the user moves the operation part 53 or the movable member 34 in the −K1 axis direction (connecting direction) to bring the contact parts cp into contact with the apparatus-side terminals 381, and to connect the liquid supply part 57 and the liquid introduction part 362 (FIG. 9). This completes the setting of the liquid container 50 to the printer 10.

Here, when the connecting direction is a direction along the thickness direction of the liquid container part 52 (K2 axis direction), it is necessary to secure a sufficient interval in the K1 axis direction between adjacent liquid containers 50 (between the spaces in which the liquid containers 50 are housed) in order to prevent adjacent liquid containers 50 from hitting each other when being attached. However, in this embodiment, the connecting direction (−K1 direction) is a direction along the length direction of the liquid container part 52 (K1 axis direction), and thus this configuration reduces the possibility of adjacent liquid containers 50 hitting against the liquid container 50 to be attached, and the attaching operation being obstructed when the user attaches a liquid container 50 to the printer 10. Also, the attaching/detaching direction (K1 axis direction) of the liquid container 50 to/from the printer 10 has forward and backward direction components (X axis direction components) of the printer 10. This configuration reduces the operation space that is necessary for attaching/detaching the liquid container 50 in the lateral direction (Y axis direction) of the printer 10.

A-5. Advantageous Effects:

In the above-described embodiment, as shown in FIG. 11, the liquid container 50 has the first side part 532 as the grip part. Accordingly, the user can easily move the operation part 53 by gripping the first side part 532. Also, since the operation part 53 having the first side part 532 is connected to the liquid container part 52, the user can connect the liquid supply part 57 to the liquid introduction part 362 by moving the operation part 53. Also, since the liquid supply opening 572 faces toward the first direction (−K1 axis direction), which coincides with the longitudinal direction (K1 axis direction) of the one end portion 501 of the liquid container part 52, this configuration can reduce the space necessary for the attaching operation for attaching the liquid container 50 in the direction (K2 axis direction) that intersects the attaching direction in which the liquid container 50 is attached to the printer 10.

Also, in the above-described embodiment, since the operation part 53 is located on the side of the one end portion 501 of the liquid container part 52, when the user grips the first side part 532, the other end portion 502 of the liquid container part 52 is suspended vertically below the one end portion 501 due to its own weight. Therefore, this configuration makes the orientation of the liquid container 50 stable when the user grips the first side part 532, and allows the user to easily operate the liquid container 50. Also, since the liquid supply part 57 is supported by the operation part 53 (specifically, the surface 534*fa*), the user can easily change the position of the liquid supply part 57 by changing the position of the operation part 53. For example, by setting the operation part 53 on the movable member 34 and moving the movable member 34, the user can move the liquid supply part 57 in conjunction with the movement of the operation part 53. Thus, the liquid supply part 57 can be more surely connected to the liquid introduction part 362.

Also, in the above-described embodiment, as shown in FIG. 14, since the liquid supply opening 572 faces toward the first direction (−K1 axis direction), which coincides with the longitudinal direction of the one end portion 501 of the liquid container part 52, this configuration can reduce the space necessary for the attaching operation for attaching the liquid container 50 in the direction (for example, the K2 axis direction) that intersects the attaching direction in which the liquid container 50 is attached to the printer 10. Also, as shown in FIG. 23, the liquid container 50 can be supported on the printer 10 by the container-side engagement part 511.

Also, in the above-described embodiment, as shown in FIG. 11, the liquid container 50 includes the operation part 53 that is disposed on the one end portion 501 of the liquid container part 52. Also, the operation part 53 includes: the first side part 532 that is disposed above the liquid container part 52 when the liquid container 50 is attached to the printer 10 and that is grippable; and the second side part 534 that extends from the operation part's one end portion 532*s* of the first side part 532 toward the liquid container part 52 and supports the liquid supply part 57. Due to this configuration, the user can easily operate the operation part 53 by gripping the first side part 532 of the operation part 53. Also, since the liquid supply part 57 is supported by the second side part 534 of the operation part 53, the liquid supply part 57 can be connected to the liquid introduction part 362 by moving the operation part 53 along the longitudinal direction of the one end portion 501.

Also, in the above-described embodiment, as shown in FIG. 14, the first side part 532 is disposed such that the longitudinal direction of the first side part 532 is parallel with the longitudinal direction of the one end portion 501. Due to this configuration, the liquid container 50 can be reduced in thickness in the K2 axis direction compared to when the longitudinal direction of the first side part 532 is the direction that intersects the longitudinal direction of the one end portion 501.

Also, in the above-described embodiment, as shown in FIG. 4, the angle a1 formed between a longitudinal direction KID of the first side part 532 and the right side face 106 in the counterclockwise direction when the printer 10 is seen from above in the vertical direction (+Z axis direction) is equal to or greater than 0 degrees and less than 90 degrees, and the connecting direction of the liquid supply part 57 has forward and backward direction components (X axis direction components). Due to this configuration, the increase in size in the lateral direction (Y axis direction) of the liquid consumption system 1000 including the printer 10 and the liquid containers 50 can be suppressed. Also, when the liquid containers 50 are attached to the printer 10, the operation space for the liquid containers 50 in the lateral direction can be reduced. Therefore, the operation space in the lateral direction that needs to be secured when attaching/detaching the liquid container 50 can be reduced.

In the above-described embodiment, as shown in FIG. 10, the liquid container 50 includes the container-side engagement part 511 for engagement with the apparatus-side engagement part 345 of the movable member 34 disposed in the operation part 53. Due to this configuration, the movable member 34 serving as the guiding part guides the liquid supply part 57 to the connection position with the liquid introduction part 362, and accordingly the liquid supply part 57 can be easily connected to the liquid introduction part 362. It is preferable that the container-side engagement part 511 is disposed along the direction that is parallel with the longitudinal direction of the first side part 532 (the connecting direction, the longitudinal direction of the one end portion 501). Due to this configuration, the misalignment of the container-side engagement part 511 and the movable member 34 in the connecting direction can be further prevented, and accordingly, the liquid supply part 57 can be even more easily connected to the liquid introduction part 362.

Also, in the above-described embodiment, as shown in FIG. 17, the liquid container 50 includes the contact parts cp provided on the operation part 53. Due to this configuration, the user can easily move the contact parts cp by gripping the operation part 53 and operating the liquid container 50. Also, the front surface 582*fa*, on which the contact parts cp are provided, is inclined with respect to the connecting direction (−K1 axis direction) of the liquid container 50 when the contact parts cp are connected to the apparatus-side electrical connection parts 381. Due to this configuration, the contact parts cp and the apparatus-side electrical connection parts 381 slide against each other immediately before they are brought into contact, and accordingly foreign objects adhering to the contact parts cp can be removed. Therefore, this configuration can reduce the possibility of an electrical connection failure occurring between the contact parts cp and the apparatus-side electrical connection parts 381. Note that the same advantageous effects as above can be achieved when the surface defined by the plurality of contact parts cp is inclined with respect to the connection direction instead of the front surface 582*fa*, on which that the contact parts cp are disposed, being inclined with respect to the connecting direction.

Also, in the above-described embodiment, as shown in FIG. 2 and FIG. 3, each of the apparatus-side terminals 381 and the liquid introduction part 362 are located outside the housing 19. Due to this configuration, the corresponding members cp and 57 of the liquid container 50 can be easily connected to the apparatus-side terminals 381 and the liquid introduction part 362 compared to when the apparatus-side terminals 381 and the liquid introduction part 362 are located inside the housing 19.

Also, in the above-described embodiment, as shown in FIG. 11, the substrate unit 58, which serves as the container-side electrical connection part, and the first side part 532, which serves as the grip part, are arranged side-by-side in the first direction (−K1 axis direction). Due to this configuration, the liquid container can be reduced in size in the direction that intersects the first direction (e.g. the K2 axis direction). Also, it is easy to connect the substrate unit 58 to the apparatus-side electrical connection parts 381 by operating the first side part 532.

B. Second Embodiment

Figure 24:
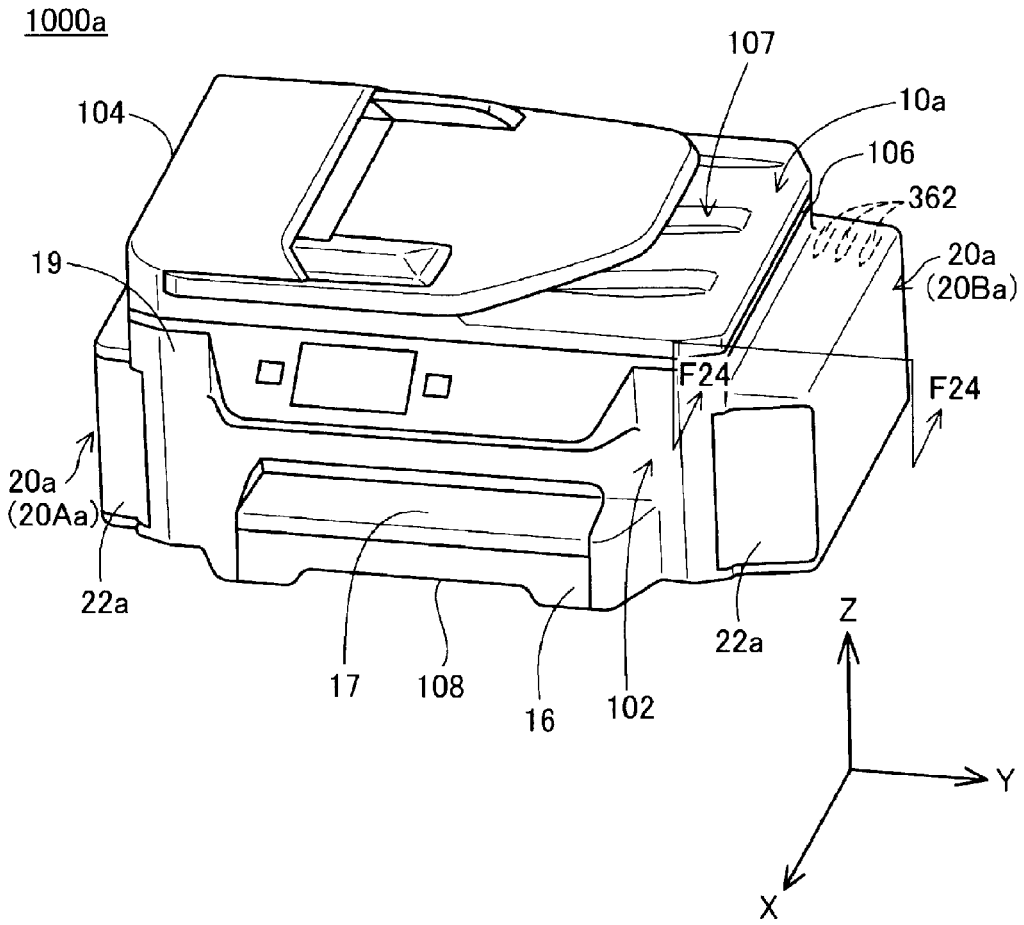
FIG. 24 is a perspective view of a liquid consumption system according to a second embodiment.
Figure 25:
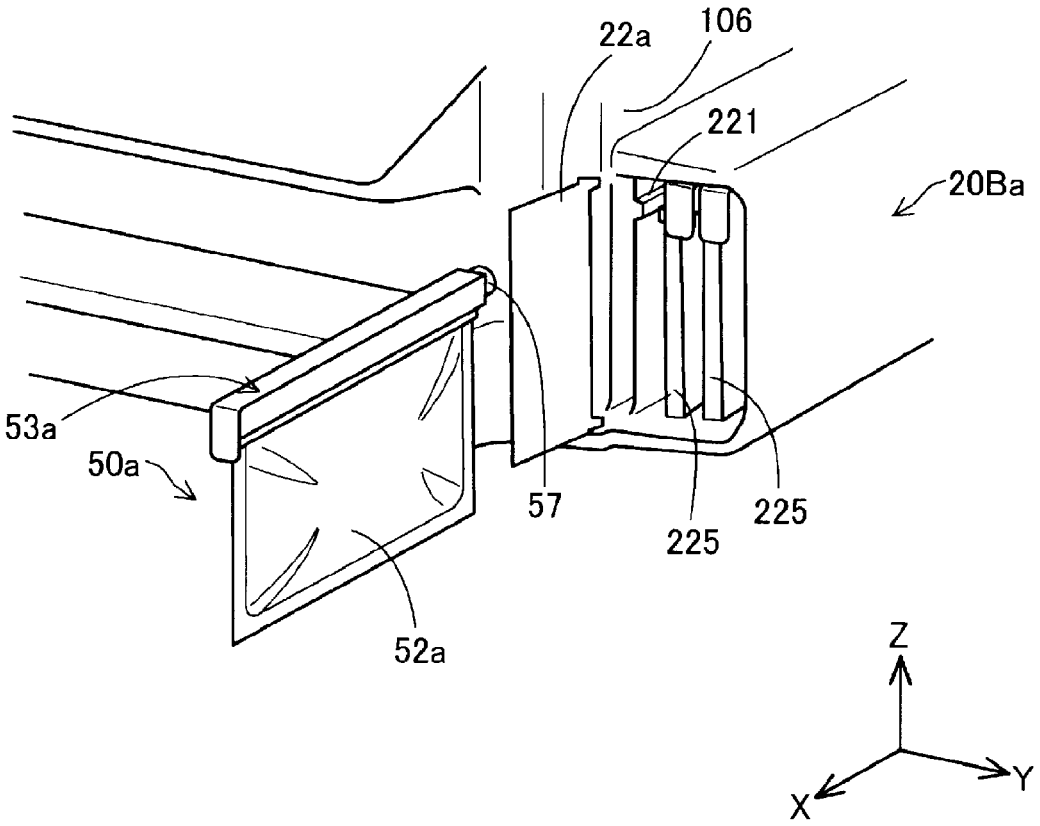
FIG. 25 is a partially enlarged view of the liquid consumption system.

FIG. 24 is a perspective view of a liquid consumption system 1000*a* according to a second embodiment. FIG. 25 is a partially enlarged view of the liquid consumption system 1000*a*. The liquid consumption system 1000*a* according to the second embodiment is different from the liquid consumption system 1000 (FIG. 1) according to the first embodiment in the number of the paper feed cassettes 16 of a printer 10*a*, the configurations of liquid container casings 20*a*, and the configurations of liquid containers 50*a*. Since the other elements are the same as the elements of the first embodiment, the elements that are the same as those in the first embodiment are given the same reference signs and the description thereof is omitted.

A first liquid container casing 20Aa is attached to the left side face 104 of the housing 19. A second liquid container casing 20Ba is attached to the right side face 106 of the housing 19. The first liquid container casing 20Aa houses a single liquid container 50*a* (a liquid container for housing black ink) and the second liquid container casing 20Ba houses three liquid containers 50*a*. The three liquid containers 50*a* are arranged side-by-side along the Y axis direction. Each of the three liquid containers 50*a* stores ink of a different color (yellow, magenta, cyan). When the first liquid container casings 20Aa and the second liquid container casings 20Ba are referred to without being distinguished from each other, they are simply referred to as "liquid container casings 20*a*".

As shown in FIG. 24, within the liquid container casing 20*a*, the liquid introduction parts 362 are provided on the side of the −X axis direction. The liquid introduction parts 362 are in communication with the head of the printer 10*a* via a hose, which serves as the distribution member and is not shown in the drawings. A lid part 22*a* that is openable and closable is attached to the front face of the liquid container casing 20*a*. The lid part 22*a* is opened, the liquid container 50*a* is housed in the liquid container casing 20*a*, and the liquid supply part 57 of the liquid container 50*a* is connected to the liquid introduction part 362. Thus, the liquid container 50*a* is attached to the printer 10*a*. In this embodiment, the attaching direction of the liquid container 50*a* (the connecting direction of the liquid supply part 57) is the −X axis direction, and the detaching direction of the liquid container 50*a* is +X axis direction.

Figure 26:
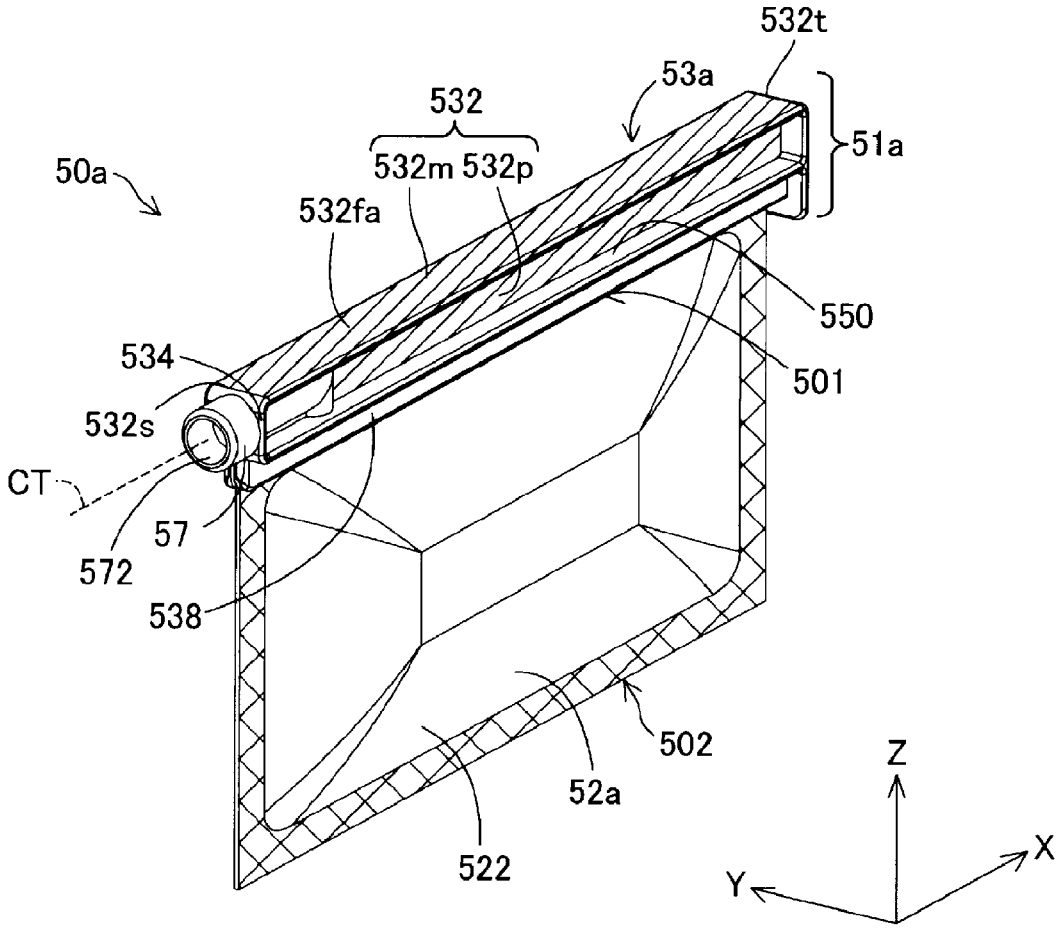
FIG. 26 is a first perspective view of a liquid container.
Figure 27:
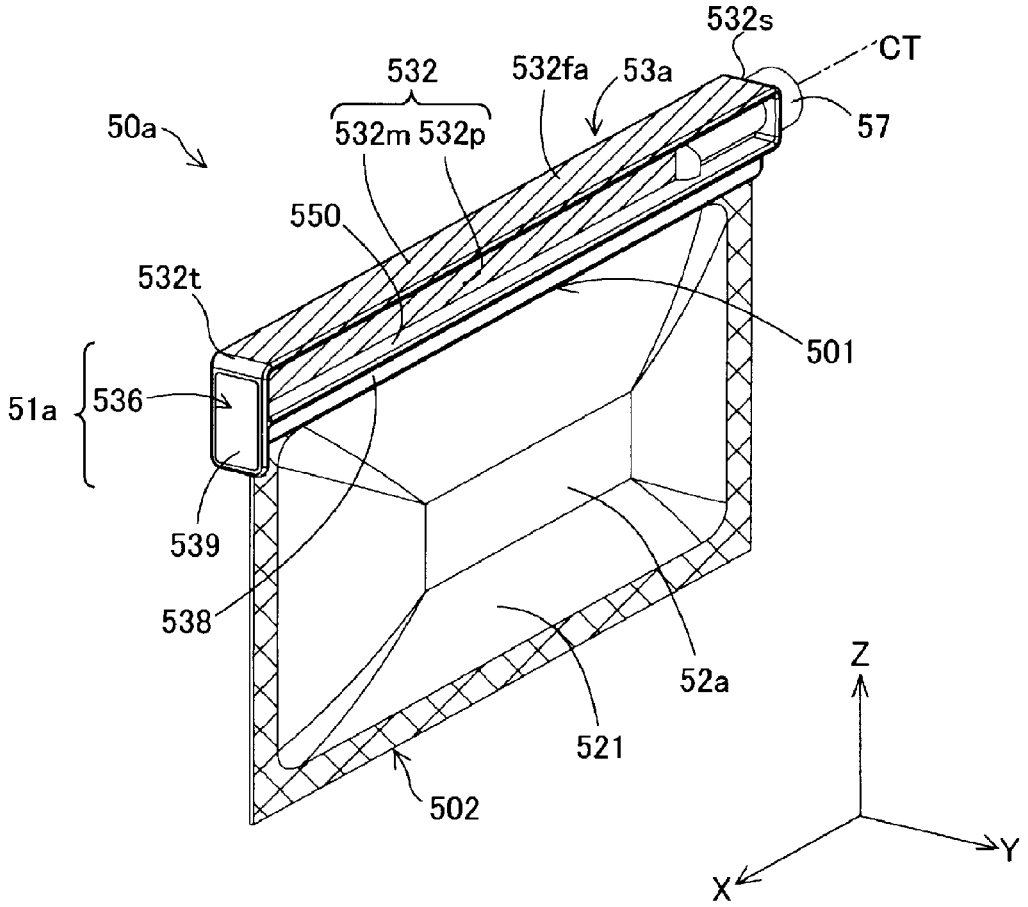
FIG. 27 is a second perspective view of the liquid container.

FIG. 26 is a first perspective view of the liquid container 50*a*. FIG. 27 is a second perspective view of the liquid container 50*a*. FIG. 26 and FIG. 27 show the X axis, the Y axis, and the Z axis in the attached state. The four liquid containers 50*a*, each storing ink of a different color, have the same configuration. The liquid container 50*a* according to the second embodiment is different from the liquid container 50 (FIG. 11) according to the first embodiment in the number of the films 521 and 522 constituting a liquid container part 52*a*, and the configuration of the container part supporting assembly 51.

The X axis direction, the Y axis direction, and the Z axis direction can be defined as follows. When the liquid container 50*a* is in the attached state, the Z axis direction is the direction of gravity (vertical direction). The +Z axis direction is the upward gravity direction (vertically upward direction), and the −Z axis direction is the downward direction of gravity (vertically downward direction). The X axis direction is the horizontal direction. The −X axis direction is the attaching direction (connecting direction) of the liquid container 50*a*. The +X axis direction is the detaching direction in which the liquid container 50*a* is detached from the printer 10*a*. The Y axis direction is the direction that is perpendicular to the direction of gravity (Z axis direction) and the X axis direction. The Z axis direction is the "height direction" of the liquid container 50*a*. The X axis direction is the "length direction" of the liquid container 50*a*. The Y axis direction is the "thickness direction" of the liquid container 50*a*.

The liquid container part 52*a* is capable of storing ink. The liquid container part 52*a* is attached to a container part supporting assembly 51*a*, with the external surface being exposed. In other words, the liquid container part 52*a* is not housed in a casing or the like, and is configured to be externally visible. The liquid container part 52*a* is flexible, and the capacity thereof decreases as the ink stored therein decreases.

The liquid container part 52*a* includes a first film 521 and a second film 522. The first film 521 and the second film 522 partition the space for storing the ink therein. In the attached state, each of the first film 521 and the second film 522 constitutes a side face part of the liquid container part 52*a*. Here, the first film 521 is also referred to as a first face 521 of the liquid container part 52*a*, and the second film 522 is also referred to as a second face 522 of the liquid container part 52*a*. The respective peripheral areas of the first film 521 and the second film 522 are partially fused to each other. To facilitate understanding, in FIG. 26 and FIG. 27, the part where the first film 521 and the second film 522 are fused to each other is indicated by cross hatching. The container part supporting assembly 51*a* is attached to the one end portion 501 of the liquid container part 52 by fusing. The first film 521 and the second film 522 are flexible as in the first embodiment.

The container part supporting assembly 51*a* includes an operation part 53*a*, and the liquid supply part 57. In this embodiment, the operation part 53*a* is attached to the one end portion 501 of the liquid container part 52*a*. The operation part 53*a* is a rod-like member extending in the direction (X axis direction) that is parallel with the direction in which the one end portion 501 extends (the longitudinal direction of the one end portion 501). The operation part 53*a* includes a first side part 532 disposed at its end portion in the +Z axis direction, a base part 538 disposed at its end portion in the −Z axis direction, a second side part 534 disposed at its end portion in the −X axis direction, and a third side part 536 disposed at its end portion in the +X axis direction. The base part 538 also serves as the attaching part 549 (FIG. 11) in the first embodiment, and one end portion 501 of the liquid container part 52*a* is attached to the base part 538.

The first side part 532 is a member that extends along the longitudinal direction of the one end portion 501 (X axis direction). The first side part 532 is a part that the user can grip. To facilitate understanding, in FIG. 26 and FIG. 27, the first side part 532 of the operation part 53*a* is indicated by single hatching. The first side part 532 includes a first plate member 532*m*, which has the face 532*fa* in the Z axis direction and extends along the X axis direction, and a second plate member 532*p*, which extends vertically downward from the first plate member 532*m*. The first side part 532 is located above the liquid container part 52*a* when the liquid container 50*a* is attached to the printer 10*a*.

The second side part 534 (FIG. 26) intersects the first side part 532 at the operation part's one end portion 532*s* of the first side part 532. In this embodiment, the second side part 534 is a member that extends toward the base part 538 from the operation part's one end portion 532*s*.

The liquid supply part 57 (FIG. 26) is supported by (attached to) the second side part 534 of the operation part 53*a* in the same manner as in the first embodiment. The liquid supply part 57 is in communication with the liquid container part 52*a* via the internal flow channel of the operation part 53*a*.

The third side part 536 (FIG. 27) intersects the first side part 532 at the operation part's other end portion 532*t* of the first side part 532. In this embodiment, the third side part 536 is a member that extends from the operation part's other end portion 532*t* toward the base part 538. The third side part 536 opposes the second side part 534. A color identification part 539 for identification of the color of the ink stored in the liquid container part 52*a* is disposed on the third side part 536. The color identification part 539 is a label colored with the ink color. In another embodiment, the color identification part 539 may be a label or the like with a description of the ink color. Due to the color identification part 539, the user can easily identify the color of the ink stored in the liquid container 50*a*. Also, as in the first embodiment, the third side part 536 also serves as the part that is pressed in the attaching direction (−X axis direction) by the user.

The base part 538 opposes the first side part 532. The longitudinal direction of the base part 538 (X axis direction) is the same as the longitudinal direction of the first side part 532. A container-side engagement part 550 is provided on the base part 538. The container-side engagement part 550 is a plate-like member that protrudes outward from the base part 538 in the Y axis direction (the thickness direction of the liquid container part 52*a*). The container-side engagement part 550 is disposed along the direction that is parallel with the longitudinal direction of the first side part 532 (the X axis direction). In this embodiment, the container-side engagement part 550 extends from the operation part's one end portion 532*s* to the operation part's other end portion 532*t* in the X axis direction. When the liquid container 50*a* is attached to the printer 10*a*, the container-side engagement part 550 engages with a guiding part, which serves as an apparatus-side engagement part described below, disposed in the liquid container casing 20*a*.

Figure 28:
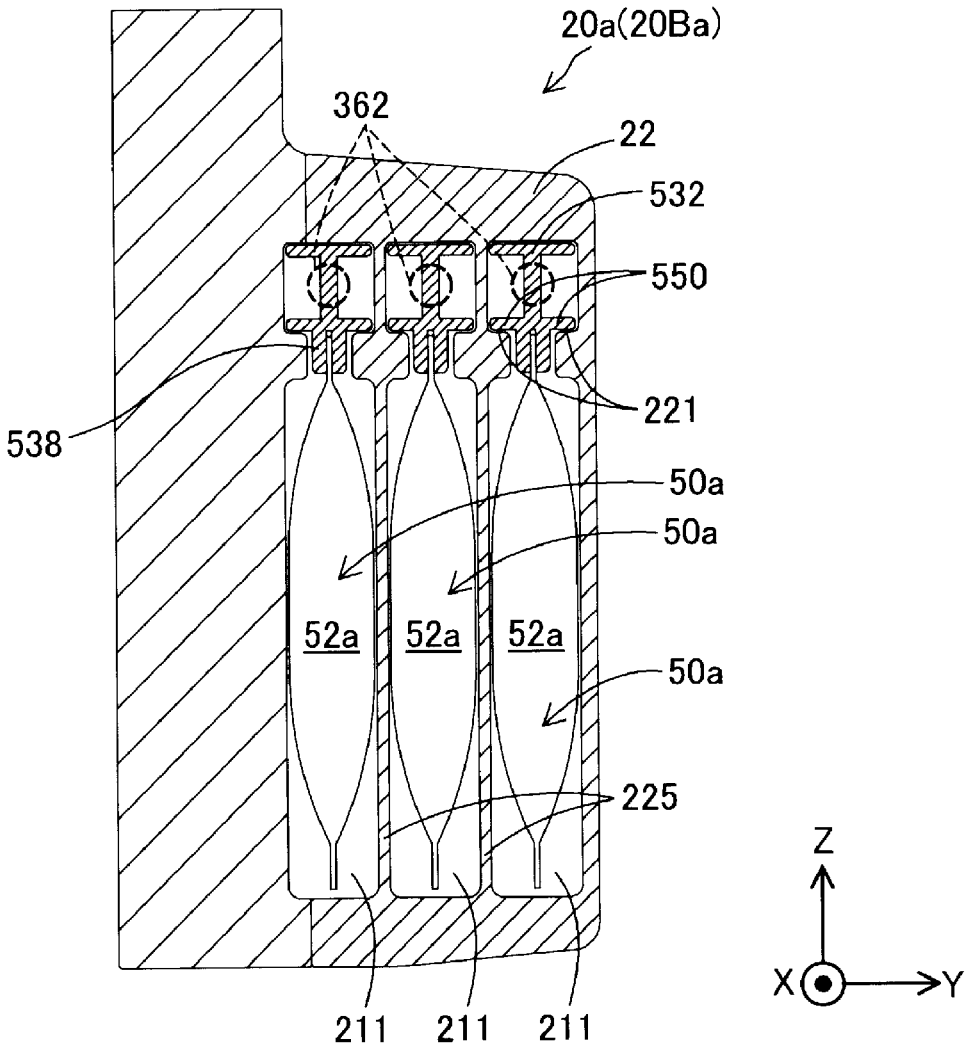
FIG. 28 is a cross-sectional view along F24-F24 in FIG. 24.

FIG. 28 is a cross-sectional view along F24-F24 in FIG. 24. FIG. 28 shows the state in which three liquid containers 50*a* are attached to the liquid container casings 20Ba. The liquid container casing 20*a* includes a guiding part 221, which extends along the X axis direction and serves as an apparatus-side engagement part. When the liquid container 50*a* is attached to the printer 10*a*, the container-side engagement part 550 is placed on the guiding part 221, and thus the container-side engagement part 550 and the guiding part 221 engage with each other. The guiding part 221 is a flat plate that protrudes from a wall from which the liquid container casing 20*a* is formed. When the liquid supply part 57 of the liquid container 50*a* is connected to the liquid introduction part 362, the container-side engagement part 550 engages with the guiding part 221, and the liquid container 50*a* moves in the connecting direction (−X axis direction). Thus, the connection of the liquid supply part 57 and the liquid introduction part 362 can be easily performed.

The liquid container casing 20Ba has two partition parts 225 that form container space parts 211 for housing adjacent liquid containers 50*a*. Each partition part 225 is located between two adjacent liquid introduction parts 362. The two partition parts 225 are walls that are substantially perpendicular to the horizontal plane. The container space parts 211 are formed by the two partition parts 225 and the casing body 22 of the liquid container casing 20*a*. Due to the partition parts 225, adjacent liquid containers 50*a* are prevented from hitting each other when being attached, and accordingly it is easy to attach/detach the liquid containers 50*a*.

Here, it is preferable that the length of the container space parts 211 in the Y axis direction is smaller than the maximum width of the liquid container parts 52*a* in the Y axis direction. The maximum width of the liquid container parts 52*a* in this case is the maximum width of the liquid container 50*a* in the initial state before the ink is consumed, and in the free state of the liquid container parts 52*a* with the first side part 532 being gripped (the liquid container parts 52*a* are suspended vertically downward from the operation part 53*a*). With this configuration, the lower portions of the liquid container parts 52*a* are prevented from bulging, and accordingly the container space parts 211 can be reduced in size in the Y axis direction.

The above-described embodiment achieves the same advantageous effects as the first embodiment, resulting from the same configuration. For example, as shown in FIG. 26, the liquid container 50*a* includes the operation part 53*a* that is disposed on the one end portion 501 of the liquid container part 52*a*. Also, the operation part 53*a* includes the first side part 532, which is located above the liquid container part 52*a* when the liquid container 50*a* is attached to the printer 10*a* and which is grippable, and the second side part 534, which intersects the first side part 532 and supports the liquid supply part 57. With this configuration, the user can easily operate the operation part 53*a* by gripping the first side part 532 of the operation part 53*a*. Also, since the liquid supply part 57 is supported by the second side part 534 of the operation part 53*a*, the liquid supply part 57 can be connected to the liquid introduction part 362 by moving the operation part 53*a* along the longitudinal direction of the one end portion 501.

Also, in the above-described embodiment, the printer 10*a* includes the guiding part 221 for guiding the liquid container 50*a* to the connection position (attaching position) with the container-side engagement part 550 being in contact with the liquid container 50*a*. Due to this configuration, the container-side engagement part 550 and the guiding part 221 guide the liquid supply part 57 to the connection position, and accordingly the liquid supply part 57 can be easily connected to the liquid introduction part 362.

C. Other Embodiments of Liquid Container

Figure 29:
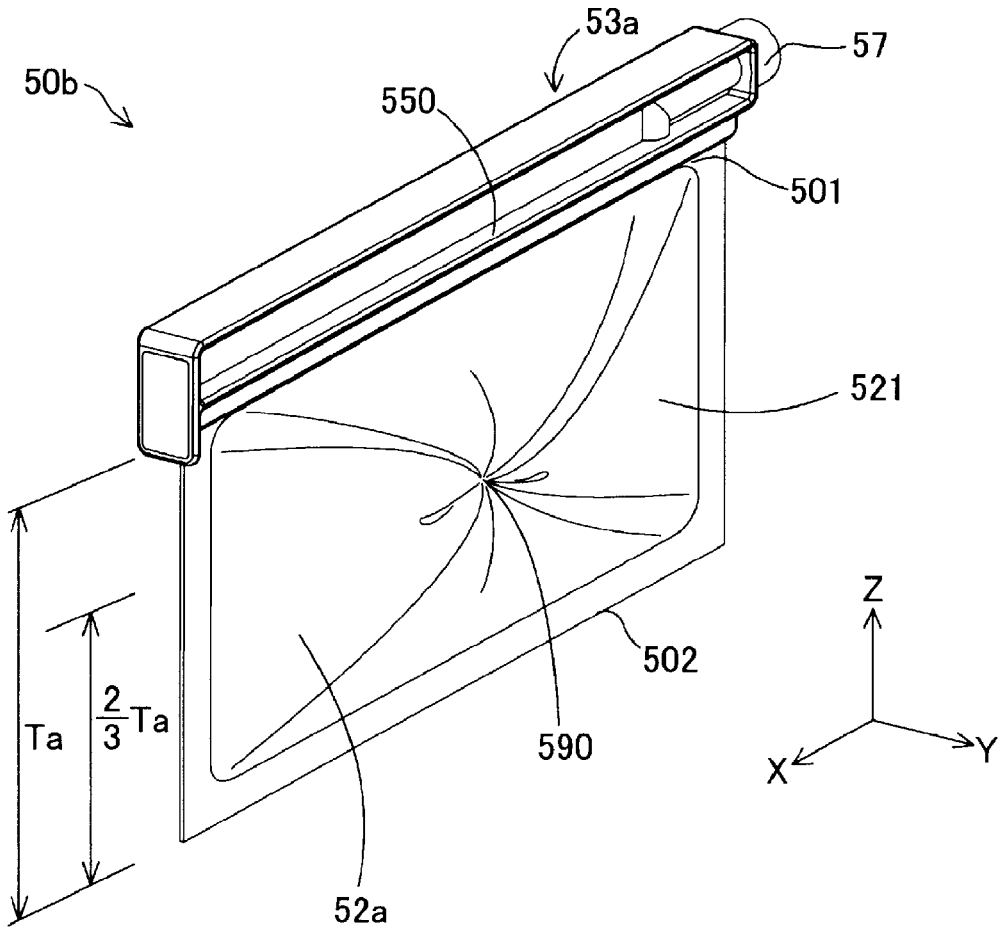
FIG. 29 is a perspective view of a liquid container according to another embodiment.
Figure 30:
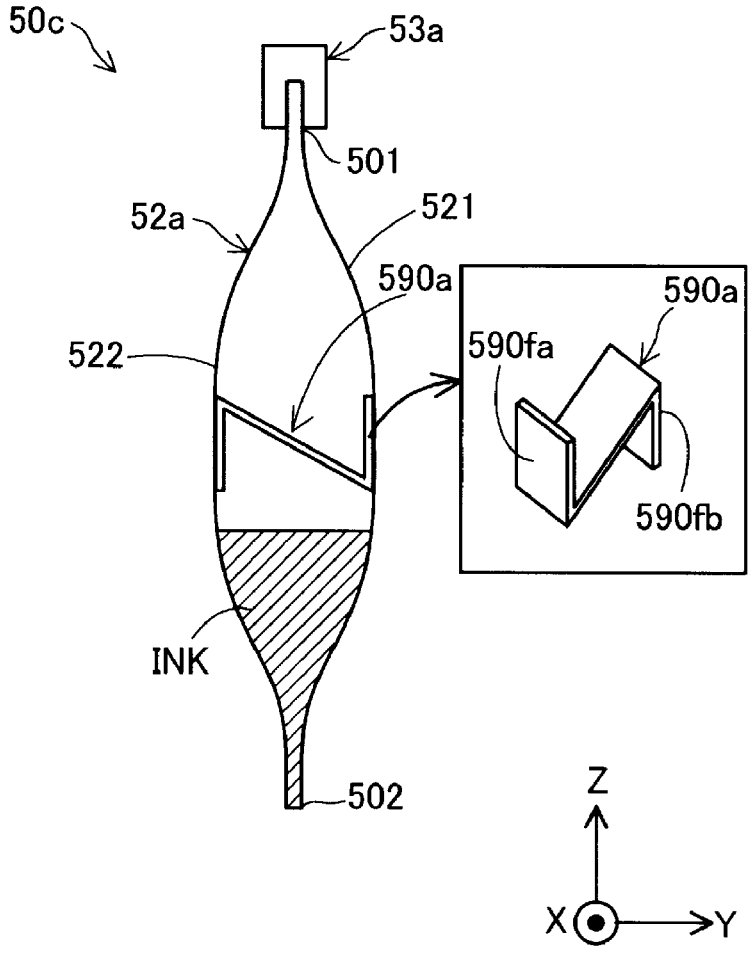
FIG. 30 is a cross-sectional view of a liquid container according to another embodiment.
Figure 31:
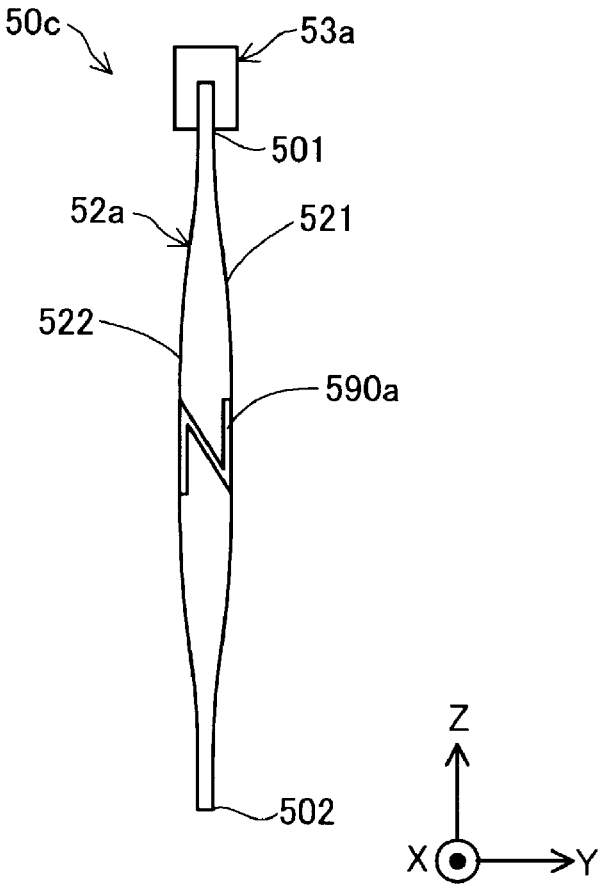
FIG. 31 is a cross-sectional view of the liquid container according to the other embodiment.
Figure 32:
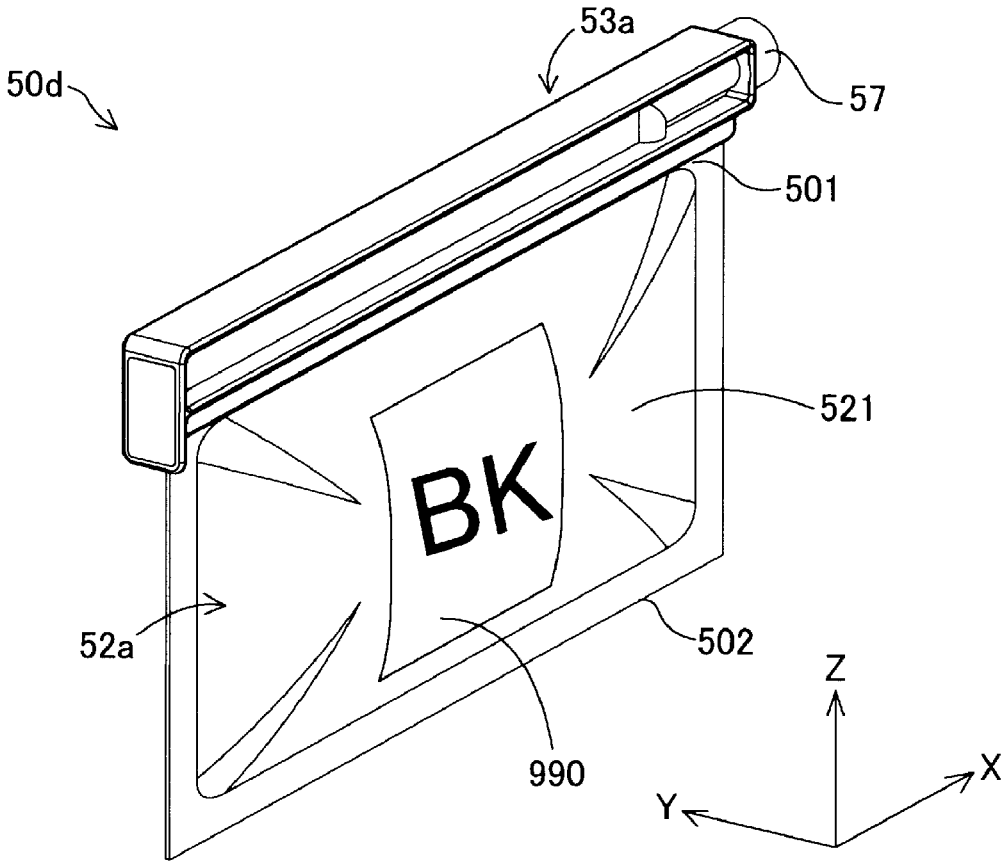
FIG. 32 is a perspective view of a liquid container according to another embodiment.

FIG. 29 is a perspective view of a liquid container 50*b* according to another embodiment. FIG. 30 is a cross-sectional view of a liquid container 50*c* according to another embodiment. FIG. 31 is a cross-sectional view of a liquid container 50*c* according to another embodiment. FIG. 32 is a perspective view of a liquid container 50*d* according to another embodiment. Although FIG. 29 to FIG. 32 illustrate further preferable modes of the liquid container 50*a* (FIG. 26) according to the second embodiment as other embodiments, they may be applied to the liquid container 50 (FIG. 11) according to the first embodiment.

As shown in FIG. 29, the liquid container 50*b* is different from the liquid container 50*a* according to the second embodiment in having a junction part 590. The junction part 590 is the part at which the respective inner surfaces of the first film 521, which is the first face, and the second film 522 (FIG. 26), which is the second face, are partially connected. Specifically, the junction part 590 is formed such that communication from the one end portion 501 to the other end portion 502 within the liquid container part 52*a* is maintained. This configuration prevents the liquid container part 52*a* filled with ink from localized large bulging in the direction (Y axis direction) in which the first film 521 and the second film 522 oppose each other. Therefore, the liquid container 50*b* can be reduced in thickness. Here, in the attached state, when the height of the liquid container part 52*a* from the level of the other end portion 502 is Ta, it is preferable that the height of the junction part 590 from the level of the other end portion 502 of the liquid container part 52*a* is no greater than Ta×(⅔), and is more preferably no greater than Ta×(½). This configuration prevents the other end portion 502 side (lower side) of the liquid container part 52*a* from greatly bulging. Also, the junction part 590 may be provided in a plurality. For example, the junction part 590 may be provided in a plurality at different heights.

Instead of directly connecting the inner surface of the first film 521 and the inner surface of the second film 522, it is possible to interpose a junction part 590*a*, which is a separate member, between the inner surface of the first film 521 and the inner surface of the second film 522, and to connect them, as shown in FIG. 30 and FIG. 31. In other words, the liquid container 50*c* includes the junction part 590*a* which locally connects the inner surface of the first film 521 and the inner surface of the second film 522. The junction part 590*a* is a leaf spring that is elastic in the direction (Y axis direction) in which the first film 521 and the second film 522 oppose each other. In a situation where the liquid container part 52*a* is filled with ink, the junction part 590*a* biases the first film 521 and the second film 522 such that the first film 521 and the second film 522 get closer to each other (such that the volume of the liquid container part 52*a* reduces). This configuration prevents the liquid container part 52*a* filled with ink from localized large bulging. Also, the junction part 590*a* may be disposed at the same position as the junction part 590 of the liquid container 50*b* shown in FIG. 29. For example, the junction part 590*a* may be located at a height within the range that is no greater than Ta×(⅔) from the other end portion 502 of the liquid container part 52*a*, or within the range that is no greater than Ta×(½).

As shown in FIG. 32, in the liquid container 50*d*, a restriction member 990 is attached on the first film 521, which is a deformable surface. The restriction member 990 is more rigid than the first film 521. In other words, the restriction member 990 is more unlikely to deform than the first film 521. The restriction member 990 is made up of, for example, synthetic resin such as polypropylene (PP) or polyethylene terephthalate (PET). The restriction member 990 is a film member (sheet member). The external shape of the restriction member 990 is substantially rectangular. The restriction member 990 is attached to a central area of the external surface of the first film 521. Here, the restriction member 990 may be disposed at the same position as the junction part 590 of the liquid container 50*b* shown in FIG. 29. For example, the restriction member 990 may be located at a height within the range that is no greater than Ta×(⅔) from the other end portion 502 of the liquid container part 52, or within the range that is no greater than Ta×(½). Also, in this embodiment, the surface of the restriction member 990 indicates the ink color. In this way, the restriction member 990 also serves as an identification part for identifying the type of the liquid container 50*d* such as the ink color. Since the liquid container 50*d* is provided with the restriction member 990 in this way, the first film 521 of the liquid container part 52 filled with ink is prevented from excessively bulging. Therefore, the liquid container 50*d* can be reduced in thickness. Note that it suffices if the restriction member 990 is provided on at least one of the first film 521 and the second film 522.

D. Another Embodiment of Operation Part 53

Figure 33:
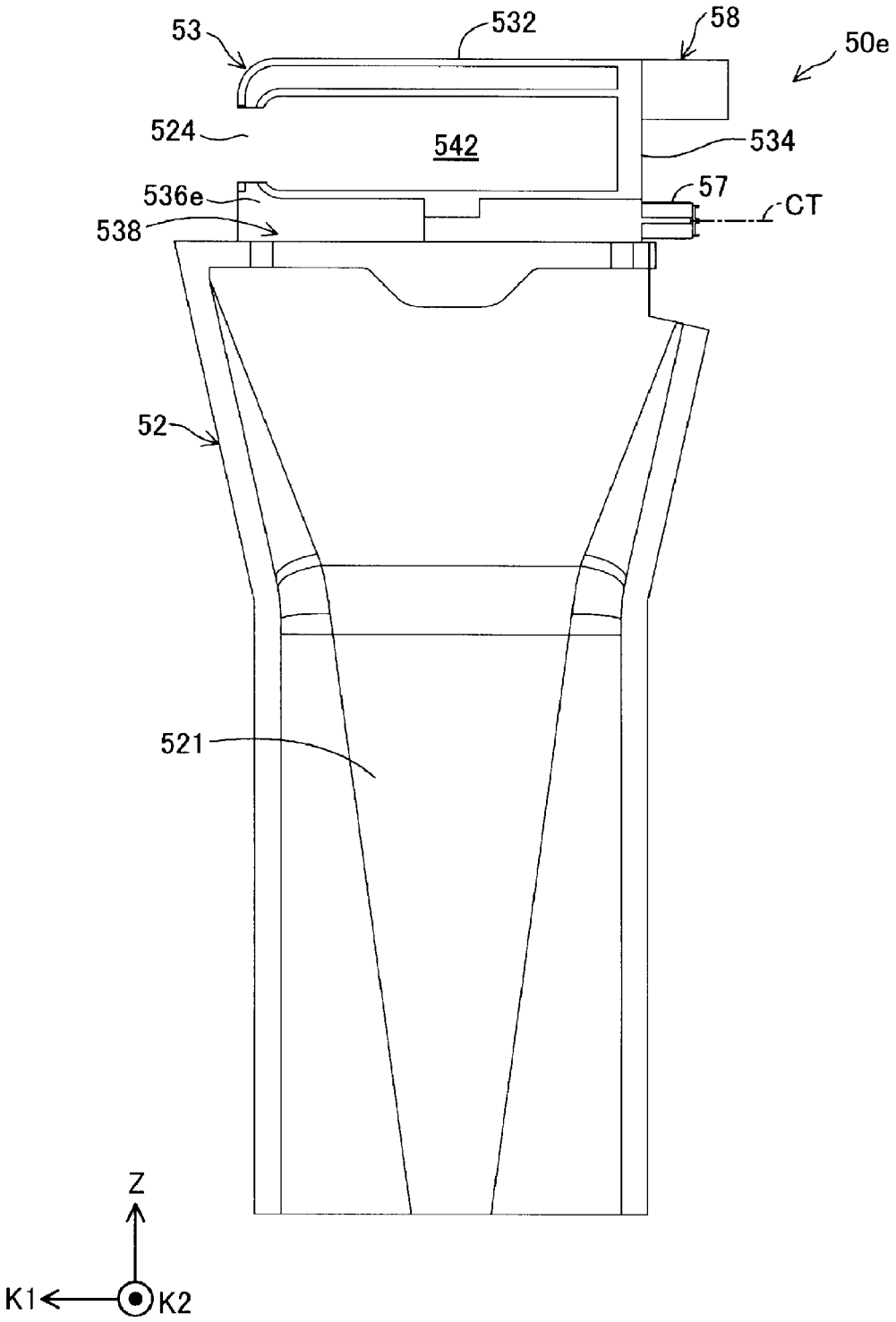
FIG. 33 is a left side view of a liquid container according to the other embodiment.

FIG. 33 is a left side view of a liquid container 50*e* according to another embodiment. FIG. 33 corresponds to FIG. 14. The liquid container 50*e* is different from the liquid container 50 (FIG. 14) in that a third side part 536*e* of the operation part 53 has an opening 524. The opening 524 is an opening that allows the user's hand to pass by the third side part 536*e* toward the second side part 534. With this configuration, when the user grips the first side part 532, the user can move their hand through the opening 524, to the position where the user can grip the first side part 532 with their hand. Therefore, the user can easily grip the first side part 532 of the operation part 53, and thus the operability of the liquid container 50*e* is improved.

E. Further Other Embodiments

Figure 34:
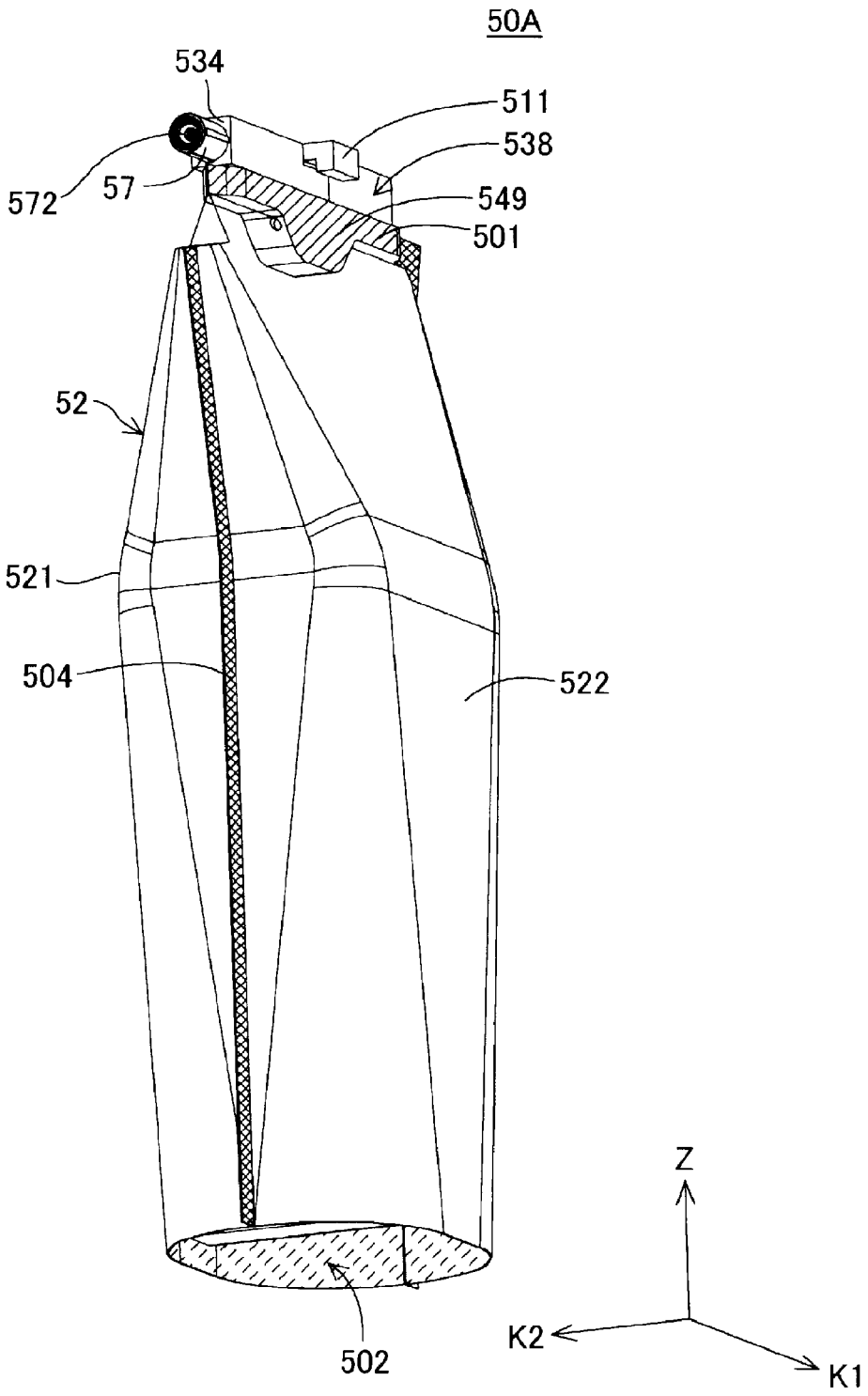
FIG. 34 is a diagram illustrating a liquid container according to another embodiment.
Figure 35:
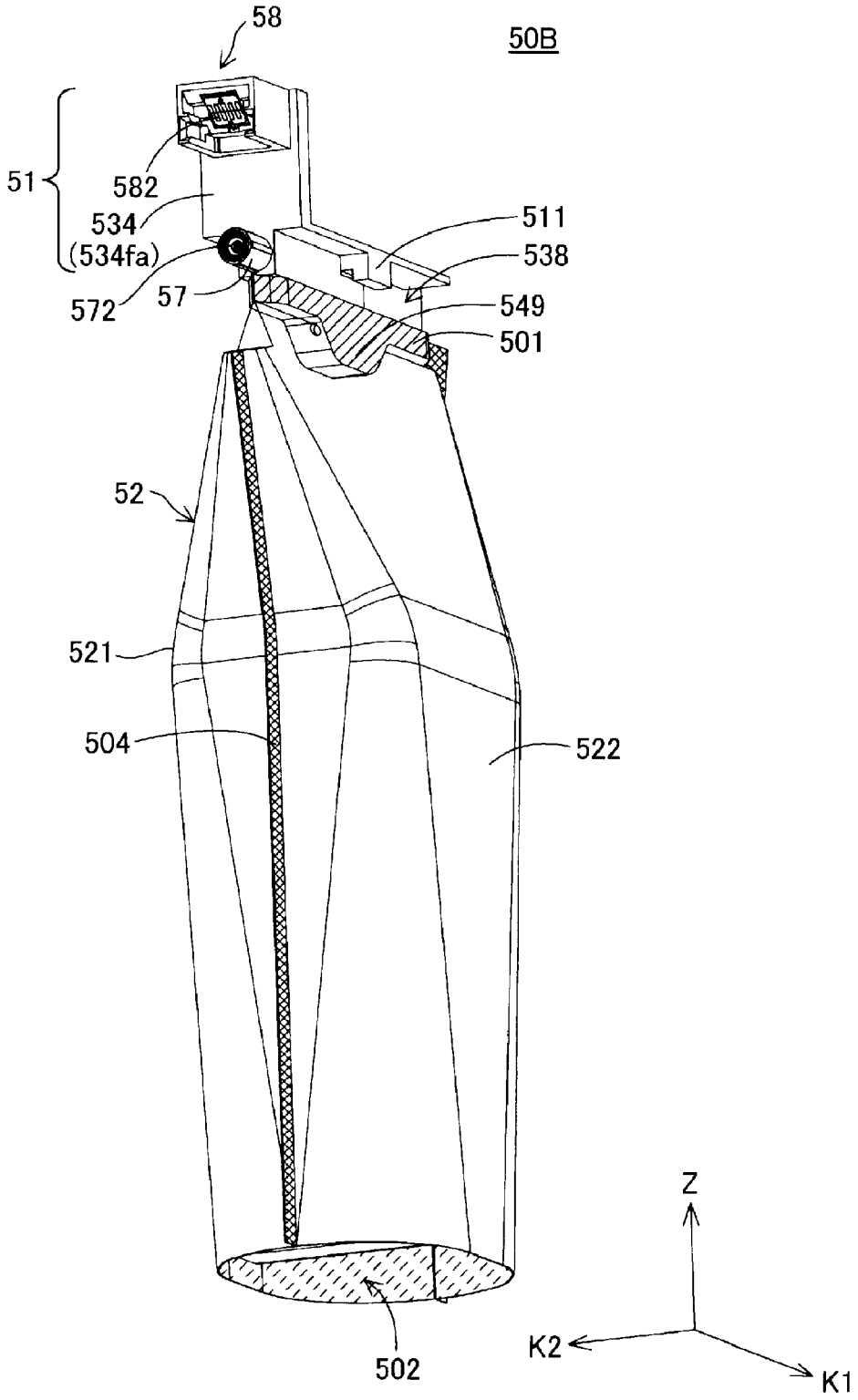
FIG. 35 is a diagram illustrating a liquid container according to another embodiment.
Figure 36:
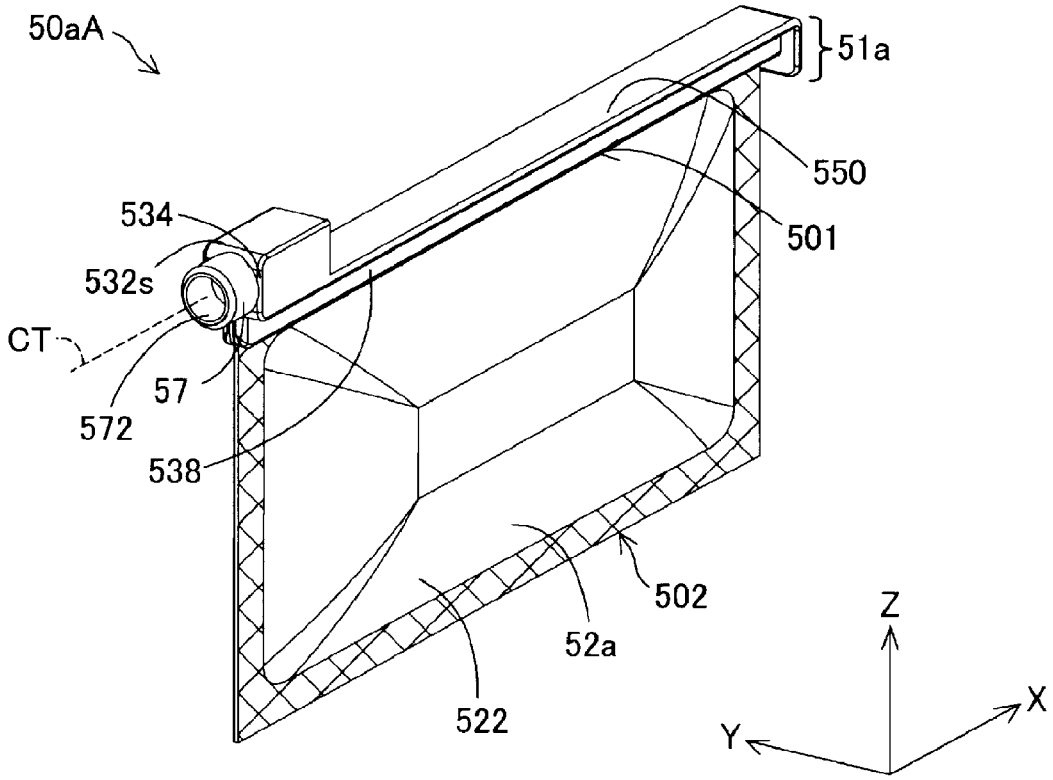
FIG. 36 is a diagram illustrating a liquid container according to another embodiment.

The following describes further other embodiments with reference to FIG. 34 to FIG. 36. FIG. 34 is a perspective view of a liquid container 50A, which is the liquid container 50 (FIG. 12) according to the first embodiment from which the first side part 532 and the substrate unit 58 have been removed. FIG. 35 is a perspective view of a liquid container 50B, which is the liquid container 50 (FIG. 12) according to the first embodiment from which the first side part 532 has been removed. FIG. 36 is a perspective view of a liquid container 50*a*A, which is the liquid container 50*a* (FIG. 26) according to the second embodiment from which the first side part 532 has been removed. As shown in FIG. 34 and FIG. 35, as with the liquid container 50 according to the first embodiment, each of the liquid container 50A and the liquid container 50B has: the liquid supply part 57 in which the liquid supply opening 572 facing toward the first direction (−K1 axis direction) which is the longitudinal direction of the one end portion 501 of the liquid container part 52; and the container-side engagement part 511 that engages with the apparatus-side engagement part 345 (FIG. 3A). This configuration, as with the first embodiment above, can reduce the space necessary for the attaching operation for attaching the liquid container 50A/50B in the direction that intersects the attaching direction in which the liquid container 50A/50B is attached to the printer 10. Also, the liquid container 50A/50B can be supported on the printer 10 by the container-side engagement part 511. Here, the printer to which the liquid container 50*a* is attached may or may not have the contact mechanism 38 (FIG. 6) as in the first embodiment.

As shown in FIG. 36, as with the liquid container 50*a* according to the second embodiment, the liquid container 50*a*A has: the liquid supply part 57 in which the liquid supply opening 572 facing toward the first direction (−K1 axis direction) which is the longitudinal direction of the one end portion 501 of the liquid container part 52*a*; and the container-side engagement part 550 that engages with the guiding part 221 (FIG. 28) serving as the apparatus-side engagement part. This configuration, as with the second embodiment above, can reduce the space necessary for the attaching operation for attaching the liquid container 50*a*A in the direction that intersects the attaching direction in which the liquid container 50*a*A is attached to the printer 10. Also, the liquid container 50*a*A can be supported on the printer 10 by the container-side engagement part 550.

Figure 37:
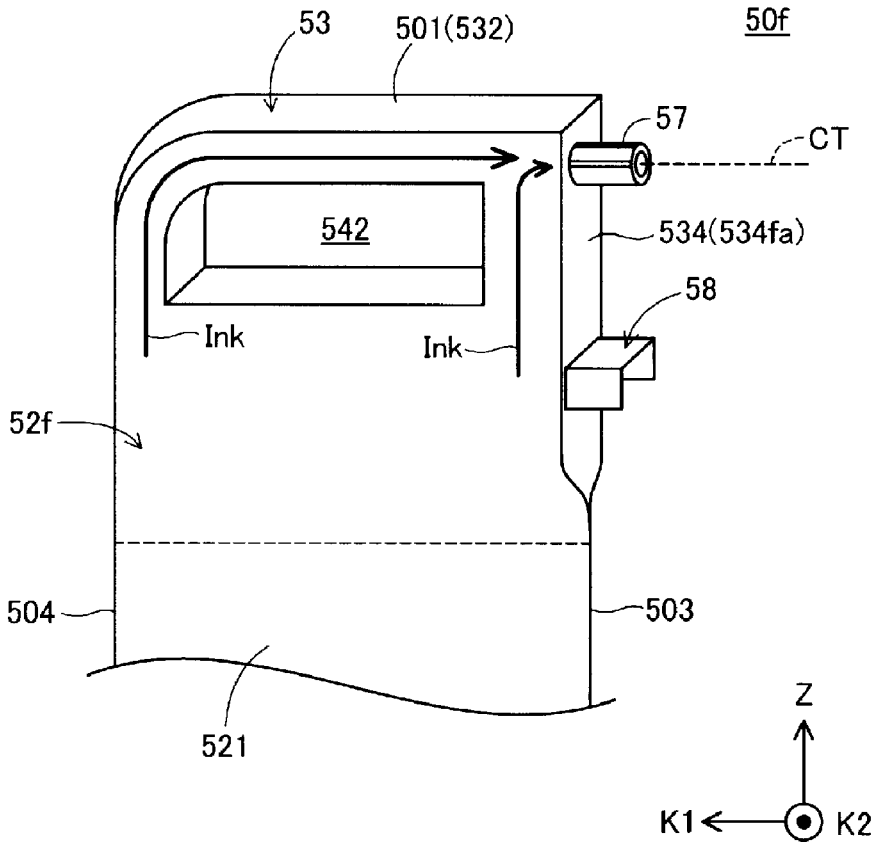
FIG. 37 is a diagram illustrating a liquid container according to another embodiment.

FIG. 37 is a diagram illustrating a liquid container 50*f* according to another embodiment. The liquid container 50*f* is different from the liquid container 50 (FIG. 11) according to the first embodiment in that the operation part 53 is configured to store ink therein and the operation part 53 is a part of the liquid container part 52, and that the liquid supply part 57 and the substrate unit 58 are arranged in reverse order in the Z axis direction. With respect to other configurations, the liquid container 50*f* has the same configuration as the liquid container 50 according to the first embodiment. The liquid container part 52*f* including the operation part 53 is formed by fusing a plurality of films to each other. Also, a sheet member that is more rigid than the film may be attached to the surface of the film on the liquid container part 52*f* above the dotted line shown in FIG. 37. This configuration suppresses the change in shape of the operation part 53 when the operation part 53 is gripped. The ink in the liquid container part 52 passes through a liquid flow channel (which is a flow channel that is a part of the liquid container part 52) inside the operation part 53, and reaches the liquid supply part 57. The liquid supply part 57 and the substrate unit 58 are supported on the second side part 534. In the attached state, the liquid supply part 57 is located above the substrate unit 58. Therefore, in the printer to which the liquid container 50*f* is attached, the contact mechanism 38 (FIG. 6) and the liquid introduction mechanism 36 are arranged in reverse order in the vertical direction. The liquid supply part 57 and the first side part 532 are arranged side-by-side in the first direction (−K1 axis direction). The above-described embodiment achieves the same advantageous effects as the first embodiment above, resulting from the same configuration. For example, since the liquid container 50*f* has the first side part 532 as the grip part, the user can easily move the operation part 53 by gripping the first side part 532. Also, since the operation part 53 having the first side part 532 is connected to the liquid container part 52, the user can connect the liquid supply part 57 to the liquid introduction part 362 by moving the operation part 53. Also, since the liquid supply opening 572 faces toward the first direction (−K1 axis direction), which coincides with the longitudinal direction (K1 axis direction) of the one end portion 501 of the liquid container part 52*f*, this configuration can reduce the space necessary for the attaching operation for attaching the liquid container 50*f* in the direction (K2 axis direction) that intersects the attaching direction in which the liquid container 50*f* is attached to the printer 10.

F. Modified Examples

Note that the invention is not limited to the above-described implementation examples or embodiments, and may be carried out in various other ways without departing from the spirit of the invention, and the following modifications are also possible.

F-1. First Modified Example

Figure 38:
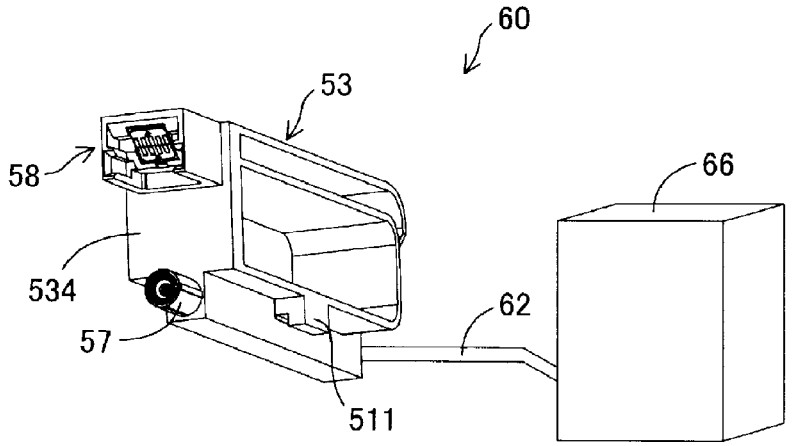
FIG. 38 is a diagram illustrating an electrical connector.

In the embodiments above, the liquid containers 50 to 50*e* have the liquid container part 52. However, the liquid container part 52 may be omitted, and an electrical connector 60 may be provided instead. FIG. 38 is a diagram showing the liquid container 50 (FIG. 12) according to the first embodiment in which the liquid container part 52 is omitted and the electrical connector 60 is provided instead. In the electrical connector 60, ink is provided from a tank 66, which is located outside, to the liquid supply part 57 via a liquid distribution tube 62 and the internal flow channel of the operation part 53. Note that the tank 66 may have an inlet (not shown in the drawing) used for injecting a liquid in the tank 66, and may have an air communication channel (not shown in the drawing) through which the inside and outside of the tank are in communication. Furthermore, the tank 66 may be located inside the liquid container casings 20. The second side part 534 of the liquid container 50*a* (FIG. 26) according to the second embodiment may have the substrate unit 58 (FIG. 34), which serves as a connector-side electrical connection part. Also, when the liquid container 50*a* according to the second embodiment is provided with the substrate unit 58, the liquid container part 52*a* may be omitted so that the function of the electrical connector can be achieved. In this way, due to the electrical connector 60, the user can easily operate the operation part 53 by gripping the first side part 532 of the operation part 53. Also, the operation part 53 may be omitted, and instead, an engagement part (connector-side engagement part) 511, which engages with the apparatus-side engagement part 345 (FIG. 6) of the liquid consumption apparatus 10, or a rail-like engagement part (connector side engagement part) 550 (FIG. 36), which engages with the guiding part 221 shown in FIG. 28, may be provided. In other words, the electrical connector that is to be connected to the liquid introduction part 362 of the liquid consumption apparatus may have the following configuration. The electrical connector includes: a liquid supply part 57 that is to be connected to the liquid introduction part 362; an engagement part 511, 550 that is connected to the liquid supply part 57 and that is configured to engage with an apparatus-side engagement part 345, 221 provided in the liquid consumption apparatus 10, 10*a*; and a substrate unit (electrical connection part) having a contact part (cp) that is to be connected to the liquid supply part 57, that is disposed so as to at least partially overlap the liquid supply part 57 in a vertical direction when the liquid supply part 57 is connected to the liquid introduction part 362, and that is configured to be able to be brought into contact with an apparatus-side electrical connection part 381 that is provided in the liquid consumption apparatus 10, 10*a*. A liquid container tank 66 may be connected to the liquid supply part 57 via the liquid distribution tube 62. The above-described electrical connector has, for example, the configuration of the liquid container 50B shown in FIG. 35 from which the liquid container part 52 is omitted. Also, the liquid supply part 57 of the electrical connector 60*a* may be omitted, and instead, the one end portion of the liquid distribution tube 62 may be connected directly to the liquid introduction part 362.

F-2. Second Modified Example

Figure 39:
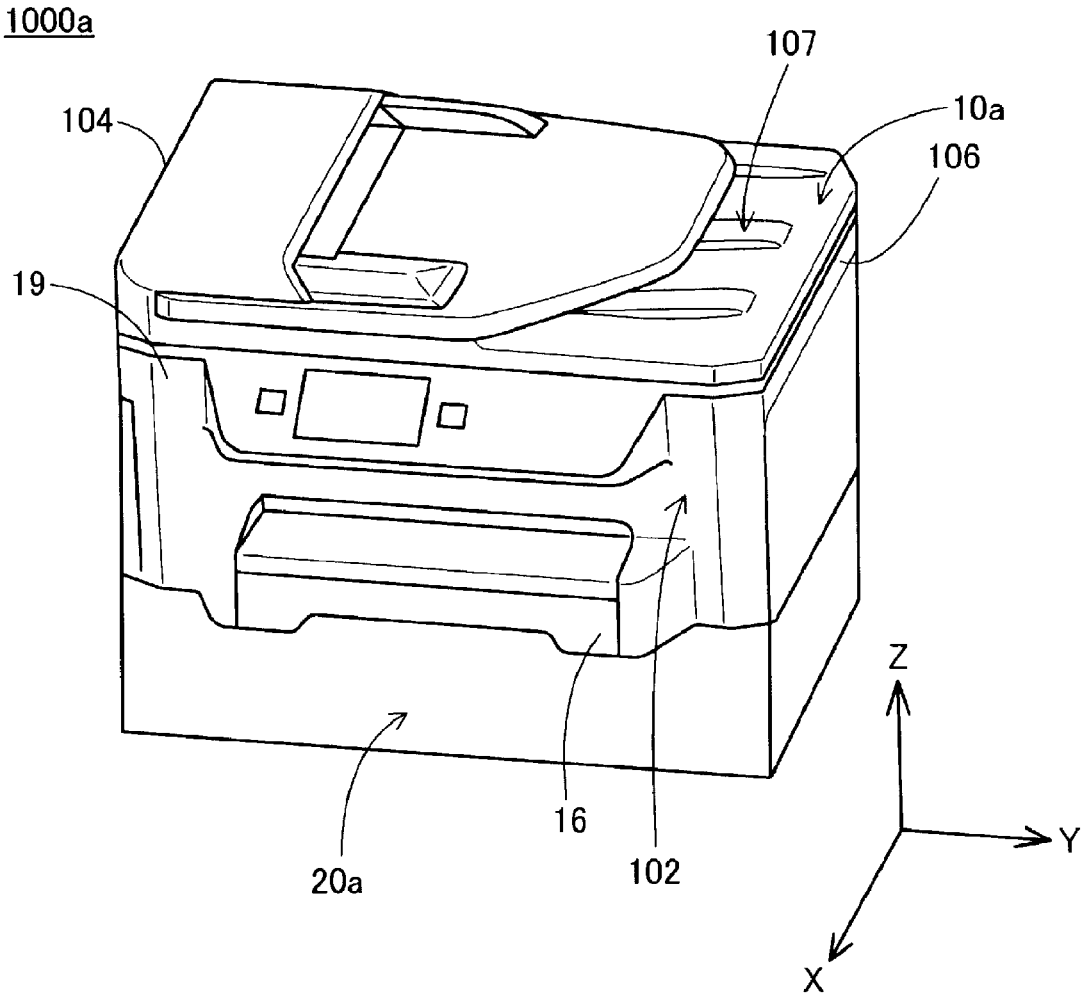
FIG. 39 is a diagram illustrating a second modification example.

FIG. 39 is a diagram illustrating a second modification example. In the above-described embodiments, the liquid container casings 20 and 20*a* are provided on the left side face 104 and the right side face 106 of the housing 19. However, the positions where they are provided are not limited to the above, and they may be provided on only one of the left side face 104 and the right side face 106, or provided on another face. For example, as shown in FIG. 39, in the second embodiment, the liquid container casing 20*a* may be provided below the housing 19. To the liquid container casing 20*a* provided below the housing 19, four liquid containers 50 respectively storing black, cyan, magenta, and yellow inks can be detachably attached. Also, the liquid container casings 20*a* may be provided above the housing 19. The liquid container casing 20 may be formed integrally with the housing 19 of the printer 10, or formed as a separate piece. Furthermore, within the liquid container casing 20, the set of the liquid introduction part 362 and the apparatus-side electrical connection parts 381 (the connection unit) may be provided in a plurality, and the plurality of sets may be arranged along the vertical direction, or arranged in a staggered manner in the vertical direction.

F-3. Third Modified Example

In the above-described embodiments, the contact parts cp are disposed on the front surface 582*fa* of the circuit substrate 582. However, it suffices if the contact parts cp are provided so as to be able to be brought into electrical contact with the apparatus-side electrical connection parts 381. For example, the circuit substrate 582 may not have the storage device 583. Also, for example, the contact parts cp may be provided with a contact part, which is a terminal used for detecting that the liquid containers 50 are attached/detached. Also, the contact parts cp may be provided on a circuit substrate such as a flexible printed substrate (FPC) that includes a flexible cable. This circuit substrate has contact parts cp on one end thereof, which can be brought into contact with the apparatus-side electrical connection parts 381. The other end is connected to a resetting apparatus, for example. Also, the contact parts cp are not necessarily formed on a flat surface, and may be formed on a curved surface.

F-4. Fourth Modified Example

In the above-described first embodiment, the first liquid container casing 20A may also have the same configuration as the second liquid container casings 20B. For example, when the printer 10 is seen from vertically above, in the attached state of the liquid container 50, the angle a2 formed between the longitudinal direction of the first side part 532 and the left side face 104 in the counterclockwise direction from the left side face 104 may be equal to or greater than 0 degrees and less than 90 degrees, and the connecting direction of the liquid container 50 may have forward and backward (X axis direction) components. This configuration prevents the liquid consumption system 1000 from increasing in size in the lateral direction. Also, when the liquid container 50 is attached to the liquid consumption apparatus 10, the operation space for the liquid container in the lateral direction can be reduced. Note that in the second embodiment, the angles a1 and a2 of the first liquid container casings 20Aa and the second liquid container casings 20Ba are both 0 degrees.

F-5. Fifth Modified Example

In the embodiments above, as shown in FIG. 14 for example, the longitudinal direction of the first side part 532 is parallel with the longitudinal direction of the one end portion 501 of the liquid container part 52. However, this configuration is not essential, and the first side part 532 suffices if it has a grippable shape. For example, the first side part 532 may be a rod-like member that extends in the vertical direction in the attached state, or have a shape that is bent in the middle.

F-6. Sixth Modified Example

The invention may be realized in other modes shown below.

Another Mode 1

A liquid container that is to be attached to a liquid consumption apparatus and that supplies a liquid to the liquid consumption apparatus, comprising:

a liquid container part that is at least partially flexible and that stores the liquid;

a liquid supply part that has a central axis extending along a straight line, and that a liquid introduction part of the liquid consumption apparatus is to be connected to; and an operation part connected to the liquid container part, wherein the operation part includes:

a first side part that is grippable, and that extends in a direction that is parallel with a direction in which the central axis extends; and a second side part that intersects the first side part and that supports the liquid supply part.

Another Mode 2

The liquid container according to the above-described other mode, wherein the liquid container part has one end portion that is located vertically above in an attached state in which the liquid container is attached to the liquid consumption apparatus, and the operation part is located on the side of the one end portion of the liquid container part.

Another Mode 3

The liquid container according to the above-described other mode, wherein the operation part further includes:

a color identification part for identifying a color of the liquid stored in the liquid container part.

Another Mode 4

The liquid container according to the above-described other mode, wherein the operation part further includes a third side part that extends from the first side part in a direction intersecting a direction in which the central axis extends, and that opposes the second side part, and the third side part has an opening that allows a user's hand to move therethrough toward the second side part.

Another Mode 5

The liquid container according to the above-described other mode, wherein the liquid introduction part may be disposed on the side of a left side face of the liquid consumption apparatus when the liquid consumption apparatus is seen from a front face thereof, and when the liquid consumption apparatus is seen from vertically above, in an attached state in which the liquid container is attached to the liquid consumption apparatus, an angle formed by the longitudinal direction of the first side part and the left side face, in a clockwise direction from the left side face, is equal to or greater than 0 degrees and less than 90 degrees, and a direction in which the liquid supply part is connected to the liquid introduction part is a direction having forward and backward components, in which the front face and a back face of the liquid consumption apparatus oppose each other.

Another Mode 6

The liquid container according to the above-described other mode, wherein the liquid introduction part is located on the side of a right side face of the liquid consumption apparatus when the liquid consumption apparatus is seen from a front face thereof, and when the liquid consumption apparatus is seen from vertically above, in an attached state in which the liquid container is attached to the liquid consumption apparatus, an angle formed between the longitudinal direction of the grip part and the right side face, in a counterclockwise direction from the right side face, is equal to or greater than 0 degrees and less than 90 degrees, and a direction in which the liquid supply part is connected to the liquid introduction part is a direction having forward and backward components, in which the front face and a back face of the liquid consumption apparatus oppose each other.

Another Mode 7

The liquid container according to the above-described other mode, further comprising a container-side engagement part that is configured to be able to engage with an apparatus-side engagement part that is disposed on the liquid consumption apparatus so as to be able to support the liquid container.

Another Mode 8

The liquid container according to the above-described other mode, wherein the container-side engagement part is disposed along a direction that is parallel with a direction in which the central axis extends.

Another Mode 9

The liquid container according to the above-described other mode, further comprising a container-side electrical connection part having a contact part that is configured to be able to be brought into contact with an apparatus-side electrical connection part that is provided in the liquid consumption apparatus.

Another Mode 10

The liquid container according to the above-described other mode, further comprising a container-side electrical connection part having a contact part that is configured to be able to be brought into contact with an apparatus-side electrical connection part that is provided in the liquid consumption apparatus, the container-side electrical connection part being supported by the operation part.

Another Mode 11

The liquid container according to the above-described other mode, wherein, in an attached state in which the liquid container is attached to the liquid consumption apparatus, a longitudinal direction of the first side part extends in a direction that intersects a vertical direction, and when the operation part is projected onto a plane that is perpendicular to the longitudinal direction of the first side part, the liquid supply part and the contact part are arranged side-by-side in the vertical direction.

Another Mode 12

The liquid container according to the above-described other mode, wherein the contact part is disposed on an inclined surface that is inclined with respect to the first direction.

Another Mode 13

The liquid container according to the above-described other mode, wherein the contact part is provided in a plurality, and a plane defined by the plurality of contact parts is inclined with respect to a connecting direction of the liquid container, the connecting direction being a direction in which the plurality of contact parts are connected to the apparatus-side electrical connection part.

Another Mode 14

The liquid container according to the above-described other mode, wherein the contact part is provided in a plurality, and the plurality of contact parts are arranged along a direction that intersects a direction in which the central axis extends.

Another Mode 15

The liquid container according to the above-described other mode, further comprising a container-side electrical connection part having a contact part that is configured to be able to be brought into contact with an apparatus-side electrical connection part that is provided in the liquid consumption apparatus, wherein at least one of the liquid supply part and the container-side electrical connection part, and the first side part, are arranged side-by-side in a direction that is parallel with a direction in which the central axis extends.

Another Mode 16

The liquid container according to the above-described other mode, wherein the container-side electrical connection part further includes a contact part-side positioning part that determines a position of the contact part with respect to the apparatus-side electrical connection part when the contact part is brought into contact with the apparatus-side electrical connection part.

Another Mode 17

The liquid container according to the above-described other mode, wherein, in an attached state in which the liquid container is attached to the liquid consumption apparatus, the liquid supply part is located at a higher level than the liquid container part.

Another Mode 18

The liquid container according to the above-described other mode, further comprising a communication flow channel that allows for communication between the liquid supply part and the liquid container part, and that intersects the one end portion.

Another Mode 19

The liquid container according to the above-described other mode, wherein the liquid supply part includes:

a liquid supply opening formed on one end; and a supply opening positioning part that determines a position of the liquid supply opening with respect to the liquid introduction part when the liquid supply opening is connected to the liquid introduction part.

Another Mode 20

The liquid container according to the above-described other mode, wherein the liquid container part includes:

a first face and a second face that oppose each other in a direction that is perpendicular to a direction in which the central axis extends, and that are flexible; and a junction part that partially connects respective inner surfaces of the first face and the second face.

Another Mode 21

The liquid container according to the above-described other mode, further comprising a restriction member that is attached to a flexible deformable face from among faces constituting the liquid container part, and that is more rigid than the deformable face.

F-7. Seventh Modified Example

The invention may be realized in further other modes shown below.

Yet Another Mode 1

A liquid container that supplies a liquid to a liquid consumption apparatus via a liquid introduction part disposed in the liquid consumption apparatus, comprising:

a liquid supply part that is to be connected to the liquid introduction part;

a liquid container part that is at least partially flexible, and that has one end portion extending in a direction that is parallel with a connecting direction in which the liquid supply part is connected to the liquid introduction part in a state in which the liquid container is attached to the liquid consumption apparatus; and an operation part connected to the liquid container part, wherein the operation part includes:

a first side part that is grippable; and a second side part that extends from one end portion of the first side part of the operation part in a longitudinal direction of the one end portion of the liquid container part, the second side part extending in a direction that intersects the longitudinal direction, and the liquid supply part is supported by the second side part.

Yet Another Mode 2

The liquid container according to the above-described yet another mode, wherein the operation part is located on the side of the one end portion of the liquid container part.

Yet Another Mode 3

The liquid container according to the above-described yet another mode, wherein the first side part is disposed such that a longitudinal direction of the first side part is parallel with the longitudinal direction of the one end portion.

Yet Another Mode 4

The liquid container according to the above-described yet another mode, wherein the operation part further includes a color identification part for identifying a color of the liquid stored in the liquid container part.

Yet Another Mode 5

The liquid container according to the above-described yet another mode, wherein the operation part further includes a third side part that extends from the first side part in a direction intersecting the longitudinal direction of the one end portion, and that opposes the second side part, and the third side part has an opening that allows a user's hand to move therethrough toward the second side part.

Yet Another Mode 6

The liquid container according to the above-described yet another mode, wherein the liquid introduction part is located on the side of a left side face of the liquid consumption apparatus when the liquid consumption apparatus is seen from a front face thereof, and when the liquid consumption apparatus is seen from vertically above, in an attached state in which the liquid container is attached to the liquid consumption apparatus, an angle formed by the longitudinal direction of the first side part and the left side face, in a clockwise direction from the left side face, is equal to or greater than 0 degrees and less than 90 degrees, and a direction in which the liquid supply part is connected to the liquid introduction part is a direction having forward and backward components, in which the front face and a back face of the liquid consumption apparatus oppose each other.

Yet Another Mode 7

The liquid container according to the above-described yet another mode, wherein the liquid introduction part is located on the side of a right side face of the liquid consumption apparatus when the liquid consumption apparatus is seen from a front face thereof, and when the liquid consumption apparatus is seen from vertically above, in an attached state in which the liquid container is attached to the liquid consumption apparatus, an angle formed between the longitudinal direction of the first side part and the right side face, in a counterclockwise direction from the right side face, is equal to or greater than 0 degrees and less than 90 degrees, and a direction in which the liquid supply part is connected to the liquid introduction part is a direction having forward and backward components, in which the front face and a back face of the liquid consumption apparatus oppose each other.

Yet Another Mode 8

The liquid container according to the above-described yet another mode, further comprising a container-side engagement part that is configured to be able to engage with an apparatus-side engagement part that is disposed on the liquid consumption apparatus so as to be able to support the liquid container.

Yet Another Mode 9

The liquid container according to the above-described yet another mode, wherein the container-side engagement part is disposed along a direction that is parallel with the longitudinal direction of the one end portion.

Yet Another Mode 10

The liquid container according to the above-described yet another mode, further comprising a container-side electrical connection part having a contact part that is configured to be able to be brought into contact with an apparatus-side electrical connection part that is provided in the liquid consumption apparatus.

Yet Another Mode 11

The liquid container according to the above-described yet another mode, further comprising a container-side electrical connection part having a contact part that is configured to be able to be brought into contact with an apparatus-side electrical connection part that is provided in the liquid consumption apparatus, the container-side electrical connection part being supported by the operation part.

Yet Another Mode 12

The liquid container according to the above-described yet another mode, wherein, in an attached state in which the liquid container is attached to the liquid consumption apparatus, a longitudinal direction of the first side part extends in a direction that intersects a vertical direction, and when the operation part is projected onto a plane that is perpendicular to the longitudinal direction of the first side part, the liquid supply part and the contact part are arranged side-by-side in the vertical direction.

Yet Another Mode 13

The liquid container according to the above-described yet another mode, wherein the contact part is disposed on an inclined surface that is inclined with respect to the connecting direction.

Yet Another Mode 14

The liquid container according to the above-described yet another mode, wherein the contact part is provided in a plurality, and a plane defined by the plurality of contact parts is inclined with respect to a connecting direction of the liquid container, the connecting direction being a direction in which the plurality of contact parts are connected to the apparatus-side electrical connection part.

Yet Another Mode 15

The liquid container according to the above-described yet another mode, wherein the contact part is provided in a plurality, and the plurality of contact parts are arranged along a direction that intersects the connecting direction.

Yet Another Mode 16

The liquid container according to the above-described yet another mode, further comprising a container-side electrical connection part having a contact part that is configured to be able to be brought into contact with an apparatus-side electrical connection part that is provided in the liquid consumption apparatus, wherein at least one of the liquid supply part and the container-side electrical connection part, and the first side part, are arranged side-by-side in the connecting direction.

Yet Another Mode 17

The liquid container according to the above-described yet another mode, wherein the container-side electrical connection part further includes a contact part-side positioning part that determines a position of the contact part with respect to the apparatus-side electrical connection part when the contact part is brought into contact with the apparatus-side electrical connection part.

Yet Another Mode 18

The liquid container according to the above-described yet another mode, wherein, in an attached state in which the liquid container is attached to the liquid consumption apparatus, the liquid supply part is located at a higher level than the liquid container part.

Yet Another Mode 19

The liquid container according to the above-described yet another mode, further comprising a communication flow channel that allows for communication between the liquid supply part and the liquid container part, and that intersects the one end portion.

Yet Another Mode 20

The liquid container according to the above-described yet another mode, wherein the liquid supply part includes:

a liquid supply opening formed on one end; and a supply opening positioning part that determines a position of the liquid supply opening with respect to the liquid introduction part when the liquid supply opening is connected to the liquid introduction part.

Yet Another Mode 21

The liquid container according to the above-described yet another mode, wherein the liquid container part includes:

a first face and a second face that oppose each other in a direction that is perpendicular to the longitudinal direction of the one end portion, and that are flexible; and a junction part that partially connects respective inner surfaces of the first face and the second face.

Yet Another Mode 22

The liquid container according to the above-described yet another mode, further comprising a restriction member that is attached to a flexible deformable face from among faces constituting the liquid container part, and that is more rigid than the deformable face.

F-8. Eighth Modified Example

In the above-described first embodiment, as shown in FIG. 10, the container-side engagement part 511 has the shape of a protrusion, and the apparatus-side engagement part 345 has the shape of a depression. However, the container-side engagement part 511 and the apparatus-side engagement part 345 may have other shapes as long as they can engage with each other. For example, the container-side engagement part 511 may have the shape of a depression, and the apparatus-side engagement part 345 may have the shape of a protrusion. Also, in the above-described second embodiment, as shown in FIG. 28, the container-side engagement part 550 is a plate-like member that protrudes outward from the base part 538, and the guiding part 221, which is the apparatus-side engagement part, is a horizontal plate surface that protrudes from a wall from which the liquid container casings 20*a* is formed. However, the container-side engagement part 550 and the guiding part 221 may have other shapes as long as they can engage with each other. For example, it is acceptable that one of the container-side engagement part 550 and the apparatus-side engagement part 221 has the shape of a depression and the other has the shape of a protrusion that fits into the depression.

F-9. Ninth Modified Example

In the above-described embodiments, as shown in FIG. 17 and FIG. 18 for example, the plane defined by the plurality of contact parts cp is an inclined plane that faces obliquely downward. However, the plurality of contact parts cp may be arranged such that the plane is an inclined plane that faces obliquely upward. Also, the apparatus-side electrical connection parts 381 (FIG. 6) may face obliquely downward.

F-10. Tenth Modified Example

The invention is not limited to inkjet printers and liquid containers used for them, and is also applicable to a given liquid consumption apparatus that ejects a liquid other than ink, and a liquid container casing in which liquid containers that store such a liquid are arranged. For example, the invention is applicable to the following various types of liquid consumption apparatuses and liquid container casings. Also, the liquid container casings in the embodiments are applicable to various types of liquid ejection apparatuses shown below that eject liquid onto a medium, instead of to a liquid consumption apparatus that records images or the like by ejecting liquid onto a recording medium.

(1) Image recording apparatuses such as facsimile apparatuses (2) Color material ejection recording apparatuses used in the manufacturing of a color filter for use in an image display device such as a liquid crystal display (3) Electrode material ejection apparatuses used in electrode formation for an organic electroluminescence (EL) display, a field emission display (FED), or the like (4) Liquid ejection apparatuses for ejecting a liquid that contains bioorganic material used in biochip manufacturing (5) Specimen ejection apparatuses for use as a precise pipette (6) Lubricating oil ejection apparatuses (7) Resin liquid ejection apparatuses (8) Liquid ejection apparatuses for the pinpoint ejection of lubricating oil in a precision machine such as a clock or camera (9) Liquid ejection apparatuses for ejecting a transparent resin liquid such as an ultraviolet curable resin liquid on a substrate in order to form, for example, microscopic semi-spherical lenses (optical lenses) for use in an optical communication element or the like

(10) Liquid ejection apparatuses for ejecting an acidic or alkaline etching liquid for etching a substrate or the like

(11) Liquid ejection apparatuses that include a liquid ejection head for discharging any other microscopic droplets Note that "droplet" refers to the state of a liquid discharged from a liquid consumption apparatus or a liquid ejection apparatus, and encompasses granular, tear-drop, and trailing string-shaped droplets. Also, the "liquid" referred to here need only be a material that can be ejected from the liquid consumption apparatus or the liquid ejection apparatus. For example, "liquid" need only be a material whose substance is in the liquid phase, and the "liquid" here encompasses high or low viscosity liquid materials, as well as liquid materials such as sols, gel water, other inorganic solvents, organic solvents, solutions, liquid resins, and liquid metals (metal melts). Also, the liquid is not limited to being a liquid as one state of materials, and the "liquid" here encompasses a substance in which functional material particles made of a solid substance such as pigment or metal particles, which are examples of precipitates, are dissolved, dispersed, or mixed in a solvent. Other representative examples of liquids include liquid crystal and ink such as that described in the above embodiments. Here, "ink" encompasses general water-based ink and oil-based ink, as well as various types of liquid compositions such as gel ink and hot-melt ink. Also, when UV ink that can be cured by ultraviolet irradiation is stored in the liquid container part connected to the printer, the liquid container bags float above the mounting surface, and the possibility that the heat of the mounting surface is conducted to the liquid container part and cures the UV ink is reduced.

What is claimed is:

1. A liquid container that supplies a liquid to a liquid consumption apparatus via a liquid introduction part disposed in the liquid consumption apparatus, the liquid container comprising:

a liquid container part that stores the liquid having a top side portion located at the top of the liquid container part when oriented in an attached state as connected to the liquid introduction part, the top side portion having a first end and a second end and defining a first direction extending in a longitudinal direction from the first end to the second end, the first direction being the direction of attaching the liquid container to the liquid introduction part;

an operation part connected to the liquid container part and located on the top side portion, the operation part having a grip part that is grippable and having a liquid supply part in fluid communication with an inside of the liquid container part, the liquid supply part located at the first direction facing end of the operation part, the liquid supply part having a liquid supply opening facing in the first direction and configured to connect with the liquid introduction part;

a container-side electrical connection part configured to be brought into electrical contact with an apparatus-side electrical connection part on the liquid consumption apparatus, the container-side electrical connection part supported by the first direction facing end of the operation part and the liquid supply part and the container-side electrical connection part at east partially overlap in the downward direction perpendicular to the first direction.

2. The liquid container according to claim 1, wherein the operation part is located along a majority of the top side portion of the liquid container part.

3. The liquid container according to claim 1, wherein the liquid supply part is located near the second end of the top side portion.

4. The liquid container according to claim 1, wherein the grip part is disposed such that a longitudinal direction of the grip part is parallel with the first direction.

5. The liquid container according to claim 4, wherein the liquid introduction part is located on the side of a left side face of the liquid consumption apparatus when the liquid consumption apparatus is seen from a front face thereof, and when the liquid consumption apparatus is seen from vertically above, in an attached state in which the liquid container is attached to the liquid consumption apparatus, an angle formed between the longitudinal direction of the grip part and the left side face, in a clockwise direction from the left side face, is equal to or greater than 0 degrees and less than 90 degrees, and a direction in which the liquid supply part is connected to the liquid introduction part is a direction having forward and backward components, in which the front face and a back face of the liquid consumption apparatus oppose each other.

6. The liquid container according to claim 4, wherein the liquid introduction part is located on the side of a right side face of the liquid consumption apparatus when the liquid consumption apparatus is seen from a front face thereof, and when the liquid consumption apparatus is seen from vertically above, in an attached state in which the liquid container is attached to the liquid consumption apparatus, an angle formed between the longitudinal direction of the grip part and the right side face, in a counter-clockwise direction from the right side face, is equal to or greater than 0 degrees and less than 90 degrees, and a direction in which the liquid supply part is connected to the liquid introduction part is a direction having forward and backward components, in which the front face and a back face of the liquid consumption apparatus oppose each other.

7. The liquid container according to claim 1,
wherein the operation part further includes
a color identification part for identifying a color of the liquid stored in the liquid container part.

8. The liquid container according to claim 1,
wherein the operation part further includes:
a second side part that extends from the grip part, which is a first side part, in a direction intersecting the first direction of the one end portion; and
a third side part that extends from the grip part in a direction intersecting the first direction of the one end portion, and that opposes the second side part, and
the third side part has an opening that allows a user's hand to move therethrough toward the second side part.

9. The liquid container according to claim 1, further comprising
a container-side engagement part that is configured to be able to engage with an apparatus-side engagement part that is disposed on the liquid consumption apparatus so as to be able to support the liquid container.

10. The liquid container according to claim 9,
wherein the container-side engagement part is disposed along a direction that is parallel with the longitudinal direction of the one end portion.

11. The liquid container according to claim 1, wherein the container-side electrical connection part is located above the liquid supply part when oriented as in the attached state and the electrical connection part includes a contact part that is configured to come into electrical contact with the apparatus side electrical connection part.

12. The liquid container according to claim 11,
wherein the contact part is disposed on an inclined surface that is inclined with respect to the first direction.

13. The liquid container according to claim 11,
wherein the contact part comprises a plurality of contact portions, and
a plane defined by the plurality of contact portions is inclined with respect to the first direction.

14. The liquid container according to claim 11,
wherein the contact part is provided in a plurality of contact portions, and
the plurality of contact portions are arranged along a direction that intersects the first direction.

15. The liquid container according to claim 11,
wherein the container-side electrical connection part further includes a contact part-side positioning part that determines a position of the contact part with respect to the apparatus-side electrical connection part when the contact part is brought into contact with the apparatus-side electrical connection part.

16. The liquid container according to claim 1, wherein the container-side electrical connection part is supported by the operation part at a location near the farthest end of the operation part in the first direction.

17. The liquid container according to claim 1,
wherein at least two of the liquid supply part and the container-side electrical connection part, and the grip part, are arranged side-by-side in the first direction.

18. The liquid container according to claim 1,
wherein, in an attached state in which the liquid container is attached to the liquid consumption apparatus, the liquid supply part is located at a higher level than the liquid container part.

19. The liquid container according to claim 1, further comprising
a communication flow channel that allows for fluid communication between the liquid supply part and the liquid container part, configured such that liquid entering the flow channel initially travels from the liquid container part into the flow channel in a direction perpendicular to the first direction and then exits the liquid supply part in the first direction.

20. The liquid container according to claim 1,
wherein the liquid supply part has a supply opening positioning part that determines a position of the liquid supply opening with respect to the liquid introduction part when the liquid supply opening is connected to the liquid introduction part.

21. The liquid container according to claim 1,
wherein the liquid container part includes:
a first face and a second face that oppose each other in a direction that is perpendicular to the longitudinal direction of the one end portion, and that are flexible; and
a junction part that partially connects respective inner surfaces of the first face and the second face.

22. The liquid container according to claim 1, wherein the liquid container part comprises at least one flexible deformable face and
a restriction member is attached to the at least one flexible deformable face and the restriction member is more rigid than the deformable face.

23. A liquid container that is to be attached to a liquid introduction part of a liquid consumption apparatus and that supplies a liquid to the liquid consumption apparatus, the liquid container comprising:
a liquid container part that is at least partially flexible and that stores the liquid;
a liquid supply part that has a central axis extending along a straight line in a first direction, and that the liquid introduction part of the liquid consumption apparatus is to be connected to; and
an operation part connected to the liquid container part,
wherein the operation part further includes:
a first side part that is grippable, and that extends in a direction that is parallel with the first direction;
a second side part that intersects the first side part and that supports the liquid supply part; and
a container-side electrical connection part located at the first direction facing end of the operation part, the container-side electrical connection part configured to be brought into electrical contact with an apparatus-side electrical connection part on the liquid consumption apparatus, the container-side electrical connection part supported by the operation part and the container-side electrical connection part and the liquid supply part at least partially overlapping in the downward direction perpendicular to the first direction when oriented to be in a state of attachment to the liquid consuming apparatus.

24. A liquid container that supplies a liquid to a liquid consumption apparatus via a liquid introduction part disposed in the liquid consumption apparatus, the liquid container comprising:
a liquid supply part that is to be connected to the liquid introduction part;
a liquid container part that is at least partially flexible, and that has one end portion extending in a first direction that is parallel with a connecting direction in which the liquid supply part is connected to the liquid introduction part in a state in which the liquid container is attached to the liquid consumption apparatus; and an operation part connected to the liquid container part, wherein the operation part further includes:

a first side part that is grippable and extends in a longitudinal direction; and a second side part that extends from one end of the first side in a direction that intersects the first direction, the liquid supply part supported by the second side part;

a container-side electrical connection part located at the first direction facing end of the operation part, the container-side electrical connection part configured to be brought into electrical contact with an apparatus-side electrical connection part on the liquid consumption apparatus, the container-side electrical connection part supported by the operation part and the container-side electrical connection part and the liquid supply part at least partially overlapping a plane perpendicular to the connecting direction projected through both the container-side electrical connection part and the liquid supply part.

* * * * *